US005932827A

United States Patent [19]

Osborne et al.

[11] Patent Number: 5,932,827

[45] Date of Patent: Aug. 3, 1999

[54] SUSTAINER FOR A MUSICAL INSTRUMENT

[76] Inventors: Gary T. Osborne, 8230 Meadowbrook, Indianapolis, Ind. 46268; Alan A. Hoover, 33 W. Laverock, Indianapolis, Ind. 46208

[21] Appl. No.: 08/370,446

[22] Filed: Jan. 9, 1995

[51] Int. Cl.[6] ..... G01H 3/18

[52] U.S. Cl. ..... 84/726; 84/738

[58] Field of Search ..... 84/726, 727, 728, 84/738, DIG. 10, 725

[56] References Cited

U.S. PATENT DOCUMENTS

| | | |
|---|---|---|
| 472,019 | 3/1892 | Ohmart . |
| 1,002,036 | 10/1911 | Clement . |
| 1,893,895 | 1/1933 | Hammond . |
| 2,001,723 | 5/1935 | Hammond . |
| 2,119,584 | 6/1938 | Knoblaugh . |
| 2,455,567 | 12/1948 | Dearmond . |
| 2,600,870 | 6/1952 | Hathaway . |
| 2,672,781 | 3/1954 | Miessner . |
| 2,896,491 | 7/1959 | Lover . |
| 3,185,755 | 5/1965 | Williams . |
| 3,194,870 | 7/1965 | Tondreau . |
| 3,290,425 | 12/1966 | Stobaugh . |
| 3,291,888 | 12/1966 | Meazzi . |
| 3,456,063 | 7/1969 | Teranishi . |
| 3,571,480 | 3/1971 | Tichenor . |

(List continued on next page.)

FOREIGN PATENT DOCUMENTS

| | | |
|---|---|---|
| 461969 | 12/1949 | Canada . |
| 0527654A2 | 2/1993 | European Pat. Off. . |
| 673375 | 1/1930 | France . |
| 961543 | 5/1950 | France . |
| 52-151022 | 12/1977 | Japan . |
| 1343766 | 1/1974 | United Kingdom . |
| 1548285 | 7/1979 | United Kingdom . |
| WO9503686 | 2/1995 | WIPO . |

OTHER PUBLICATIONS

Heet Sound Products Inc., *EBOW Instructions*, Heet Sound Products Inc., Copyright Approximately 1978.

Motorola Inc., "Switching Audio Amplifier Uses Power MOSFETS", *Electronics World & Wireless World*, Jul. 1992.

Motorola Inc., "High Fidelity Switching Audio Amplifiers Using TMOS Power MOSFETs", Motorola Semiconductor App. Note AN1042, 1989.

(List continued on next page.)

*Primary Examiner*—William M. Shoop, Jr.
*Assistant Examiner*—Jeffrey W. Donels

[57] ABSTRACT

The invention relates to the provision of a sustainer that is compatible with single coil pickups and stacked, single coil pickups. In this regard, feedback is substantially eliminated by processing and altering the direct electromagnetic radiation emitted by the driver. Another aspect of the invention provides a musical instrument, and a sustainer for a musical instrument that overcomes the problems with shifting forces between magnetic fields that are present in some known prior art devices and that are worsened when the driver is placed between the neck pickup and the bridge pickup. Another aspect of the invention is to provide suitable drive force and battery life with half as many batteries of some known sustainers, thereby providing a high efficiency switching amplifier. Another aspect of the invention provides that the sustainer can be enabled or disabled by one momentary contact switch, thereby providing that the major components of the sustainer are responsive to a transition in a control signal. Another aspect of the invention provides a bi-lateral driver for emitting a lateral magnetic field into the string array. Another aspect of the invention changes the harmonic content of the substitution signal that replaces the driver output signal when the sustainer is enabled. Another aspect of the invention enables the user to limit the drive current to a predetermined level.

47 Claims, 28 Drawing Sheets

U.S. PATENT DOCUMENTS

| | | |
|---|---|---|
| 3,612,741 | 10/1971 | Marshall . |
| 3,662,223 | 5/1972 | Marshall . |
| 3,693,700 | 9/1972 | Berardi . |
| 3,742,113 | 6/1973 | Cohen . |
| 3,813,473 | 5/1974 | Terymenko . |
| 3,935,782 | 2/1976 | O'Brien . |
| 4,075,921 | 2/1978 | Heet . |
| 4,137,811 | 2/1979 | Kakehashi . |
| 4,143,575 | 3/1979 | Oliver . |
| 4,181,058 | 1/1980 | Suenaga . |
| 4,236,433 | 12/1980 | Holland . |
| 4,238,433 | 12/1980 | Holland . |
| 4,245,540 | 1/1981 | Groupp . |
| 4,248,120 | 2/1981 | Dickson . |
| 4,338,846 | 7/1982 | Pogoda . |
| 4,364,295 | 12/1982 | Stich . |
| 4,484,508 | 11/1984 | Nourney . |
| 4,519,287 | 5/1985 | Naruse . |
| 4,532,847 | 8/1985 | Youngblood . |
| 4,697,491 | 10/1987 | Maloney . |
| 4,852,444 | 8/1989 | Hoover . |
| 4,907,483 | 3/1990 | Rose . |
| 4,941,388 | 7/1990 | Hoover . |
| 4,995,293 | 2/1991 | Anderson . |
| 4,998,960 | 3/1991 | Rose . |
| 5,031,501 | 7/1991 | Ashworth . |
| 5,054,361 | 10/1991 | Usa . |
| 5,056,400 | 10/1991 | Wachi et al. . |
| 5,070,759 | 12/1991 | Hoover . |
| 5,123,324 | 6/1992 | Rose . |
| 5,182,546 | 1/1993 | Shinbori et al. . |
| 5,189,242 | 2/1993 | Usa . |
| 5,200,569 | 4/1993 | Moore . |
| 5,200,685 | 4/1993 | Sakamoto . |
| 5,233,123 | 8/1993 | Rose . |
| 5,262,586 | 11/1993 | Oba . |
| 5,292,999 | 3/1994 | Tumura . |
| 5,336,845 | 8/1994 | Lace . |
| 5,378,850 | 1/1995 | Tumura . |
| 5,404,090 | 4/1995 | Shinbori . |
| 5,449,858 | 9/1995 | Menning . |
| 5,459,283 | 10/1995 | Birdwell . |
| 5,523,526 | 6/1996 | Shattil . |
| 5,569,872 | 10/1996 | Gimpel . |
| 5,585,588 | 12/1996 | Tumura ..... 84/726 |

OTHER PUBLICATIONS

Int'l.Rectifier Corp., *HEXFET Databook Power MOSFET Application and Product Data*, HDB–1,Int'l. Rectifier Corp.,pp. 20 and 21,1981.

Walter G. Jung, *IC OP–Amp Cookbook*, pp. 199 and 200, Howard W. Sams & Co., Fifth Printing 1989.

Maniac Music Inc., *Operating Instructions Sustainiac Model GA–1*, Maniac Music Inc., Copyright 1989.

Maniac Music Inc., *Installation Guide Sustainiac Model GA–1*, Maniac Music Inc., Copyright 1989.

Maniac Music Inc., *Alignment and Check–Out Guide Sustainiac Model GA–1*, Maniac Music Inc., Copyright 1989.

Maniac Music Inc., *Bridge Pickup Selection Guide Sustainiac Model GA–1*, Maniac Music Inc., Copyright 1989.

Maniac Music Inc., *Pickup Installation Guide Sustainiac Model GA–1*, Maniac Music Inc., Copyright 1989.

Maniac Music Inc., *Pickup Location Diagram* (for Sustainiac Model GA–1, Maniac Music Inc., Dec. 23, 1988.

Maniac Music Inc., *Circuit Board Hook–Up Diagram Model GA–1 for 3 Pickups*, Maniac Music Inc., Dec. 23, 1988.

Maniac Music Inc., *Circuit Board Hook–Up Diagram Model GA–1 for 2 Pickups*, Maniac Music Inc., Dec. 23, 1988.

Maniac Music Inc., *Circuit Board Hook–Up Diagram Model GA–1 for 1 Pickup*, Maniac Music Inc., Dec. 23, 1988.

Maniac Music Inc., *Sustainiac Model GA–1 Rev. D* Schematic Diagram, Maniac Music Inc., Dec. 23, 1988.

Fernandez Co Ltd., *1995–96 Fernandez Guitars USA Catalog*, Inside Front Cover and p. 1, Fernandez Co Ltd., 1995.

Frederic J. Mowle, *A Systematic Approach to Digital Logic Design*, Addison Wesley, Copyright 1976.

Hal Chamberlin, *Musical Applications of Microprocessors*, Hayden Books, Copyright 1985.

Texas Instruments Inc., *TMS320 Digital Signal Processors—Moving Your Ideas Ahead Faster*, Texas Instruments, 1994.

Texas Instruments Inc., *TMS320C5X User's Guide*, Texas Instruments Inc., 1994.

Texas Instruments Inc., *TMS320 Family Development Support Reference Guide*, Texas Instruments Inc., 1994.

Texas Instruments Inc., *Third–Party Support*, Texas Instruments Inc., 1994.

John Strawn, *Digital Audio Signal Processing an Anthology*, William Kaufman, 1985.

John G. Proakis and Dimitris G. Manolakis, *Introduction to Digital Signal Processing*, Macmillan Publishing Co., 1988.

Audio Sound Int'l Inc., *Sustainiac GA–2R Retro–Fit Kit Guitar Sustain System Installation*, ASI, 1989.

Maniac Music Inc., *Sustainiac Model GA–2 Standard Installation*, ASI, 1989.

Maniac Music Inc., *Sustainiac Model GA–2 Alternate Installation*, ASI, 1989.

Maniac Music Inc., *Sustainiac Model GA–2 Standard Block Diagram*, ASI, 1989.

Maniac Music Inc., *Sustainiac Model GA–2 Alternate Block Diagram*, ASI, 1989.

Maniac Music Inc., *GA–2L Rev. B 7–6–89* Schematic Diagram, ASI, 1989.

Hayt and Kemmerly, *Engineering Circuit Analysis*, Chapter 13, McGraw–Hill, 1978.

British Patent Application 85/237,729 by Michael Brook *Making Music* Magazine, The Infinite Guitar, p. 6, Apr. 1987, Issue 13, London England.

Letter to Brian Gibson, IVL Technology Ltd, Dec. 16, 1985, from Michael Brook. Sustainiac Splitter Schematic, Maniac Music,Inc.,Oct. 31, 198 .

Sustainiac Splitter Schematic, Maniac Music,Inc.,Oct. 31, 1986 .

Ibanez TS9 Tube Screamer Service Manual No. 004, Author and Publish Date Unknown.

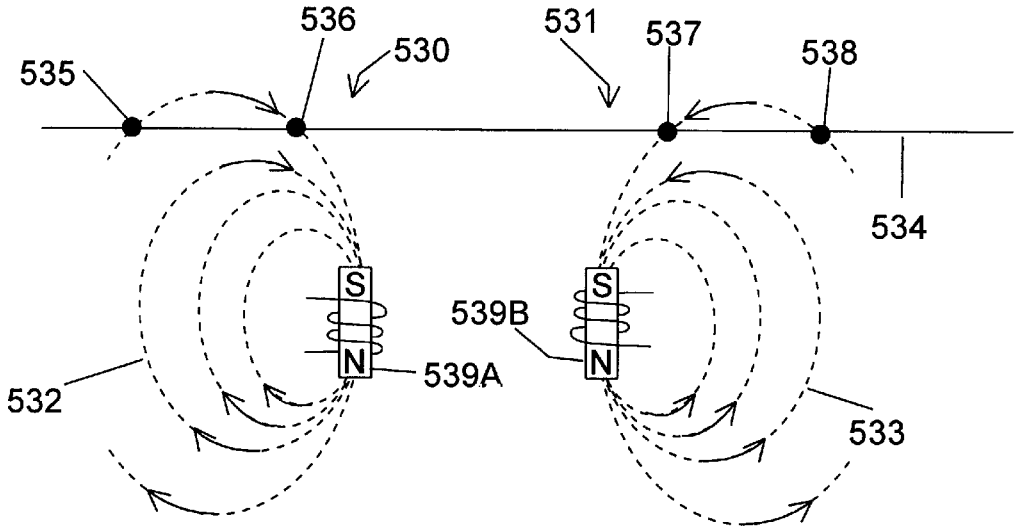
FIGURE 5(c)
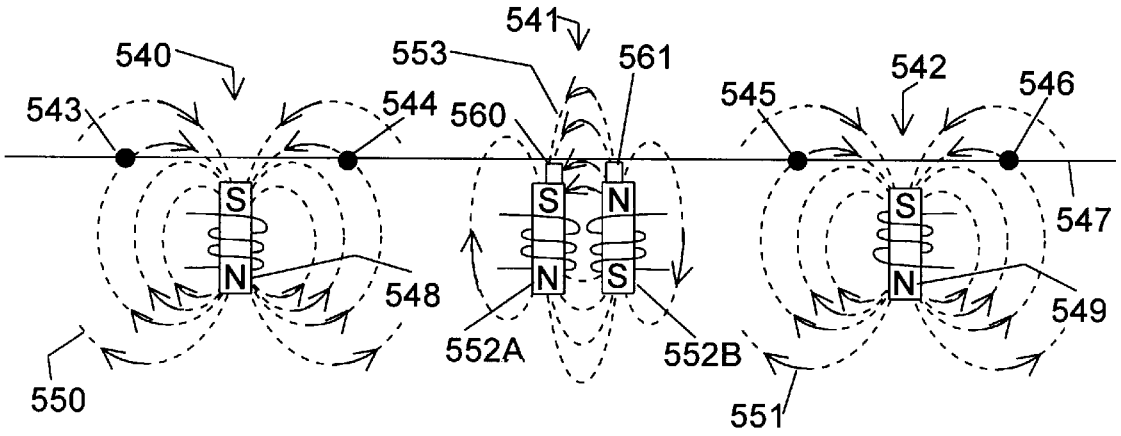
FIGURE (5d)

823
0
806
805
814
806
805
806
818
time
807
807
807

815
V1
808
818
time
t1
t2
t3
t4

V2
816
V1
V3
811
818
time
t5
t6
t7
t8
t9
t11
t12
t13

817
812
818
time
t14
t15
t16
t17

DRIVER
MIDDLE PICKUP
R50
1000
LED1
218B
218A
IN
IN
OUT
OUT
215
205B
205A
102
C14
470uF
1107
V2
Vo
R26
0.1
ohm U1: LM324
U2: LM358
U3: LM339
U4: IRF7107
U5: CD4011
U6: CD4001
109A
130C
VR1
DRIVE
250K
130A
130B
MPU
14
15
V1
R25
1M
R24
10K
U5A
R16
22K
C13
100pF
R17
3300
V4
U3C
U3D
CURRENT-SOURCE
AMPLIFIER
1112
1111
DRIVE CURRENT LIMITER
U3A
R23
4700
C11
2200pf
C12
820pF
Q7
R21
82K
R22
1M
R15
100K
U1B
R18
100K
U3B
R20
1M
C10
10uF
R14
1000
D
G
S
C9
10uF
R12
100K
BRPU
R19
10K
R13
100K
NPU MPU
R46
220
C23
0.22uF
R45
100K
V1
Vo
C24
0.22
uF
R44
100
C22
1000pF
LOW NOISE PREAMP
1117
1100

1114
V4
V3
Q8
C28
10uF
COMPARATOR
SUPPLY
CR4
1N4148
R49
220K
C26
10uF
V3
R40
6800
R41
1000
Q10
R43
10K
C21
.047uF
R42
220
R39
1M
C25
10uF
R38
15K
1113
FLIP-FLOP
U6A
U6B
R37
4.7M
R53
1M
131B
131A
SW1
ON-OFF
MOMENTARY SPST
ONOFF
109B
CR6
1N4148
CR5
1N4148
MPU2

MPU2
ONOFF
Q6
S
G
D
C19
100pF
C20
.01uF
Vo
MIDDLE
GATE FILTER
1116
CR2
1N4148
R37
4.7M
R17
4.7M
CR3
1N4148
PICKUP SELECTOR LOGIC
V3A
U5A
U5B
U6D
R32
4.7M
U5D
U6C
R33
4.7M
R34
4.7M
C18
0.1uF
1104
PICKUP COMBINER
R30
22K
R31
22K
C2 .047uF
1115
110
PICKUP
SELECTOR
SWITCH
BRIDGE
MIDDLE
NECK
141A
141B
141C
SW2
140
1118
BATTERY
SUPPLY
C17
10uF
R36
1000
Q9
V3
V2
CR1
1N5817
C16
470uF
B1
9v
700
107
VR2
VOLUME
250K-A
C29
0.1uF
108
VR3
TONE
250K
A
1/4"
OUTPUT
JACK
J1
1119
1120

SUSTAINER FOR A MUSICAL INSTRUMENT

TECHNICAL FIELD OF THE INVENTION

This invention relates to the art of musical instruments, and more particularly to those instruments such as electric guitars having an amplifier connected between a pickup and a driver to sustain the vibration of a vibratory element, such as the strings of the guitar.

BACKGROUND OF THE INVENTION

Electrically amplified musical instruments having pickups and sustain-inducing drivers typically operate in the following manner: The pickup provides a feedback signal representative of the vibration of the vibratory element (such as a string or a head of a percussion instrument). The amplifier accepts the feedback signal from the pickup and provides a drive signal to the driver. The driver accepts the drive signal and provides a drive force to the vibratory element that sustains the vibration of the vibratory element.

The most common musical instrument of this type is a stringed musical instrument such as a guitar, which includes a plurality of magnetically permeable strings. Vibration of a string disturbs the magnetic field associated with the pickup. The pickup provides a feedback signal representative of the string vibration. The amplifier boosts the current and voltage of the feedback signal to provide a drive signal. The drive signal is then applied to the driver. The drive signal causes a disturbance in the magnetic field emitted by the driver which applies a drive force to the string. This drive force emitted by the driver comprises a magnetic field that impinges upon the string. The drive force reinforces the string vibration thereby sustaining the string vibration. An example of an electrified, stringed musical instrument for which the present invention is especially well adapted is the Fender STRATOCASTER guitar, and various STRATOCASTER copies referred to as "Strats".

Prior art electric guitars generally comprise a structure having a body portion and a neck portion coupled to, and extending away from the body portion. A plurality of strings are supported by the body portion and neck portion. A bridge is provided on the body to support one end of each string. A bridge pickup is disposed underneath the strings in close proximity to the bridge. The bridge pickup provides a signal representative of string vibration near the bridge. The bridge pickup signal emphasizes the higher harmonic frequencies of the vibrating strings because the bridge pickup is located near one end of the strings. A neck pickup is disposed underneath the strings at a location remote from the ends of the strings. The neck pickup provides a signal representative of string vibration remote from the ends of the strings. The neck pickup signal emphasizes the fundamental frequencies of the vibrating strings because the neck pickup is located remote from the ends of the strings.

Some models of known instruments provide a middle pickup disposed underneath the strings, and positioned between the bridge pickup and the neck pickup. Because of its positioning, the middle pickup provides a signal representative of string vibration between the bridge pickup and neck pickup. The middle pickup signal provides a balanced mix of fundamental frequencies and higher harmonic frequencies of the vibrating strings. From a musically artistic aspect, it is generally accepted that the bridge pickup and neck pickup are of greater importance than the middle pickup, as demonstrated by the fact that some popular electric guitar models do not provide any middle pickup.

Numerous designs of prior art pickups have evolved over the past 40 years to be highly optimized for their intended artistic uses. One of the challenges involved in the design of a driver is to make it compatible with existing pickups. For example, one prior art multi-string driver is the GA-2 driver manufactured by Audio Sound International, Inc. This driver is disposed underneath the strings at the neck pickup position. In the GA-2 sustainer, the bridge pickup provides the feedback signal to the amplifier. This arrangement provides a relatively long distance between the driver and the bridge pickup to decrease the effects of direct magnetic feedback on the pickup. However, one disadvantage with this arrangement is that it replaces the highly-optimized prior art neck pickup with a driver. To overcome this disadvantage, the driver of the present invention is disposed underneath the strings between the neck pickup and the bridge pickup. The driver is not disposed in close proximity to either the bridge pickup or the neck pickup to thereby decrease the shifting of the intersection between the strings and the magnetic fields emitting from the pickups. The driver of the present invention emits a narrowly dispersed lateral magnetic field to further decrease shifting of the intersection.

A typical prior art pickup emits a magnetic field from its core that impinges on the strings. The pickup's magnetic field has a predetermined three dimensional shape that is governed by the geometry of the pickup's magnetic core. The intersection between the pickup's magnetic field and the strings provides the characteristic tonality of the pickup. Since different string harmonic frequencies have nodal points at different points along the string, the length and location of intersection determines the pickup's sensitivity to the different harmonics.

When a driver is place in proximity to the pickup, the nature (e.g., length and location) of the intersection is changed due to the shifting force between the magnetic field of the pickup and the magnetic field of the driver. This interaction occurs because the magnetic field emitting from the driver applies a shifting force that repels a like-polarity magnetic field emitting from the pickup, thereby shifting the shapes and locations of the driver's magnetic field and the pickup's magnetic field. Likewise, the magnetic field emitting from the driver applies a force that attracts an opposite-polarity magnetic field emitting from the pickup also causing shifting.

The shifting force shifts the predetermined shape of the magnetic fields emitted by the driver and the pickups, and adversely affects the characteristic tonality of the bridge pickup and the neck pickup, thereby diminishing the artistic expression. For example, if the magnetic field associated with the bridge pickup is repelled away from the driver in the direction of the bridge, the flux density directly above the bridge pickup, will be less than it would have been had the shifting force not been present. Furthermore, the flux density will be greater between the bridge pickup and the bridge because the driver's magnetic field shifts the bridge pickup's magnetic field toward the bridge. Such a shift in the flux density causes a shift in the intersection between the pickup's magnetic field and the strings. Due to this shift, the bridge pickup will have a greater response to string vibration nearer the bridge than it otherwise would have had. Therefore, since string vibration nearer the bridge is richer in harmonic frequencies, the shifting force produces a tonality from the bridge pickup that will be subjectively "brighter".

It is therefore one objective of the present invention to provide a musical instrument, and a sustainer for a musical instrument that overcomes these problems with shifting forces that are present in some known prior art devices and that are worsened when the driver is placed between the neck pickup and the bridge pickup.

SUMMARY OF THE INVENTION

In accordance with a first aspect of the present invention, a musical instrument is provided comprising a structure which includes a body and a neck for supporting at least one vibratory element. The instrument includes a first pickup means, capable of emitting a first magnetic field, for providing a first feedback signal responsive to an intersection of said vibratory element and the first magnetic field emitting from said first pickup means. The first pickup means is disposed between the body and the vibratory element. Also included is a second pickup means, capable of emitting a second magnetic field, for providing a second feedback signal responsive to an intersection of said vibratory element and the second magnetic field emitting from said second pickup means. The second pickup means is disposed between the body and the vibratory element. An amplifier means is coupled to at least one of the first and second pickup means for providing a drive signal in response to at least one of the first and second feedback signals. A driver means is coupled to the amplifier means for emitting a driver magnetic field for applying a drive force to said vibratory element in response to said drive signal. The driver means is disposed between the body and the vibratory element. A shifting force minimizing means segregates the shifting force applied by the driver magnetic field from at least one of (i) the intersection of the vibratory element and the first magnetic field and (ii) the intersection of the vibratory element and the second magnetic field.

To decrease the shifting force between the magnetic fields, the present invention provides a driver disposed in immediate proximity to neither the bridge pickup nor the neck pickup, rather the driver is separated from each of the pickups as much as possible, given the space constraints of the driver and the instrument. To further decrease shifting force, the driver has a pair of flux emitters disposed end-to-end and a gap narrowing means disposed between the emitters for narrowing a gap between the emitters.

Another aspect of the present invention relates to the provision of a driver that is compatible with single coil pickups and stacked, single coil pickups. In this regard, it is important to note that some known prior art sustainers that utilize a multi-string driver were generally incompatible with single-coil pickups and stacked single-coil pickups. The inherent susceptibility of these "single coil" pickups to the effects of direct magnetic feedback from the driver formerly rendered them unacceptable for use with these types of sustainers. To overcome this incompatibility, some prior art multi-string driver sustainers were used with humbucking pickups which are less sensitive to the effects of direct magnetic feedback than single coil pickups. Even though a humbucking pickup is more compatible with some sustainers than a single coil pickup is, the simple construction and characteristic tonality produced by a single-coil pickup makes it generally a more popular choice for many non-sustainer equipped musical instruments. Therefore, one object of this second aspect of the present invention is to provide a driver that is compatible with each of a single-coil pickup, a stacked single-coil pickup, and a humbucking pickup.

The use of single coil pickups with multi-string drivers presents a substantial problem relative to direct magnetic feedback between the driver and the pickup, especially when the driver is positioned between a neck pickup and a bridge pickup. The reasons for this problem are as follows; 1) disposing the driver between the neck pickup and the bridge pickup generally quadruples the effect of direct magnetic feedback because the distance between the driver and the pickup providing the feedback signal is generally cut in half and, 2) the inherent susceptibility of a single coil pickup to the effect of direct magnetic feedback provides a substantial increase in the effect of direct magnetic feedback. Such extreme direct magnetic feedback was not handled well by some of the prior art known to the applicants.

Furthermore, the use of single coil pickups and the reduced spacing between the driver and pickups brings about a second form of direct feedback (direct electrostatic feedback), that has been generally ignored until now. Direct electrostatic feedback is caused by capacitive coupling of the drive voltage between the driver and the pickup, and has the same effect on the feedback signal as direct magnetic feedback. Both forms of direct feedback (i) increase the probability of uncontrolled oscillation and (ii) contaminate the feedback signal with noise from the amplifier.

The combination of direct magnetic feedback and direct electrostatic feedback will be referred to in this application as "direct electromagnetic radiation." Direct electromagnetic radiation comprises any combination of its two constituents, direct magnetic feedback and direct electrostatic feedback. Together, the constituents provide an adverse composite effect on the feedback signal. The present invention provides means to substantially eliminate the effect of direct electromagnetic radiation on the feedback signal, by addressing both the direct magnetic feedback and the electrostatic feedback.

Therefore, in accordance with another aspect of the present invention, a sustainer is provided for a musical instrument having at least one vibratory element and a pickup means for providing a feedback signal in response to the disturbance of the magnetic field associated with said pickup means by the vibratory element, said feedback signal being affected by direct electromagnetic radiation. The sustainer comprises an amplifier means coupled to the pickup means and responsive to the feedback signal for providing a drive signal having both a drive voltage and a drive current. A driver means is provided for using the drive signal to apply a drive force to the vibratory element. The driver uses the drive signal to emit an electromagnetic radiation field. A feedback elimination means is provided for processing and altering the direct electromagnetic radiation for causing the electromagnetic radiation field emitted by the driver means to insubstantiality affect said feedback signal.

Another aspect of the present invention decreases the effect of direct electrostatic feedback by inverting the phase of the feedback signal. The amplifier applies a drive voltage to the driver. Direct electrostatic feedback between the driver and the pickup conveys a representation of the drive voltage to the pickup whereby a noise signal is produced that contaminates the feedback signal with a representation of the drive voltage. By inverting the feedback signal, the noise signal is phase inverted as well. The phase inversion decreases the effect of direct electrostatic feedback because the noise signal is applied to the amplifier out-of-phase with the drive signal. The phase inverted noise signal cancels the portion of the drive signal that produces the noise signal at the pickup. Means are also provided for enabling the driver to accept the phase inverted drive signal and provide a drive force that is generally in-phase with vibration of the string.

In accordance with this third aspect of the present invention, a sustainer is provided for a musical instrument having at least one vibratory element and a pickup means for providing a feedback signal in response to vibration of the vibratory element, said feedback signal being affected by direct electromagnetic radiation. The sustainer comprises an amplifier means coupled to the pickup means and responsive to said feedback signal for providing a drive signal having a drive voltage, and a driver means for using the drive signal to apply a drive force to the vibratory element in response to the drive voltage. Means are also provided for conveying direct electrostatic feedback comprising a representation of the drive voltage from the driver means to the pickup means. Further, means are provided for inverting the phase of said feedback signal to decrease the effect of direct electrostatic radiation, and for enabling the driver means to apply a drive force to the vibratory element that is generally in-phase with the vibration of the vibratory element.

As means for decreasing direct electrostatic feedback in some known prior art sustainers, shields comprising metallic foil were wrapped around the pickups and driver. This technique has the disadvantage of adding additional cost to the pickups and driver. The present invention utilizes the outer layers of wire that form the driver coils to provide a shield between the inner layers having the drive signal, and the pickups. In accordance with this aspect of the invention, a sustainer is provided for a musical instrument having at least one vibratory element, and a pickup means for producing a feedback signal responsive to the vibratory element. The sustainer comprises an amplifier means coupled to the pickup means for providing a fluctuating drive voltage and a generally constant reference voltage in response to the feedback signal. A driver means is provided for applying a drive force to the vibratory element in response to the drive voltage and the reference voltage. The driver means includes a core means having a first conductor means wrapped around the core means in a coiling configuration comprising a plurality of layers. The layers include an inner layer disposed relatively nearer the core means, and an outer layer disposed relatively farther away from the core means. The core means also includes a second conductor means wrapped around the core means in a coiling configuration comprising a plurality of layers, with the layers including an inner layer disposed relatively nearer the core means, and an outer layer disposed relatively farther away from the core means. The driver further includes a means for applying the drive voltage to the inner layers of both the first and second conductor means, and means for applying the reference voltage to the outer layers of both the first and second conductor means so that said outer layers provide electrostatic shielding between the inner layer and said pickup means.

Another aspect of the present invention provides an improved "power on" indicator. The prior art E-Bow sustainer provides a light emitting diode (LED) to indicate that power has been applied to the sustainer. When the E-Bow sustainer is in use, the LED emits light downwardly toward the body of the guitar. The prior art Kramer/Floyd Rose guitar sustainer provides an LED that emits light upwardly away from the body of the guitar. The disadvantage with these arrangements is that the light emitted by the LED is not easily viewed by the player when the guitar is in the conventional playing position. To overcome this disadvantage of the prior art, the invention provides an LED installed inside the cover that houses the driver. The LED emits light in a lateral direction away from the strings to be easily viewed by the player when the guitar is in the conventional playing position. In accordance with this aspect of the invention, a sustainer is provided for a musical instrument having (i) a plurality of generally longitudinally extending strings disposed in a side-by-side arrangement to define a generally laterally extending array of strings, and (ii) a pickup means for providing a feedback signal in response to string vibration. The sustainer comprises an amplifier means for providing a drive signal responsive to the feedback signal and a driver means capable of applying a drive force to the strings in response to the drive signal. The sustainer also includes a lamp means positioned for emitting light in a generally lateral direction away from the string array, and toward the eyes of the player of the instrument.

Another problem with some prior art sustainers relates to the means provided in the instrument for housing the power source for the sustainer. Some known prior art sustainers generally employed a cavity in the body of the musical instrument to accept a battery case for housing the batteries to provide power to the sustainer. A disclosure of this arrangement is provided on page 4 of the Sustainiac GA-2R Retro-Fit Kit Guitar Sustain System Installation Manual. A disadvantage of the arrangement disclosed in the said manual is that a wood router and other power tools are generally required to create the cavity in the guitar body, which adds time and cost to the installation of a prior art sustainer. To overcome the disadvantage, the sustainer of the present invention utilizes a cavity that already exists in the body of many "solid body" musical instruments to house the battery.

Musical instruments generally provide a cavity for housing an output jack attached to a cover plate. The output jack provides a means for conveying the output signal from the pickups, (which are located inside cavities in the body of musical instrument), to an external amplifier and speaker. Most such output jack cavities are generally large enough to hold one conventional 9-volt battery. The invention provides means to utilize this cavity for both a battery and an output jack. In accordance with this aspect of the invention, a musical instrument is provided which comprises a structure having a cavity, at least one vibratory element supported by the structure, and a first pickup means for providing a first feedback signal in response to the vibratory element. The instrument also includes an amplifier means coupled to the first pickup means for providing a drive signal in response to the first feedback signal, and a driver means coupled to the amplifier means for applying a drive force to the vibratory element in response to the drive signal. A battery means provides power to the amplifier means, and is housed within the cavity in the structure. A cover means is attachable to the structure for covering the cavity, and includes a jack means mateable with a plug means for conveying a signal between the inside and the outside of the cavity.

Another problem with some prior art sustainers related to their power requirements, and the means for supplying sufficient power to the sustainers. Some prior art sustainers employ two conventional 9-volt batteries to supply power to the amplifier, as two batteries are required to provide suitable drive force and battery life. Unfortunately two batteries are unable to fit within the "output jack" cavity of most solid body type electrical musical instruments, as there is generally only enough space available for one 9-volt battery. Thus, one aspect of this embodiment of the present invention is to provide suitable drive force and battery life with half as many batteries of some known sustainers, thereby providing energy efficiency enhancement means to increase the energy efficiency of the amplifier. Furthermore, improving the energy efficiency of the amplifier decreases the operating cost of the sustainer since fewer batteries per hour of use are consumed.

Prior art sustainers employ linear amplifiers to provide drive voltage and drive current to the driver. Linear amplifiers dissipate power internally, as heat, due to substantial voltage drops that occur across the semi-conductor output devices providing the drive current. This dissipated power is essentially wasted energy. The sustainer of the present invention provides a non-linear switching amplifier to decrease wasted energy. The semi-conductor output devices in the non-linear switching amplifier of the present invention operate in a switched-mode rather than in the linear-mode utilized by the prior art linear amplifiers. Such switched-mode operation provides that the semi-conductor output devices behave as switches having two operating conditions that include; (1) a saturation condition comprising low resistance to current flow through the device and low voltage drop across the device, and (2) a cut-off condition comprising high resistance to current flow through the device and high voltage drop across the device.

In switched-mode operation, the heat created through energy dissipation at the semi-conductor output devices is substantially eliminated. Thus, in accordance with this aspect of the present invention a sustainer is provided for a musical instrument having at least one vibratory element and a pickup means for providing a feedback signal in response to string vibration. The sustainer comprises an amplifier means including a semi-conductor output device means for providing a drive signal responsive to said feedback signal, and a driver means for applying a drive force to said vibratory element in response to said drive signal. An energy efficiency means is also provided for increasing the energy efficiency of said amplifier means by substantially eliminating power dissipation at said semi-conductor output device means.

Further in accordance with the preferred embodiment of this aspect of the present invention, a sustainer is provided for a musical instrument having at least one vibratory element and a pickup means for providing a feedback signal in response to string vibration. The sustainer comprises a comparator means for providing a drive-switch control signal in response to the comparison of said feedback signal to a threshold signal, and a drive-switch means responsive to said drive-switch control signal for providing a square-wave drive signal. The square-wave drive signal includes a rise-time period representative of the period of time to transition from a low output level to a high output level, and a fall-time period representative of the period of time to transition from a high output level to a low output level wherein said rise-time periods and said fall-time periods are substantially dependant on the switching speed of said drive-switch means. The sustainer also includes a driver means for applying a drive force to said vibratory element in response to said square-wave drive signal.

Another problem with some known prior art sustainers is that they had difficulty providing, or were unable to provide a uniform drive force and drive current throughout the entire frequency band of the musical instrument. Most prior art sustainers utilize amplifiers commonly referred to as voltage-source amplifiers. Voltage-source amplifiers provide a drive voltage (V) and allow the resultant drive current (I) to be determined by the actual impedance of the driver (Z) according to Ohm's law, I=V/Z. A voltage-source amplifier provides a drive voltage having a flat frequency response. However, the drive current decreases with increasing frequency because the impedance of a driver is characteristically inductive. Since the drive force applied to the strings is generally proportional to the drive current, the drive force also decreases with increasing frequency due to the characteristic impedance of the driver. To compensate for this inherently "non linear" frequency response, prior art sustainers have utilized equalization circuitry to boost the drive voltage at high frequencies so that the resultant drive current will be generally independent of frequency. One problem with such equalization circuits is that they are not self-adjusting. For mass quantity manufacturing of prior art sustainers, the equalization circuitry is designed to compensate for the characteristic impedance of a nominal driver. However, the manufacturing variations that occur in each individual driver cause variations in the actual impedance of the driver, which cause variations in the frequency response of the drive force. Furthermore, driver coils generally comprise copper wire. The temperature coefficient of copper is such that increased temperature increases the copper's resistance to the flow of current which also causes variations in frequency response. Thus, manufacturing variations and variations in temperature cause variations in drive current and drive force in the prior art sustainers.

To provide uniform drive current and drive force, the preferred embodiment of the invention provides compensation means responsive to the impedance of the driver to compensate the drive signal. This is provided by a current-source amplifier. The current-source amplifier of the invention provides a drive current (I) and allows the resultant drive voltage (V) to be determined by the actual impedance of the driver (Z) according to Ohm's law, V=(I) (Z). The current-source amplifier senses the driver current as a means for altering the frequency response of the drive voltage. The current-source amplifier provides a generally constant amplitude drive current, and allows the amplitude of the resultant drive voltage to be determined according to Ohm's law. Since the current-source amplifier provides a drive current having a flat frequency response, and since the impedance of the driver of the invention is characteristically inductive, the drive voltage increases with increasing frequency . Since the frequency response of the drive force is generally proportional to the frequency response of the drive current, the drive force has a generally flat frequency response in accordance with the frequency response of the drive current.

Thus in accordance with this aspect of the invention, a sustainer is provided for a musical instrument having at least one vibratory element, and a pickup means for providing a feedback signal in response to said vibratory element. The sustainer comprises an amplifier means for providing a drive signal in response to the feedback signal and a driver means for applying a drive force to the vibratory element in response to the drive signal. The sustainer also includes a compensation means responsive to the impedance of the driver means for compensating the drive signal.

Another feature of one embodiment of the present invention is that it more effectively deals with variations the drive current. Some known prior art sustainers utilize automatic gain control (AGC) circuits to limit the maximum amplitude of the feedback voltage to a predetermined level. As a by-product of their operation, these AGC's therefore limit the maximum amplitude of the drive voltage to a predetermined level as well. The disadvantage with this prior art arrangement is that the drive current is limited only to the extent that the limited drive voltage provides a maximum drive current according the impedance of the driver. Thus, variations in the impedance of the driver provide corresponding substantive variations in the actual drive current. The present invention eliminates this disadvantage by providing a current-sense signal responsive to the actual drive current. The current-sense signal is compared to a predetermined threshold, thereby providing an error signal. If the drive current exceeds the predetermined threshold, the error signal decreases the feedback signal until the drive current no longer exceeds the predetermined threshold. Thus the invention limits the amplitude of the drive current to a predetermined level.

According to this aspect of the present invention, a sustainer is provided for a musical instrument having at least one vibratory element, and a pickup means for providing a feedback signal in response to the vibratory element. The sustainer comprises an amplifier means for providing a drive current in response to the feedback signal, and a driver means for emitting a driver magnetic field that applies a drive force to the vibratory element in response to the drive current. Means are also provided for (i) providing a current-sense signal responsive to the drive current and (ii) for changing the amplitude of the feedback signal in response to a change in the current-sense signal.

Another set of problems that exist with some known prior art sustainers are the problems that arise as a result of the use of mechanical switches by the musical instrument. Prior art sustainers utilize mechanical switches to combine the output signals from the pickups with the driver output signal to produce an output signal. The output signal is applied to the output terminal of the output jack. The output jack mates with a plug that conveys the output signal to an external amplifier and speaker. The mechanical switches utilized by the prior art sustainers have several disadvantages. First, "contact bounce" within the switch introduces, noise into the signal being switched. Second, switch contacts wear out, thereby causing intermittent connections. Third, mechanical switches are costly, and finally, mechanical switches do not respond well (if at all) to control signals. To overcome these disadvantages, the present invention provides an analog switch to combine the pickup signals and driver output signal. Preferably, the analog switch comprises a gate chosen to accept a low power gate control signal to control the resistance between the input terminal and the output terminal of the analog switch. Preferably, the "on" resistance is less than about 300 ohms, and the "off" resistance is greater than about 1,000,000 ohms.

Therefore, in accordance with this aspect of the present invention, a sustainer is provided for a musical instrument having at least one vibratory element, and a pickup means for providing a feedback signal in response to the vibratory element. The sustainer comprises an amplifier means for providing a drive signal in response to the feedback signal, and a driver means for applying a drive force to the vibratory element in response to the drive signal. Additionally, the sustainer includes a means for providing an output signal in response to the vibratory element, an output jack means, and an analog switch means responsive to a transition in a control signal to enable the conveyance of the output signal to the output jack means. The output signal can be the same feedback signal that is provided to the amplifier or the output signal can be the driver output signal provided by the driver when the drive signal is not applied.

Furthermore, the invention provides analog switches to combine the feedback signals from the neck pickup and the bridge pickup. In accordance with this aspect of the present invention, a sustainer is provided for a musical instrument having at least one vibratory element, and a first pickup means for providing a first feedback signal in response to the vibratory element, and a second pickup means for providing a first feedback signal in response to the vibratory element. The sustainer comprises analog switch means responsive to a transition in an analog switch control signal for combining the first feedback signal with said second feedback signal to provide a composite feedback signal. The sustainer also includes an amplifier means for providing a drive signal in response to said composite feedback signal, and a driver means for applying a drive force to the vibratory element in response to the drive signal.

Another feature of the present invention provides a means for dealing with differences in the harmonic content of the driver output signal and the substitution signal that replaces the driver output signal while the drive signal is applied to the driver. Prior art sustainers generally utilize the driver as a means to provide an output signal representative of string vibration when the drive signal is not being applied to the driver. The driver output signal is provided to an external amplifier and speaker. When the drive signal is applied to the driver, one known prior art sustainer substitutes the driver output signal with the feedback signal from the pickup. The disadvantage with this arrangement is that the pickup's response to string harmonic frequencies is different than the driver's response, because the pickup is in a location along the length of the string that is different than the driver. The present invention overcomes this disadvantage by combining the feedback signals from both the neck pickup and the bridge pickup (of an instrument containing two pickups), and utilizing that combined signal as a substitute signal for the driver output signal when the drive signal is being applied. This combined signal is a better substitute for the driver output signal than either the bridge pickup feedback signal or the neck pickup feedback signal alone. In an alternate embodiment of the invention, the feedback signal is processed through a filter to provide the substitute signal. In both embodiments, the harmonic content of the substitute signal is modified by a sound modifier means. In neither embodiment however, does the sound modifier means change the harmonic content of the driver output signal.

In accordance with this aspect of the present invention, a sustainer is provided for a musical instrument having at least one vibratory element and a pickup means for providing a feedback signal in response to the vibratory element. The sustainer comprises an amplifier means for providing a drive signal in response to the feedback signal, and a driver means for applying a drive force to the vibratory element in response to the drive signal. Means are provided for selectively applying the drive signal to the driver means. Additionally, the sustainer provides means for enabling the driver means to provide a driver output signal responsive to the vibratory element while the drive signal is not being applied to the driver means. Means provide a substitution signal in response to the vibratory element. Sound modifier means change the harmonic content of the substitution signal independently of the driver output signal. A means is provided for substituting the substitution signal for the driver output signal while the drive signal is being applied to the driver means. The feedback signal can be combined with the substitution signal as a means to change the harmonic content of the substitution signal or, the feedback signal can be processed by a filter to change the harmonic content of the substitution signal.

Another feature of an embodiment of the present invention is that means are provided for improving the sound quality of the sustainer by eliminating the "pop" caused by the use of a mechanical enabling switch to enable or disable the sustainer. When the sustainer is enabled, one pole of the enabling switch enables the amplifier to provide the drive signal. Another pole of the enabling switch substitutes the substitution signal for the driver output signal. A change of the enabling switch that enables the sustainer is an enabling transition.

When the sustainer is disabled, one pole of the enabling switch disables the amplifier from providing the drive signal. Another pole of the enabling switch substitutes the driver output signal for the substitution signal. A change of the enabling switch that disables the sustainer is a disabling transition.

During the enabling transition, at least one known prior art sustainer utilizes the enabling switch for connecting the amplifier to the driver and disconnecting the driver from the transformer. Simultaneous with that, another pole of the enabling switch substitutes the substitution signal for the driver output signal. In addition to the disadvantages inherent to mechanical switches described above, a further disadvantage with this prior art arrangement is that the drive signal is applied coincident with the substitution of the driver output signal. This causes a "pop" to be heard in the external speaker. The present invention overcomes these disadvantages by providing a first control signal transition for initiating the substitution. Then, after the substitution has been completed, a second control signal transition is provided for applying the drive signal to the driver. In accordance with this aspect of the invention a sustainer is provided for a musical instrument having at least one vibratory element and pickup means for providing a feedback signal in response to the vibratory element. The sustainer comprises an amplifier means for providing a drive signal in response to the feedback signal, and a driver means for applying a drive force to the vibratory element in response to said drive signal. The sustainer also includes a means for providing a first control signal transition at a predetermined point in time, means responsive to said first control signal transition provide a second control signal transition at a point in time that is later than the first control signal transition. Additionally, means are provided for applying the drive signal to the driver in response to the second control signal transition. Means can be provided for substituting the substitution signal for the driver output signal in response to the first control signal transition.

During the disabling transition, at least one known prior art sustainer utilizes the enabling switch for disconnecting the amplifier from the driver and connecting the driver to a transformer. The transformer boosts the amplitude of the driver output signal. In addition to the disadvantages of mechanical switches disclosed above, a further disadvantage with this prior art arrangement is that a "pop" is heard in the external speaker because the driver is connected to the transformer (and therefore to the external speaker) while the drive current is still dissipating. To overcome this problem, the present invention provides a first control signal transition to remove the drive signal from the driver. Then, after the drive signal has dissipated, a second control signal transition is provided for substituting the driver output signal for the substitution signal.

In accordance with this aspect of the present invention, a sustainer is provided for a musical instrument having at least one vibratory element, and a pickup means for providing a feedback signal in response to said vibratory element. The sustainer comprises an amplifier means for providing a drive signal in response to the feedback signal, and a driver means for applying a drive force to said vibratory element in response to the drive signal. Means provide a first control signal transition at a predetermined point in time. Another means, responsive to the first control signal transition, provides a second control signal transition that is at a point in time that is later than the first control signal transition. Additionally, the sustainer includes means for removing the drive signal from the driver in response to the first control signal transaction. Means can be provided for substituting a driver output signal for a substitution signal in response to the second control signal transition.

Another feature of the present invention is that it eliminates the need for a transformer, thereby eliminating some of the costs and problems associated with the use of transformers. Some prior art sustainers employ a transformer to boost the amplitude of the driver output signal during the time that the drive signal is not applied to the driver. The disadvantage of using a transformer is that it is costly and susceptible to picking up noise from external magnetic fields. The sustainer of the present invention eliminates this disadvantage by employing a low noise preamplifier comprising discrete components.

In accordance with this aspect of the present invention, a sustainer is provided for a musical instrument having at least one vibratory element, and a pickup means for providing a feedback signal in response to the vibratory element. The sustainer comprises an amplifier means coupled to the pickup means for providing a drive signal in response to the feedback signal, and a driver means coupled to the amplifier means for applying a drive force to the vibratory element in response to the drive signal. The sustainer also includes a means for removing the drive signal from the driver means, and a means for enabling the driver means to provide a driver output signal in response to the vibratory element. The sustainer further includes a preamplifier means coupled to the driver means for boosting the amplitude of the driver output signal. The preamplifier means comprises a transistor means having an emitter terminal means, a collector terminal means, and a base terminal means, and a first resistance means connected between the emitter terminal means and a first voltage source means. The preamplifier also includes a second resistance means connected between the collector terminal means and a reference voltage, and a third resistance means connected between the base terminal means and a bias voltage. The transistor means can be a field effect transistor means having a gate terminal, a drain terminal, and a source terminal.

It is also a feature of an embodiment of the present invention that means are provided for facilitating the assembly of the sustainers. Prior art sustainers such as the Sustainiac GA-2R provide a circuit board housed in a cavity in the body of the musical instrument. Wiring harnesses are provided to connect the circuit board to the instrument's components such as the driver, pickup, batteries, and tone controls. The disadvantage with this prior art arrangement is that the entire musical instrument must be handled during the wiring process, which adds time and labor costs to the final product. The present invention overcomes this disadvantage by providing means to attach the sustainer components to the pick guard. Thus, only the pick guard is handled during the assembly and the wiring.

Therefore, in accordance with this aspect of the present invention, a sustainer assembly is provided for a musical instrument having (i) a structure for supporting a plurality of longitudinally extending strings disposed in a side-by-side arrangement to define a generally laterally extending array of strings, and (ii) a pick guard means disposed between said structure and said array of strings for protecting the top of said structure from damage, and (iii) a pickup means for providing a feedback signal in response to said string vibration. The sustainer assembly comprises a means for attaching said pickup means to said pick guard means, and an amplifier means for providing a drive signal in response to said feedback signal; said amplifier means being attached to said pick guard means. The sustainer also includes a driver means for applying a drive force to said strings in response to said drive signal, the driver means being attached to said pick guard means, and a power supply means for supplying power to said amplifier means. An output jack means is included for providing the feedback signal to an external speaker means, and a wire harness means is provided. The wire harness means connects (i) the pickup means to said amplifier means and (ii) the driver means to the amplifier means.

Another aspect of the present invention is designed to correct another problem that exists with some known prior art drivers. The prior art is abundant with sustain drivers that comprise a plurality of single-string drivers disposed side-by-side to apply drive force to a plurality of strings. Due to its small size, a single-string driver provides a magnetic field concentrated on an individual string. Such an arrangement provides an advantage over a multi-string driver with respect to the direct magnetic feedback, but a disadvantage relative to the lateral uniformity of the magnetic field. Conversely, the multi-string driver emits a magnetic field that is broadly dispersed across a plurality of strings. Due to its size, a prior art multi-string driver provides an advantage relative to the lateral uniformity of the magnetic field but a disadvantage relative to direct magnetic feedback, when compared to single string drivers. In contrast to both the prior art single string and multi-string drivers, the driver of the present invention provides an advantage relative both to direct magnetic feedback and to lateral uniformity of the magnetic field. In accordance with this aspect of the invention, a sustainer is provided for a musical instrument having (i) a plurality of generally longitudinally extending strings and disposed in a side-by-side arrangement to define a generally laterally extending array of strings, and (ii) a pickup means for providing a feedback signal in response to string vibration. The sustainer comprises an amplifier means for providing a drive signal responsive to the feedback signal, and a driver means for emitting a driver magnetic field capable of applying a drive force to said strings in response to the drive signal. The driver means includes a coil base means comprising a magnetic core means having a predetermined lateral width, a conductor means wrapped around the core means in a coiling configuration for providing magnetic flux and a plurality of magnetic flux emitter means. The magnetic flux emitter means are disposed generally in an end-to-end relation to form a generally laterally extending array positioned adjacent to the laterally extending array of strings. At least one of the magnetic flux emitter means has a lateral width substantially unequal to the lateral width of the coil base means. Adjusting the size of the flux emitter means can narrow a gap between a pair of adjacent magnetic flux emitter means.

In accordance with another aspect of the invention a sustainer is provided for a musical instrument having (i) a plurality of generally longitudinally extending strings disposed in a side-by-side arrangement to define a generally laterally extending array of strings, and (ii) a first pickup means for providing a feedback signal in response to string vibration. The sustainer comprises an amplifier means for providing a drive signal responsive to the feedback signal and a driver means capable of applying a drive force to the strings in response to said drive signal. The driver means includes a plurality of core means disposed generally in an end-to-end relation to form a generally laterally extending array generally adjacent to the array of strings. A first magnetic shunt means is provided for creating a magnetic imbalance between the first pickup means and the driver means. A positioning means is provided for enabling the magnetic shunt means to be adjustably positioned in each of a first position and a second position to permit the user to vary said magnetic imbalance between said first pickup means and said driver means. A retention means is provided for retaining said first magnetic shunt means in at least one of said first and second positions.

In accordance with another aspect of the invention a sustainer is provided for a musical instrument having (i) a plurality of generally longitudinally extending strings disposed in a side-by-side arrangement to define a generally laterally extending array of strings, and (ii) a first pickup means for providing a feedback signal in response to string vibration. The sustainer comprises an amplifier means for providing a drive signal responsive to the feedback signal and a driver means capable of applying a drive force to the strings in response to said drive signal. The driver means includes, a flux emitter means for emitting a generally laterally flowing magnetic flux into the strings to provide the drive force. A coil base means has a conductor wrapped around the coil base means in a coiling configuration for providing a magnetic flux flowing in a predetermined direction. Additionally, a redirecter means is provided for redirecting magnetic flux from the coil base means to the emitter means to provide the generally laterally flowing magnetic flux.

BRIEF DESCRIPTION OF THE DRAWINGS

The invention will be more clearly understood from the description as set forth below with reference to the accompanying drawings.

FIG. 1(*b*) shows that drive control 109A of the invention is adjusted by rotating knob 109C in the circular direction shown by arrow 132. FIG. 1(*b*) further shows that ON-OFF switch 109B of the invention is actuated by temporarily pressing down on knob 109C towards pick guard 111 in the direction indicated by arrow 133.

FIG. 1(*c*) shows that pickup selector switch body 110A of the prior art is attached to the underside of pick guard 111 with brackets 110C,10D and screws 117,118.

FIGS. 1 (*d*) and 2 show the preferred embodiment of pickups 101, 103, and driver 102 of the invention.

FIG. 3(*b*) shows the side view of cores 202A,202B and coils 203A,203B of the preferred embodiment driver 102 of the invention.

FIG. 5(*b*) shows, in schematic format, the end view of the elongated cores 512A,512B in a prior art humbucking pickup 510.

FIG. 5(*c*) shows, in schematic format, the shift in the intersection 535,536 of string 534 and magnetic field 532 emitting from pickup 530.

FIG. 5(*d*) shows, in schematic format, the arrangement of pickups 540 and 542 relative to driver 541 in the preferred embodiment of the invention.

FIG. 6(*b*) shows, in schematic format, prior art sustainer 619 having the effect of direct electromagnetic radiation represented by an equivalent transfer function G(s) 620.

FIG. 6(*c*) shows, in schematic format, an embodiment of the invention providing means to process and alter direct electrostatic radiation 615.

FIG. 6(*d*) shows, in schematic format, an embodiment of the invention providing means to process and alter direct magnetic feedback 648 substantially independently of direct electrostatic feedback.

FIG. 6(*e*) shows, in schematic format, an embodiment of the invention providing means process and alter direct electrostatic feedback 616 substantially independently of direct magnetic feedback.

FIG. 6(*f*) shows, in schematic format, an embodiment of the invention providing means to process and alter direct electrostatic feedback 616 substantially independently of direct magnetic feedback.

FIG. 8(*b*) shows, in graphical format, vibration 814 of prior art string 609 with respect to time 818B.

FIG. 8(*c*) shows, in graphical format, generally sinusoidal feedback voltage 808 provided by prior art pickup 600 to non-linear switching amplifier 821 of the invention.

FIG. 8(*d*) shows, in graphical format, square-wave drive voltage 811 provided to driver 602 by non-linear switching amplifier 821 of the invention when switch 819 is in the rightward position.

FIG. 8(*e*) shows, in graphical format, triangle-wave drive current 812 provided to driver 602 by non-linear switching amplifier 821 of the invention.

FIG. 8(*f*) shows, in schematic format, drive-switch 827 for accepting drive-switch control signal 803 and providing drive signal 813 in the preferred embodiment of the invention.

FIG. 9(*b*) shows, in graphical format, generally sinusoidal feedback voltage 808 provided by prior art pickup 600 to non-linear switching amplifier 821 of the invention.

FIG. 9(*c*) shows, in graphical format, pulse-width modulated square-wave drive voltage 811 provided to driver 602 by non-linear switching amplifier 821 of the invention when switch 819 is in the leftward position.

FIG. 9(*d*) shows, in graphical format, drive current 812 provided to driver 602 by non-linear switching amplifier 821 of the invention.

FIG. 12(*b*) shows, in schematic format, common-base low noise discrete preamplifier 1220 of the invention.

FIG. 14(*b*) shows, in schematic format, the top view of bi-lateral driver 1403 in sustainer 1400 of the preferred embodiment of the invention.

FIG. 14(*c*) shows, in schematic format, the end view of bi-lateral driver 1403 in sustainer 1400 of the preferred embodiment of the invention.

FIG. 15(*b*) shows, in side view, an alternate embodiment of lateral driver 1500.

FIG. 16(*b*) shows, in side view, an alternate embodiment of lateral driver 1600.

FIG. 16(*c*) shows, in top view, an alternate embodiment of lateral driver 1600.

FIG. 17(*b*) shows, in side view, an alternate embodiment of lateral driver 1700.

FIG. 17(*c*) shows, in top view, an alternate embodiment of lateral driver 1700 having magnets 1703A, 1703B removed.

FIG. 18(*b*) shows, in side view, an alternate embodiment of lateral driver 1800.

FIG. 18(*c*) shows, in top view, an alternate embodiment of lateral driver 1800.

DETAILED DESCRIPTION OF PREFERRED EMBODIMENTS

Figure 1A:
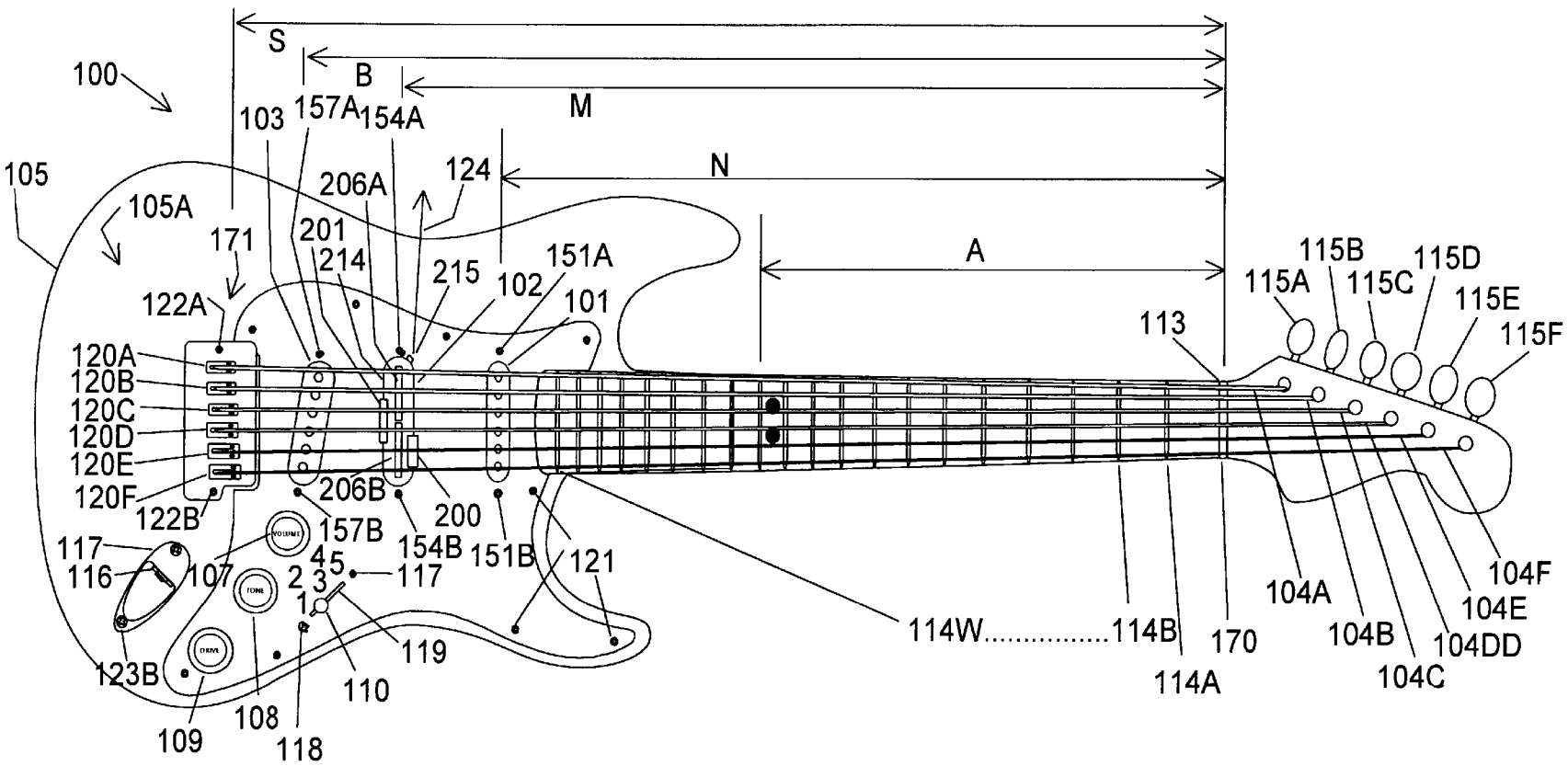
FIG. 1(*a*) shows, in top view, the preferred embodiment of driver 102 of the invention installed on a prior art electric guitar 100 commonly referred to as a "Strat".
Figure 1B:
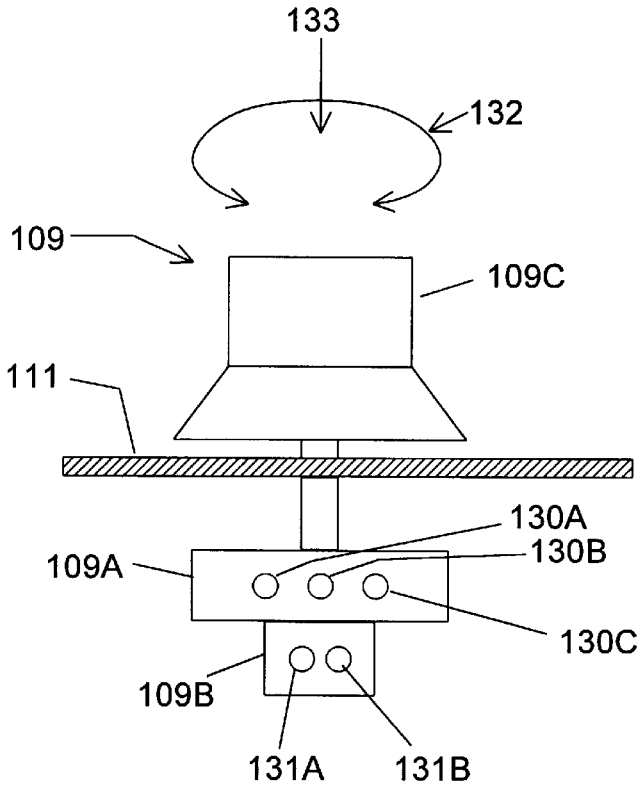
Figure 1C:
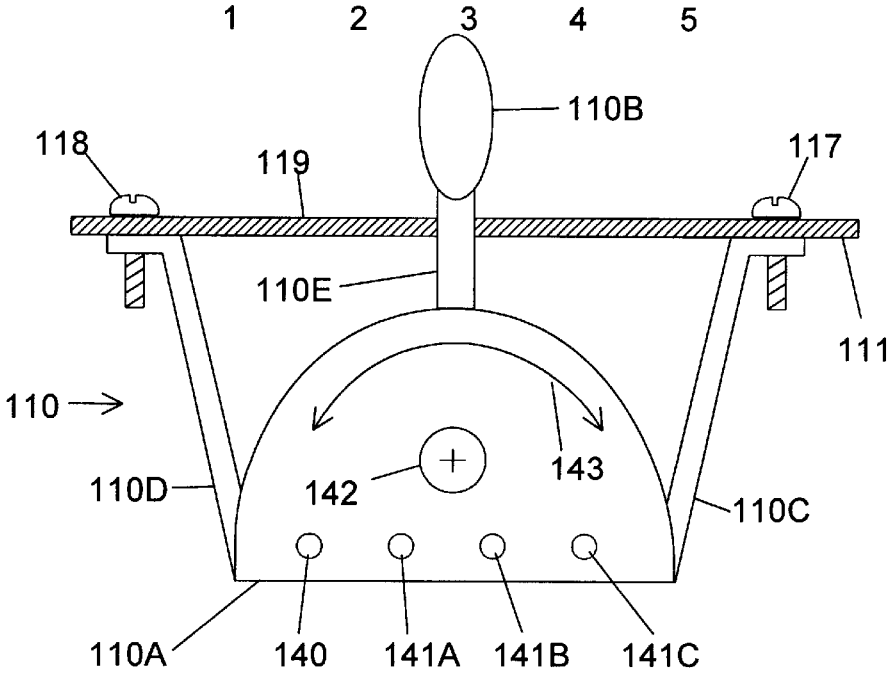
Figure 1D:
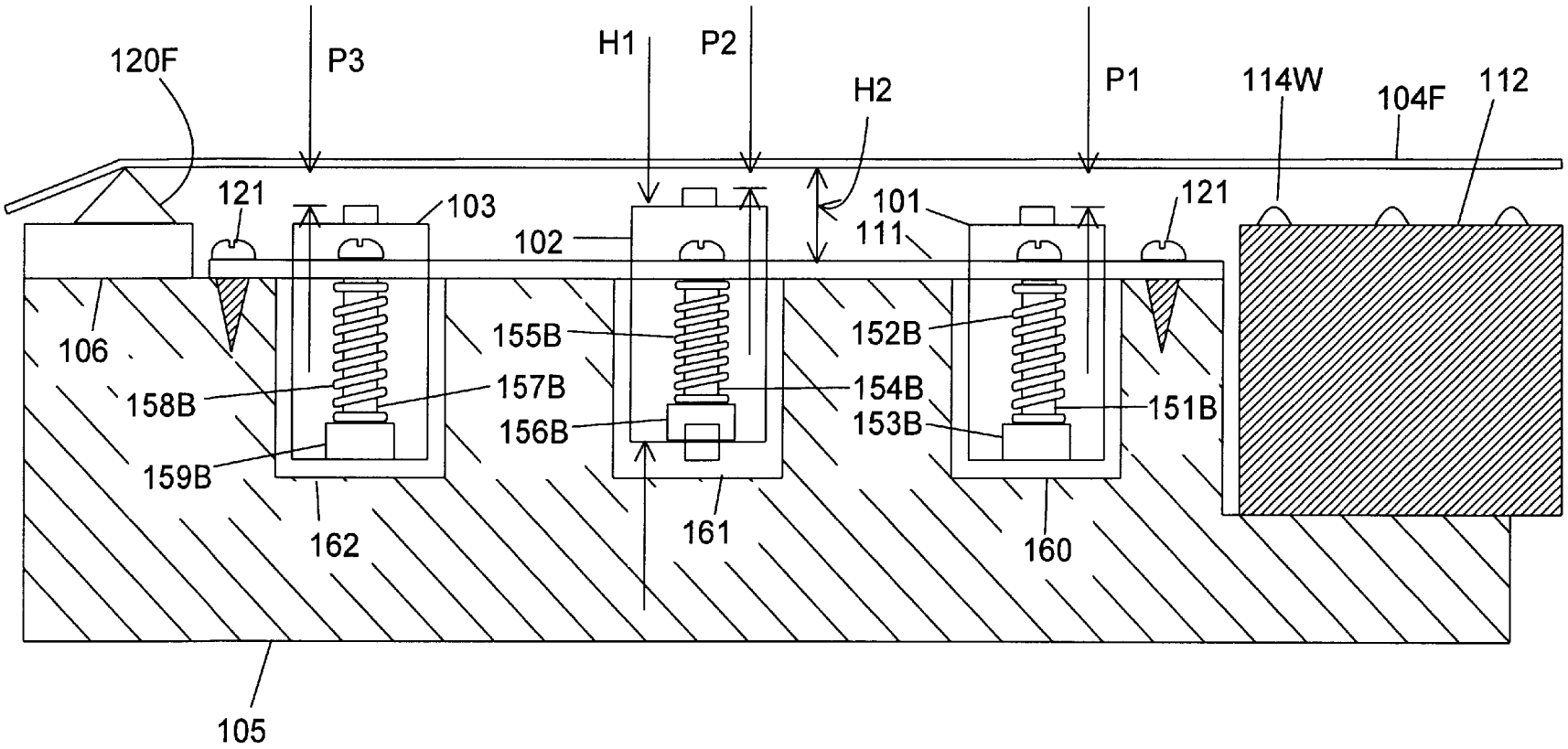

FIG. 1(*a*) shows, in top view, the preferred embodiment of driver 102 of the invention installed on a prior art electric guitar 100 commonly referred to as a "Strat". Driver 102 of the preferred embodiment the invention is located between prior art bridge pickup 103 and prior art neck pickup 101.

Guitar 100 has the following prior art components; a structure including body 105; elongated neck 112 extending away from the body 105 in a lengthwise direction; plurality of frets 114A to 114W, plurality of strings 104A through 104F disposed above neck 112 and body 105, plurality of tuning keys 115A to 115F for tuning the pitch of the strings 104A through 104F, nut 113, bridge 106, pick guard 111, volume control 107, tone control 108, output jack 116 mounted on jack plate 117, neck pickup 101, bridge pickup 103, and pickup selector switch 110. Not shown in FIG. 1(*a*) is middle pickup 199 which would be located between bridge pickup 103 and neck pickup 101 if guitar 100 was not equipped with a sustainer. Pick guard 111 is a rigid sheet of material such as plastic, wood, or metal to which all of the major electrical components are attached. Pick guard 111 protects top 105A of body 105 from damage due to plectrums and fingernails used to pluck strings 104A through 104F.

Strings 104A through 104F are generally made of stainless steel and supported under tension. Bridge 106 is secured to body 105 with screws 122A,122B. String saddles 120A to 120F on bridge 106 hold strings 104A through 104F in position above body 105. Nut 113 holds strings 104A through 104F in position above neck 112. Tuning keys 115A to 115F are provided to apply tension to strings 104A through 104F and transfer the string tension to neck 112. Therefore, neck 112 supports strings 104A through 104F on one end and bridge 106 supports them on the other end so that each string extends generally in the same longitudinal direction from the bridge 106 to the nut 113. Strings 104A through 104F are disposed side-by-side above the neck 112 and body 105 to generally define an array of strings 104 having widthwise lateral direction transverse to the longitudinal direction and generally parallel to the top of body 105. Vibrations of strings 104 occurs between saddles 120A–120F and nut 113, the linear distance measured between saddles 120A–120F defining scale length S. Scale lengths are typically 24 to 26 inches in length but substantially shorter or longer scale lengths are practicable.

Figure 5A:
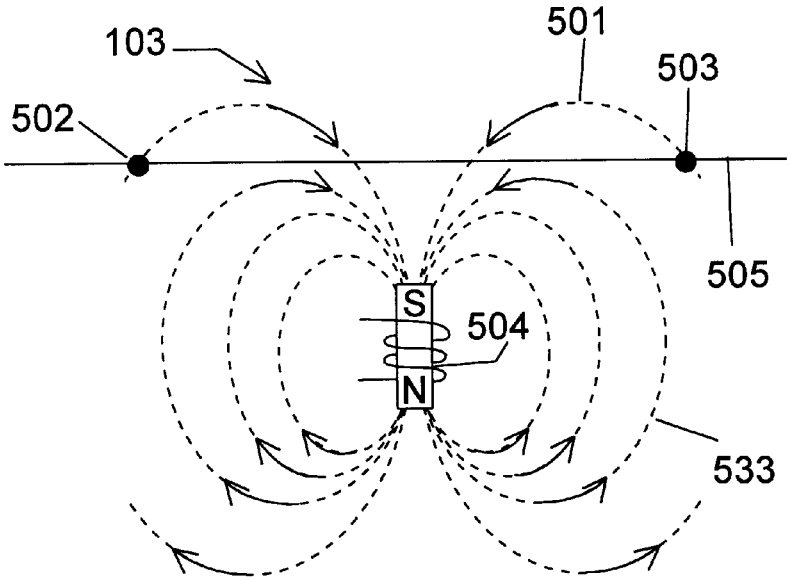
FIG. 5(*a*) shows, in schematic format, the end view of elongated core 504 of prior art pickup 103 and its associate broadly dispersed magnetic field 501 impinging on string 505.
Figure 5B:
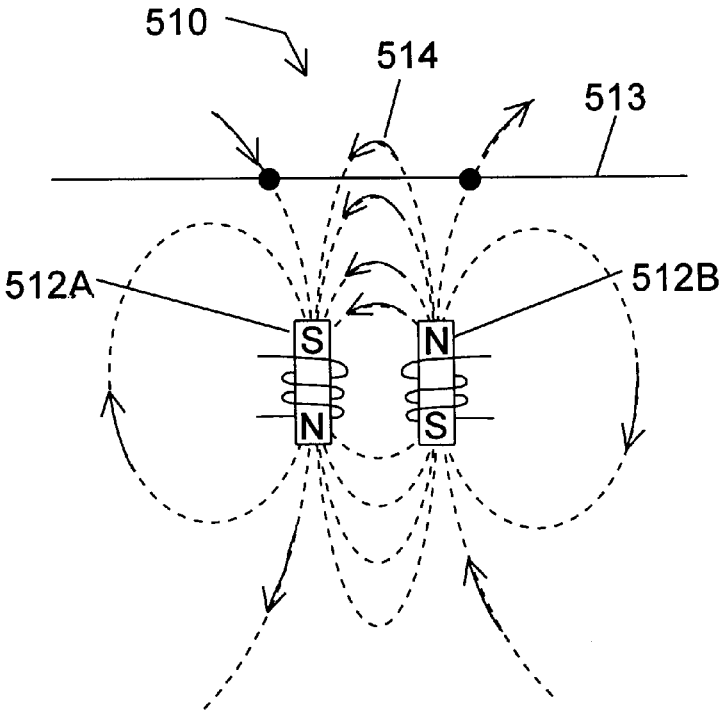
Figure 6A:
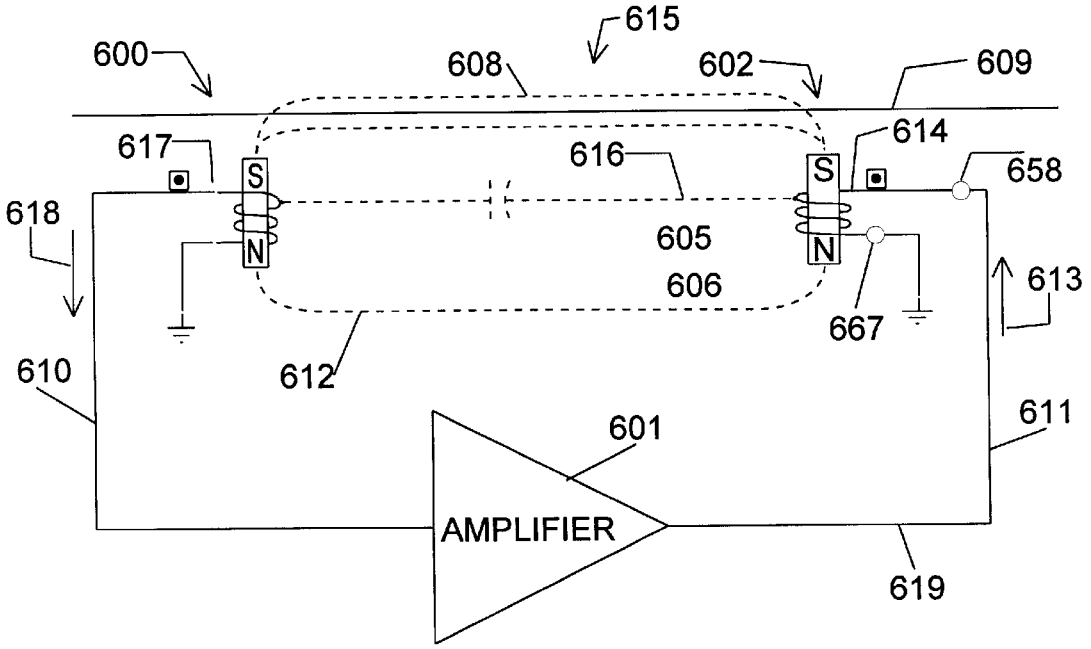
FIG. 6(*a*) shows prior art sustainer 619 in schematic format.
Figure 6B:
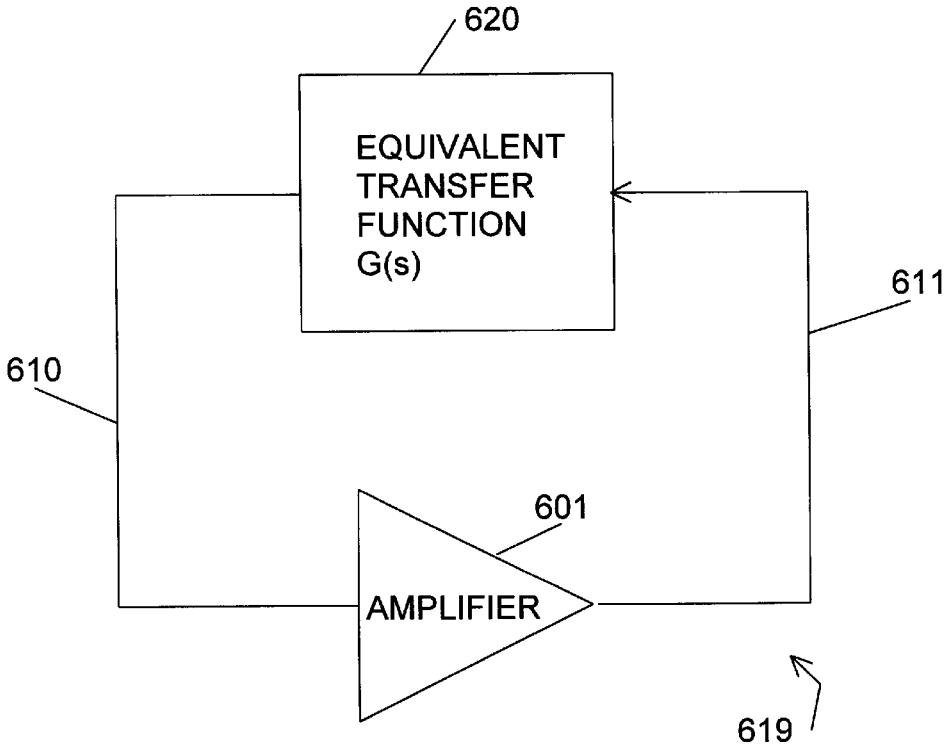
Figure 6C:
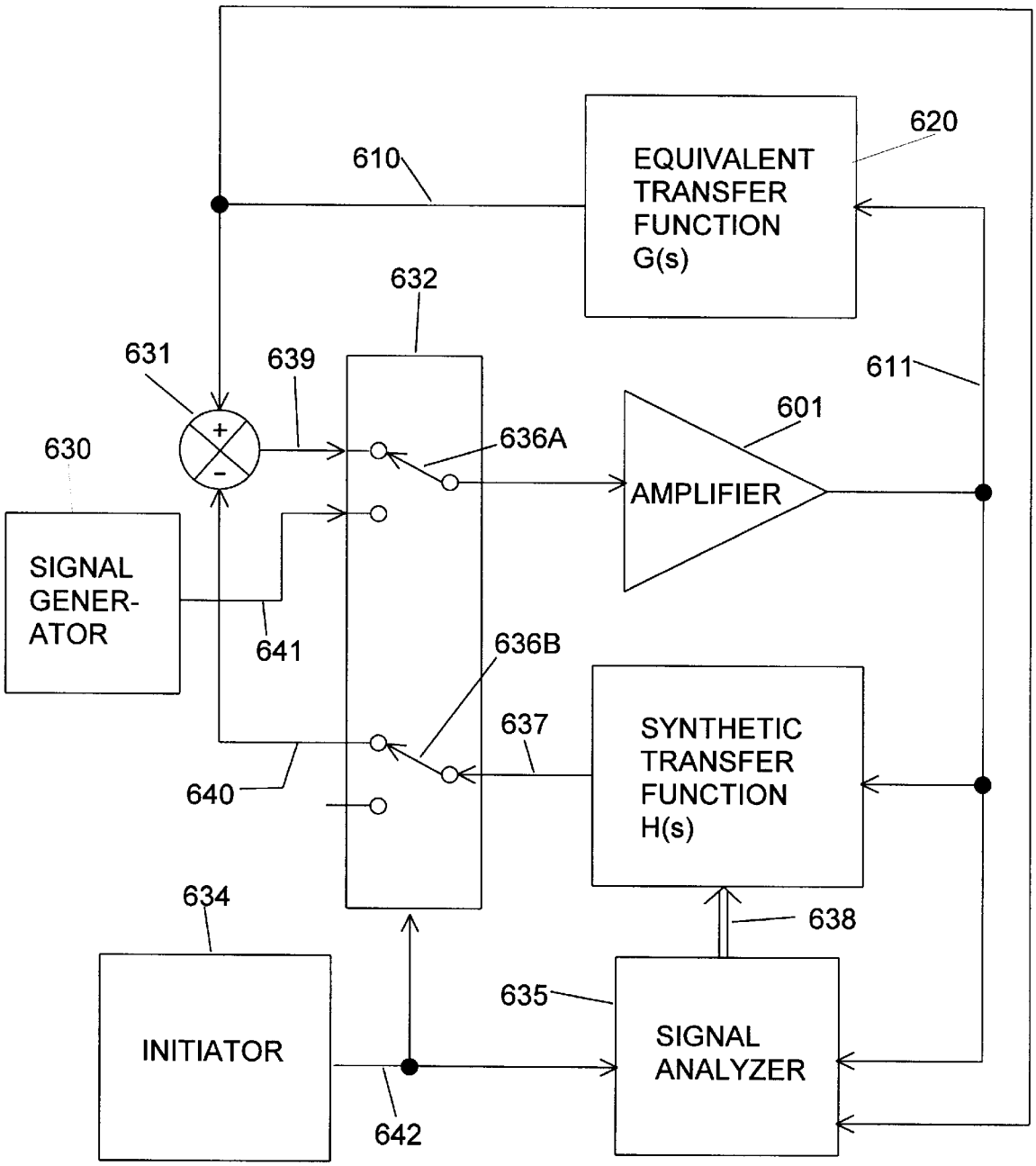
Figure 6D:
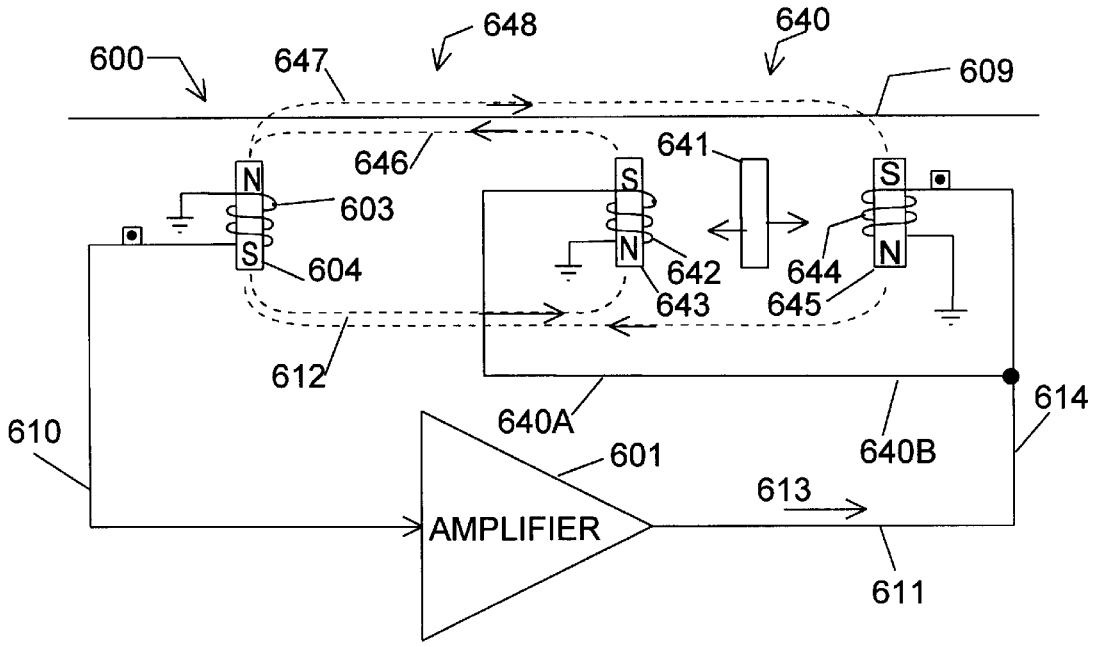
Figure 6E:
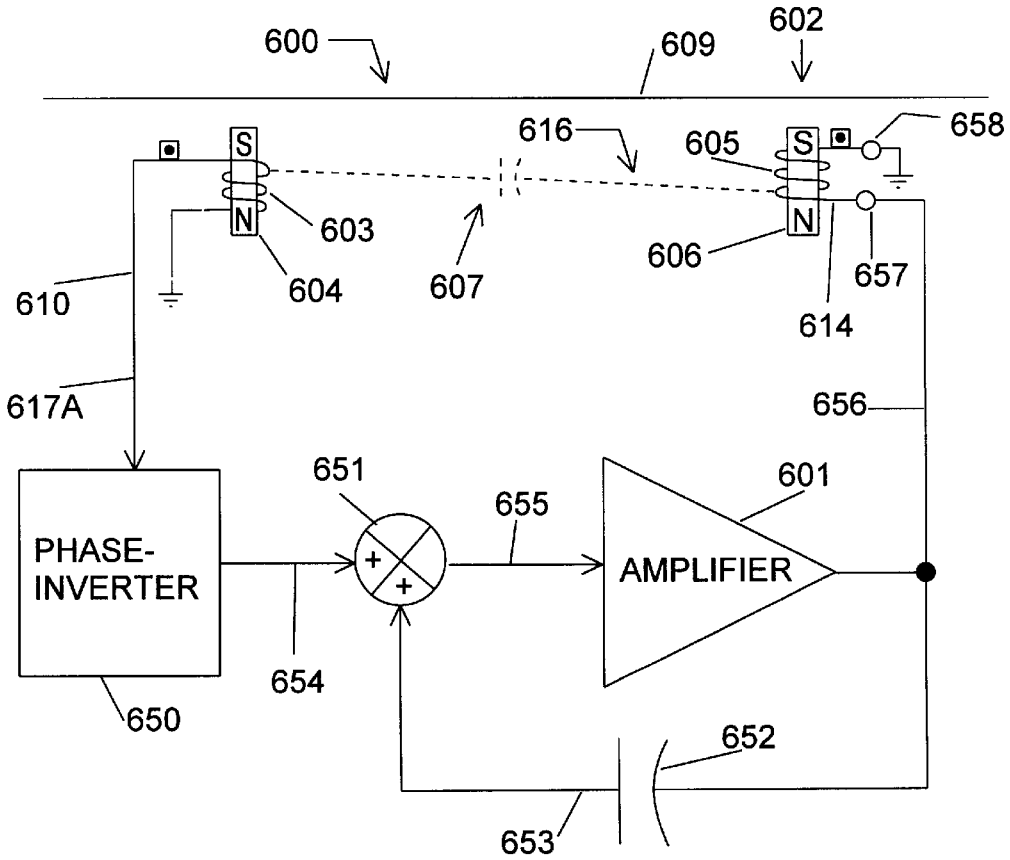
Figure 6F:
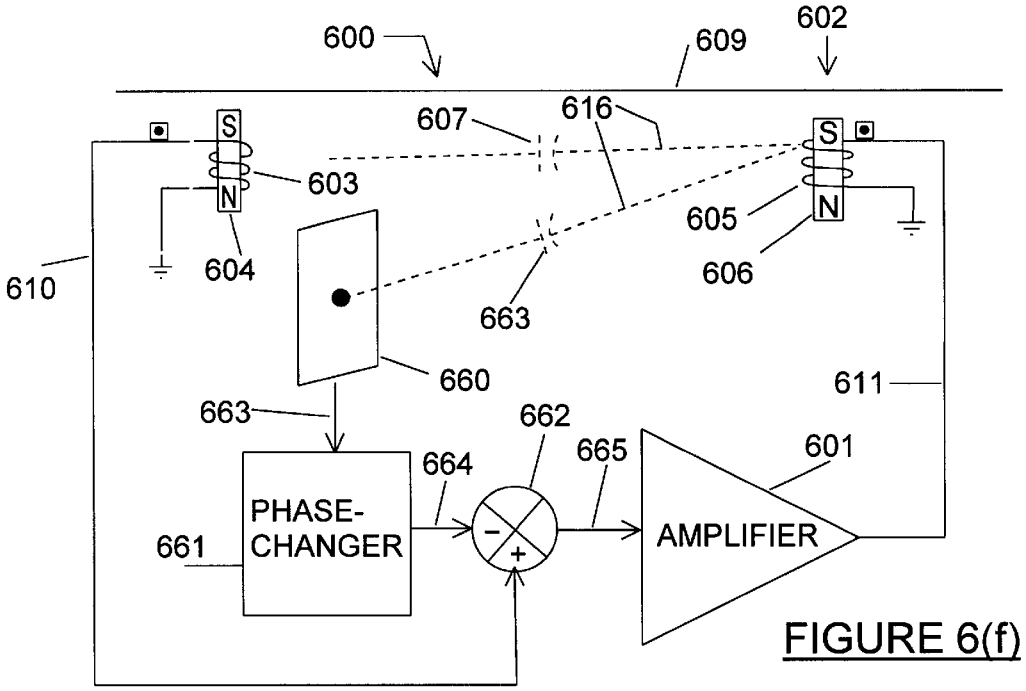

In accordance with the preferred embodiment of the invention, driver 102 is disposed generally equidistant between neck pickup 101 and bridge pickup 103 for minimizing shifting of the intersection between strings 104 and the magnetic fields emitted from pickups 101,103. FIG. 5(*a*) shows, in schematic format, the end view of elongated core 504 of prior art pickup 103 and its associate broadly dispersed magnetic field 501 impinging on string 505. The intersection between magnetic field 501 and string 505 is designated as the segment of string 505 between points 502,503. Pickup 103 is most responsive to string vibration within intersection 502,503.

FIG. 5(*c*) shows, in schematic format, the shift in the intersection 535,536 of string 534 and magnetic field 532 emitting from pickup 530. In this example, pickup 530 has magnetic core 539A which emits magnetic field 532 that impinges on string 534. Intersection 535,536 is the segment of string 534 between points 535,536 where magnetic field 532 and string 534 intersect. Pickup 530 is most responsive to string vibration at intersection 535,536. Driver 531, having magnetic core 539B, is disposed in proximity to pickup 530. Magnetic field 533 emitting from core 539B applies a shifting force to magnetic field 532. Magnetic fields 532,533 are of like polarity therefore providing that the shifting force repels magnetic fields 532,533 from one another. Such shifting force shifts both of magnetic fields 532,533. Intersection 535,536 is shifted leftward and intersection 537,538 is shifted rightward. In the absence of such shifting force, intersection 535,536 and intersection 537,538 would be centered above their respective magnetic cores 539A,539B. Thus, the shifting force between magnetic field 532 and magnetic field 533 shifts intersection 535,536 and intersection 537,538.

One means to for decreasing shifting forces provides as much space between magnetic cores 539A and 539B as possible. Therefore, driver 102 of the invention is disposed generally equidistant between neck pickup 101 and bridge pickup 103 to decrease shifting of the intersection between strings 104 and the magnetic fields emitting from pickups 101,103.

Scale length S, the distance between nut 113 and bridge saddles 120A to 120F, is generally defined as 100% of S. Dimension A measured from nut 113 to twelfth fret 114J is substantially 50% of scale length S. Dimension N, the distance from nut 113 to the center of neck pickup 101, is generally 76% of scale length S. Dimension M, the distance from nut 113 to the center of driver 102, is generally 85% of scale length S. Dimension B, the distance from nut 113 to the center of bridge pickup 103, is generally 94% of scale length S. Given the proliferation of different guitar designs, these percentages may vary in either direction by as much as 10% of the scale length S.

For example, a popular guitar model know as a "Strat" has dimension A=12.75". Therefore, S=12.75"/0.50=25.50", B=25.50"×0.94=23.97", M=25.50"×0.85=21.68", and N=25.50×0.76=19.38". Furthermore, the distance between neck pickup 101 and driver 102 is 21.68"−19.38"=2.30" and the distance between bridge pickup 103 and driver 102 is 23.97"−21.68"=2.29". Driver 102 is disposed generally equidistant between neck pickup 101 and bridge pickup 103. Thus, the invention provides shifting force minimizing means for segregating the shifting force applied by the driver magnetic field from the intersection of the vibratory element and the magnetic fields of the pickup means.

To further decrease shifting force, driver 102 emits a narrowly dispersed lateral magnetic field.

FIG. 5(*d*) shows, in schematic form, the arrangement of pickups 540,542 relative to driver 541 in the preferred embodiment of the invention. Pickups 540, 542 comprise magnetic cores 548, 549 which emit magnetic fields 550,551 that impinge on string 547. Fields 550, 551 apply shifting forces to intersection 543,544 (the segment of string 547 intersecting with magnetic field 550) and intersection 545, 546 (the segment of string 547 intersecting with magnetic field 551). The shifting of both intersections 543, 544 and 545, 546 is decreased because driver 541 is disposed generally equidistant between pickups 540, 542 and because driver 541 provides narrowly dispersed lateral magnetic field 553.

Driver 541 comprises magnetic cores 552A, 552B which are disposed end-to-end across string 547 (like driver 102 shown in FIG. 1(*a*)) but are shown schematically side-by-side in FIG. 5(*d*). Magnetic cores 552A, 552B are disposed in close proximity to each other and have a gap 561 between them and a gap narrowing means 560 to provide narrowly dispersed magnetic field 553.

Another aspect of the invention provides means for improving the installation and adjustment of driver 102 relative to strings 104.

FIG. 1(*d*) shows, in cross sectional view, the arrangement of pickups 101,103 and driver 102 relative to string 104F. Screw 151B passes through a hole in pick guard 111 and spring 152B to engage flange 153B in pickup 101 thus supporting neck pickup 101 between body 105 and strings 104. Not shown are screw 151A, spring 152A, and flange 153A on the other side of pickup 101 which are configured similarly. Rotation of screws 151A, 151B changes distance P1 to change the proximity of pickup 101 relative to strings 104. Similarly, screws 154A and 154B, springs 155A and 155B, and flanges 156A,156B are provided to support driver 102 between body 105 and strings 104. Rotation of screws 154A,154B changes distance P2. Screws 157A and 157B, springs 158A and 158B, and flanges 159A,159B are provided to support bridge pickup 103 between body 105 and strings 104. Rotation of screws 157A,157B changes distance P3. Thus, a means is provided to support pickup 101,103 between body 105 and strings 104A to 104F. Means is also provided for any one of pickups 101,103 and driver 102 to be disposed in closer proximity to strings 104 than the others. Recessed cavity 161 is provided in body 105 to house driver 102 thus providing means for height HI of driver 102 to be greater than the available height H2 between strings 104 and body 105. Cavity 161 houses the portion of driver 102 that is below pick guard 111 enabling the entirety of driver 102 to be disposed between pickup 101,103. Recessed cavity 160 is provided for neck pickup 101 and recessed cavity 162 is provided for bridge pickup 103 enabling their height to be greater as well. Thus, means are provided to enable any of pickups 101,103 and driver 102 to have their height greater than the available height H2 between strings 104 and body 105. Additionally, means provide that the entirety of driver 102 is disposed between pickup 101,103.

Another aspect of the invention provides a feedback elimination means for processing and altering the direct electromagnetic radiation for causing the electromagnetic radiation field emitted by the driver means to insubstantiality affect said feedback signal.

FIG. 6(*a*) shows prior art sustainer 619 in schematic format. Pickup 600 comprises core 604 surrounded by coil 603 to respond to vibration of string 609 and provide feedback signal 610 to amplifier 601. Pickup 600 produces feedback signal 610 through disturbances in the magnetic field emitted from pickup 600. These disturbances are caused by vibration of string 609. This phenomenon is well understood in the art but shall be briefly described here for sake of completeness. Core 604 has the pickup magnetic field passing through it which is generally provided by a permanent magnet (not shown) disposed in close proximity to core 604. The pickup magnetic field is emitted by core 604 for impinging on string 609. A downward phase of vibration brings string 600 closer to core 604 causing an increase in the intensity of the pickup magnetic field inside of core 604. This produces a negative voltage 617 that causes current to flow in the opposite direction as current arrow 618. An upward phase of vibration takes string 600 farther away from core 604 causing a decrease in the intensity of the pickup magnetic field inside of 604. This produces a positive voltage 617 that causes current to flow in the same direction as current arrow 618.

Feedback signal 610 comprises a combination of feedback voltage 617 and feedback current 618 provided by pickup 600. Amplifier 601 provides drive signal 611 to driver coil 605 wrapped around driver core 606 of driver 602. Drive signal 611 comprises a combination of drive voltage 614 and drive current 6613 provided by to driver 602. Driver 602 provides a magnetic field that applies a drive force to sustain the vibration of string 609. Direct magnetic feedback 608, which is conveyed by string 609 and space 612 between driver 602 and pickup 600, contaminates drive signal 610 with a noise signal that is a representative of drive current 613. Therefore, direct magnetic feedback 608 is said to affect feedback signal 610. A second means to directly affect feedback signal 610 is symbolized by capacitor 607 which conveys direct electrostatic feedback 616 between driver 602 and pickup 600.

Direct electrostatic feedback 607 is representative of drive voltage 614. Direct electrostatic feedback 616 also contaminates feedback signal with a noise voltage. Only, the noise signal associated with direct electrostatic feedback 616 is representative of drive voltage 614. The electrostatic noise signal has the same effect on feedback signal 610 as the noise signal caused by direct magnetic feedback 608. Therefore, direct electrostatic feedback 616 is said to affect feedback signal 610. The combined effect of direct magnetic feedback 608 and direct electrostatic feedback 616 is referred to as direct electromagnetic radiation 615.

FIG. 6(*b*) shows, in schematic format, prior art sustainer 619 having the effect of direct electromagnetic radiation represented by an equivalent transfer function G(s) 620. Drive signal 611, which is applied through driver 602 and pickup 600 to feedback signal 610, is represented by function G(s) 620. Function G(s) 620 provides the phase response, amplitude response, and dynamic response exhibited by the network comprising driver 602, pickup 600, direct electromagnetic radiation 615 which is conveyed between driver 602 and pickup 600 by string 609, space 612, and capacitor 607. Function G(s) 620 is a function of the complex frequency variable s=jw+a, where "jw" is the imaginary radian frequency and "a" is the real neper frequency as described in *Engineering Circuit Analysis,* Hayt and Kemmerly, McGraw-Hill, ISBN 0-07-027393-6.

FIG. 6(*c*) shows, in schematic format, an embodiment of the invention providing means to process and alter direct electrostatic radiation 615. The system of FIG. 6(*c*) has two modes of operation. The first mode is the measurement-mode which begins when initiator 634 activates switch 632 such that switch arms 636A,636B are in the downward position. While in the measurement-mode, the output of signal generator 630 is applied through switch arm 636A to amplifier 601 for providing drive signal 611. Function G(s) 620 provides feedback signal 610 to signal analyzer 635. Signal analyzer 635, being commenced by initiator 634, compares feedback signal 610 to drive signal 611 for determining the characteristics of equivalent transfer function G(s) 620. It is preferable that string 609 be prevented from vibrating during the measurement-mode to provide feedback signal 610 comprising substantially a representation of direct electromagnetic radiation 615. After the measurement-mode is completed, initiator 634 commences the run-mode by activating switch 632 so that switch arms 636A,636B are in the upward position.

In the run-mode, signal analyzer 635 provides a "description" for sythesizing function G(s) 620 to synthetic transfer function H(s) 633 through control lines 638. Function H(s) 633 utilizes the description for providing a substantial equivalent of function G(s) 620. Drive signal 611 is applied to function H(s) 633 providing error signal 637 which is substantially representative of direct electromagnetic radiation 615 that affects feedback signal 610. In the run-mode, string 609 is free to vibrate so, feedback signal 610 comprises the effect of direct electromagnetic radiation and a representation of the vibration of string 609. Difference amplifier 631 subtracts error signal 640 from feedback signal 610 to provide error signal 639 to amplifier 601. Due to the subtraction, error signal 639 is substantially lacking in a representation of direct electromagnetic radiation 615.

Initiator 634 preferably initializes the measurement-mode in response to the need for eliminating feedback. Alternatively, initiator 634 can respond to a periodic timing signal. A cost effective means to realize the system in FIG. 6(*c*) is through software running on a prior art digital signal processor (DSP). Thus, the invention provides feedback elimination means for processing and altering the direct electromagnetic radiation for causing the electromagnetic radiation field emitted by the driver to insubstantially affect said feedback signal.

The circuit of FIG. 6(*c*) provides means for processing and altering the combined effects of the electrostatic feedback and direct magnetic feedback. However, the power consumption of prior art DSP's is too high for use in a one-battery sustainer. Therefore, alternative means are provided to substantially eliminate the effects of direct electrostatic feedback and direct magnetic feedback independently of each other. Such means are highly effective and consume less power at lower cost than the circuit of FIG. 6(*c*).

FIG. 6(*d*) shows, in schematic format, an embodiment of the invention providing means to process and alter direct magnetic feedback 648 substantially independently of direct electrostatic feedback. Driver 640 comprises coil-core assembly 640A and coil-core assembly 640B. Assemblies 640A, 640B are disposed end-to-end across string 609 (like driver 102 in FIG. 1(*a*)) but are shown schematically side-by-side in FIG. 6(*d*). Assembly 640A comprises core 643 and coil 642. Assembly 640B comprises core 645 and coil 644. Direct magnetic feedback 648 comprises direct magnetic feedback 646 from coil-core assembly 640A and direct magnetic feedback 647 from coil-core assembly 640B. Direct magnetic feedback 648 impinges on pickup 600 thereby contaminating feedback signal 611 with a representation of drive current 613. Direct magnetic feedback 646 and 647 have opposite polarity and therefore generally cancel each other at pickup 600. It is more desirable, however, that direct magnetic feedback 646 and 647 substantially cancel each other.

To that end, a lateral unbalancing means includes adjustable magnetic shunt plate 641 for providing a magnetic imbalance between driver 640 and pickup 600. Means to adjust plate 641 are symbolized by arrows pointing leftward and rightward away from plate 641. Such means provide that when plate 641 is positioned nearer to assembly 640A, the magnetic field 646 produced by assembly 640A is decreased while magnetic field 647 produced by assembly 640B is augmented. When plate 641 is positioned nearer to assembly 640B, the opposite occurs. When plate 641 is correctly positioned, magnetic fields 646,647 substantially cancel each other at pickup 600. Since shunt plate 641 has insubstantial effect on direct electrostatic feedback, means are provided to process and alter direct magnetic feedback 648 substantially independently of electrostatic feedback.

FIG. 6(*e*) shows, in schematic format, an embodiment of the invention providing means to process and alter direct electrostatic feedback 616 substantially independently of direct magnetic feedback. Capacitor 607 symbolizes the conveyance of direct electrostatic feedback 616 between driver 602 and pickup 600. Direct electrostatic feedback 616 contaminates feedback signal 610 with noise signal 617A that is a representation of drive voltage 614. Phase inverter 650 inverts the phase of feedback signal 610 (and noise signal 617A) to provide phase-inverted feedback signal 654. Feedback signal 654 is applied to amplifier 601 directly or through adder 651 which is an optional component. The phase inversion decreases the effect of direct electrostatic feedback 616 because noise signal 617A is applied to the amplifier out-of-phase with drive signal 656. The phase inverted noise signal cancels the portion of drive signal 656 that produces noise signal 617A at pickup 600. Drive signal 656 is applied to ground terminal 657 of coil 605 instead of input terminal 658 as is shown in FIG. 6(*a*). Input terminal 658 of coil 605 is grounded. This reversed wiring allows driver 602 to accept drive signal 656 (which has been phase-inverted) yet provide a drive force that is generally in-phase with the vibration of string 609. By inverting the phase of feedback signal 610, noise signal 617A is applied out-of-phase to amplifier 601 making it substantially less likely to promote uncontrolled oscillation. Thus, means are provided for inverting the phase of the feedback signal to decrease the effect of direct electrostatic feedback for enabling the driver means to apply a drive force to said vibratory element that is generally in-phase with the vibration of said vibratory element. To further decrease the effect of direct electrostatic feedback 616, an error signal and adder are provided.

Capacitor 652 (which is an optional component) provides error signal 653 to adder 651. Adder 651 cancels in-phase error signal 653 with out-of-phase noise signal 617A contained in feedback signal 654 to provide feedback signal 655 which is therefore substantially lacking in a representation of direct electrostatic feedback 607. Thus, means are provided to further decrease the effect of direct electrostatic feedback 616. Since capacitor 607 has insubstantial effect on direct magnetic feedback, means are provided to process and alter direct electrostatic feedback 616 substantially independently of direct magnetic feedback.

FIG. 6(*f*) shows, in schematic format, an embodiment of the invention providing means to process and alter direct electrostatic feedback 616 substantially independently of direct magnetic feedback. Capacitor 607 symbolizes the conveyance of direct electrostatic feedback 616 between driver 602 and pickup 600. Capacitor 663 symbolizes the conveyance of direct electrostatic feedback 616 between driver 602 to pickup plate 660. Plate 660 provides error signal 663 representative of direct electrostatic feedback 616 affecting pickup 600. Optional phase changer 661 can be added to compensate phase changes in plate signal 663 due to the size, shape, and location of plate 660. Error signal 664, provided by optional phase changer 661, is combined with feedback signal 610 by difference amplifier 662 thereby substantially eliminating the representation of direct electrostatic feedback 616 in feedback signal 665. Thus, means are provided to process and alter direct electrostatic feedback 616 substantially independently of direct magnetic feedback.

Additionally, the invention provides a feedback elimination means for processing and altering direct electromagnetic radiation for causing the electromagnetic radiation field emitted by the driver means to insubstantiality affect said feedback signal.

Another aspect of the present invention is designed to correct problems that exists with some known prior art drivers.

Figure 2:
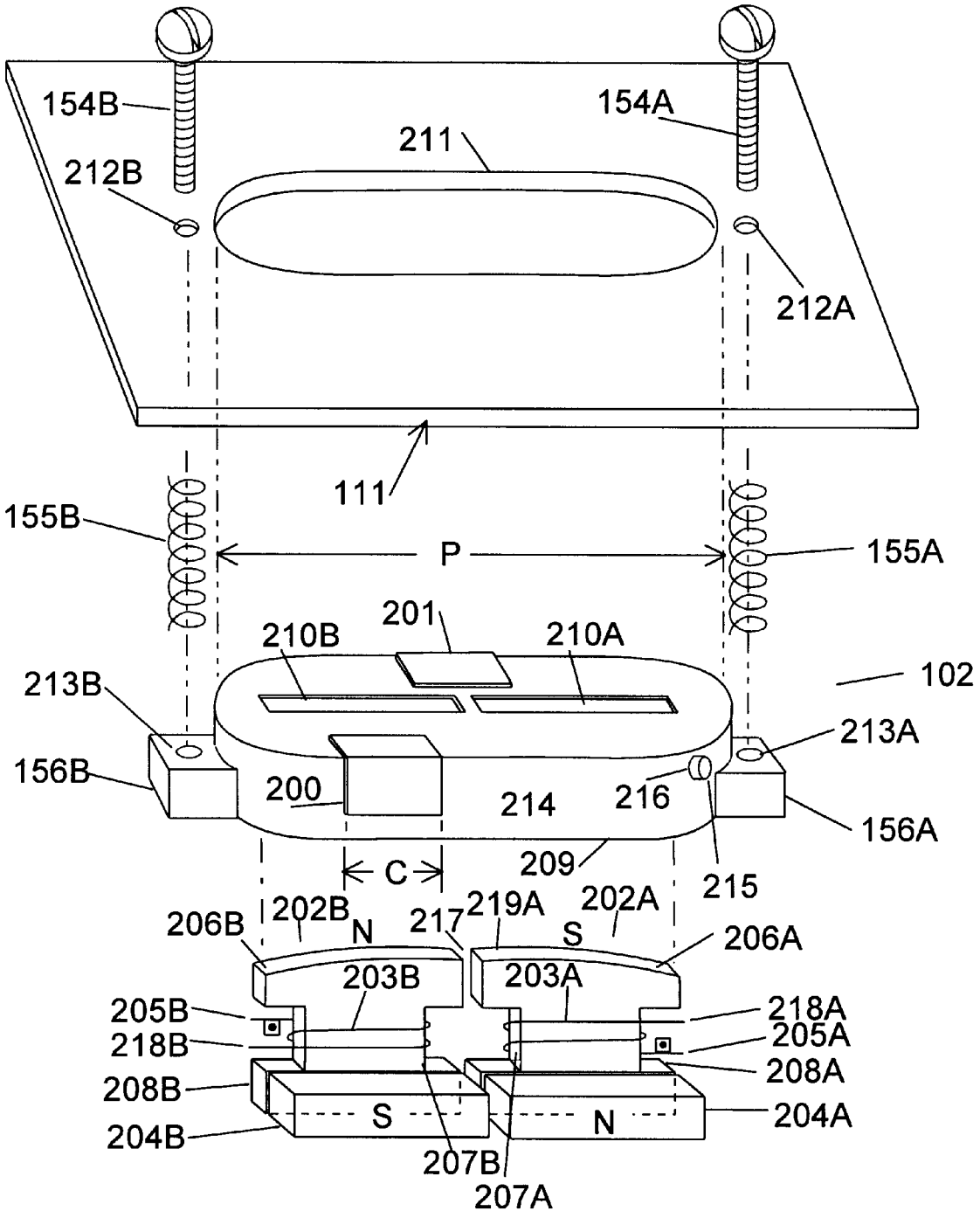

FIG. 2 shows, in exploded view, the preferred embodiment of driver 102 of the invention. Driver 102 comprises similar laterally elongated magnetic cores 202A,202B preferably comprising cold rolled steel. Cores 202A,202B are disposed end-to-end to extend laterally across strings 104. Core 202A comprises magnetic flux collector 208A, coil base 207A, and magnetic flux emitter surface 206A. Collector 208A conveys magnetic flux from permanent magnet 204 through base 207A to emitter 206A. Base 207A is the portion of core 202A onto which coil 203A is wound. Base 207A conveys magnetic flux from coil 203A to emitter 206A. Since a fluctuating drive current is generally applied to coil 206A, a fluctuating magnetic flux is conveyed to emitter 206A. Core 202A combines the generally stronger constant flux from magnet 204A with the generally weaker alternating flux from coil 203A such that emitter 206A emits a fluctuating magnetic flux into strings 104A to 104C. The fluctuating magnetic flux applies a fluctuating drive force to strings 104A to 104C to attract strings 104A to 104C toward emitter 206A. The fluctuating nature of the applied magnetic flux rapidly increases and decreases the attractive force on strings 104A to 104C thereby reinforcing the vibration of strings 104A to 104C. Since strings 104A to 104C do not emit a magnet field of their own, no force acts to repel strings 104A to 104C away from emitter 206A. Likewise, core 202B comprises magnetic flux collector 208B, narrow coil base 207B, and magnetic flux emitter surface 206B for applying a similarly fluctuating drive force to string 104D to 104F.

Figure 3A:
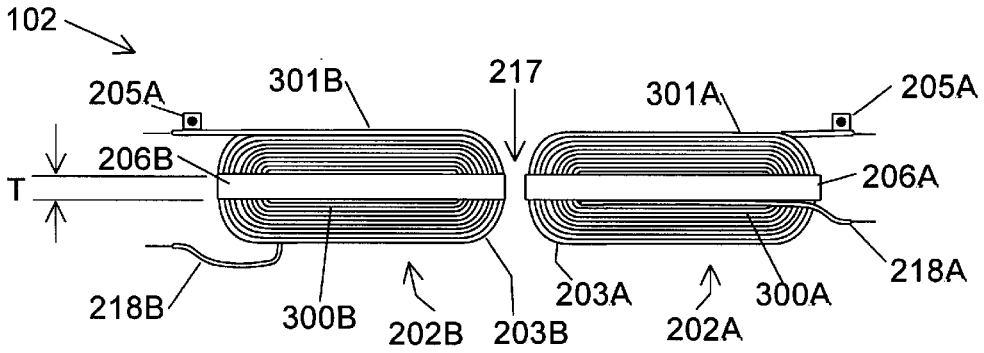
FIG. 3(*a*) shows the top view of cores 202A,202B and coils 203A,203B of the preferred embodiment of driver 102 of the invention.
Figure 3B:
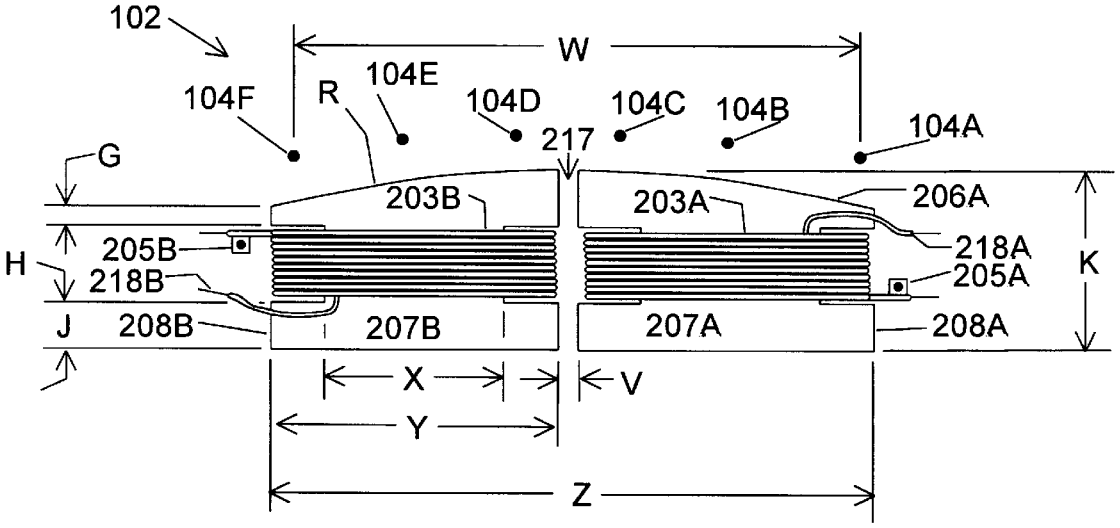

FIG. 3(*a*) shows the top view of cores 202A,202B and coils 203A,203B of the preferred embodiment of driver 102 of the invention. FIG. 3(*b*) shows the side view of cores 202A,202B and coils 203A,203B of the preferred embodiment driver 102 of the invention. Preferably coils 203A, 203B each comprise 256 turns of AWG number 28 magnet wire. FIGS. 3(*a*), 3(*b*) show a gap narrowing means for narrowing a gap 217 between the pair of adjacent flux emitters 206A, 206B. The gap narrowing means includes overhang portion of 219A, 219B of flux emitters 206A, 206B which overhang coil bases 207A, 207B in the direction of gap 217 to narrow gap 217. Preferably, the dimensions shown in FIGS. 3(*a*), 3(*b*) are as follows: Dimension W, the lateral disposition of strings 104, is 2.00". Dimension Z, the overall lateral width of cores 202A,202B plus gap 217, is 2.25". Dimension Y, the lateral width of each of cores 202A,202B is 1.10". Dimension X, the lateral width of each of coil bases 207A,207B is 0.62". Dimension V, the lateral width of gap 217 is 0.050". Dimension K, the overall height of each of cores 202A,202B is 0.80". Dimension G, the height of each of emitters 206A,206B is 0.10". Dimension H, the height of each of coil bases 207A,207B is 0.40". Dimension J, the height of each of collectors 208A,208B is 0.25". Dimension R, the radius of each of emitters 206A, 206B is approximately 12". Dimension T, the thickness of each of cores 202A,202B is 0.125". Thus, by manipulating the above dimensions, gap 217 is narrowed. Preferably, however, gap 217 is approximately 0.050" so as not to cause a magnetic short-circuit between cores 202A,202B. Thus, gap 217 between adjacent emitters 206A,206B is narrowed because emitters 206A,206B have greater lateral width than bases 207A,207B.

In reference to FIG. 1(*a*), the orientation of magnet 204A provides that emitter 206A emits a pulsating SOUTH polarity magnetic flux into strings 104A to 104C. The orientation of magnet 204B provides that emitter 206B emits a pulsating NORTH polarity magnetic flux into strings 104A to 104C. Furthermore, drive current is applied to coils 203A,203B such that during a phase of increasing SOUTH magnetic flux from emitter 206A, a corresponding increase in NORTH magnetic flux from emitter 206B occurs as well. Thus, the two magnetic fields emitted by driver 102 are of opposite polarity to generally cancel each other at pickups 101,103. However, since strings 104 each have different diameters and since pickup 103 is not parallel with driver 102, the magnetic fields emitted by driver 102 substantially cancel each other at neither pickup 101 nor pickup 103 to an extent that the effect of direct magnetic feedback on pickups 101,103 is substantially eliminated. To correct this problem, laterally adjustable magnetic shunt plates 200,201 are provided.

Laterally adjustable magnetic shunt plate 200 (preferably made of cold rolled steel) is wedged between pick guard 111 and cover 209 such that finger pressure applied to either side moves it in lateral directions. Friction between plate 200 and pickup guard 111 holds plate 200 in place. Pick guard 111 provides means to retain plate 200 in proximity to driver 102. As described above in reference to FIG. 6(*d*), plate 200 provides means to substantially eliminate the effect of direct magnetic feedback.

Thus, the invention provides a driver means including a plurality of core means disposed generally in an end-to-end relation to form a generally laterally extending array generally adjacent to the array of strings. A first magnetic shunt means is provided for creating a magnetic imbalance between the first pickup means and the driver means. A positioning means is provided for enabling the magnetic shunt means to be adjustably positioned in each of a first position and a second position to permit the user to vary said magnetic imbalance between said first pickup means and said driver means. A retention means is provided for retaining said first magnetic shunt means in at least one of said first and second positions.

Predominantly, the result of lateral movement of plate 200 is to change the effect of direct magnetic feedback relative to neck pickup 101 because plate 200 faces pickup 101. Similarly, the result of lateral movement of plate 201 is to change the effect of direct magnetic feedback relative to bridge pickup 103 since plate 201 faces pickup 103. Thus, each of pickups 101,103 has an adjustable lateral unbalancing means between it and driver 102 to provide generally independent changes in the effect of direct magnetic feedback.

The lengthwise dimension B of cover 209, is generally 0.70". Dimension P, the lateral width of cover 209, is generally 2.75". Dimension C, the lateral width of plate 200, is generally 0.50". Thus, the lateral width of plate 200 is less than the lateral width of cover 209 to provide substantial lateral adjustment range of plate 200.

Again in reference to FIG. 2, coil 203A is wound around base 207A such that dotted terminal 205A exhibits positive-on-pull-away polarity. Positive-on-pull-away polarity is defined in the prior art *Sustainiac GA-2R Retro-Fit Kit Guitar Sustain System Installation Manual.* Coil 203B is wound around base 207B such that dotted terminal 205B exhibits positive-on-pull-away polarity. Driver 102 is encased by cover 209. Emitter 206A extends through rectangular slot 210A and emitter 206B extends through rectangular slot 210B. Driver 102 extends through obround hole 211 in pick guard 111. Screw 154A,154B pass through holes 212A,212B and springs 155A,155B to engage with holes 213A,213B in flanges 156A,156B respectively. Thus means are provided to support driver 102 and adjust its proximity to string 104A to 104F.

Another aspect of the present invention is that it provides an improved "power on" indicator.

In reference to FIG. 1(*a*), driver 102 is disposed between pickups 101,103 such that face 214 of cover 209 is adjacent to neck pickup 101. Indicator lamp 215 extends through hole 216 in cover 209 to give a visual indication that a drive signal is applied to driver 102. Lamp 215 emits light laterally away from strings 104 so that the light is easily viewed when guitar 100 is in the conventional playing position. Arrow 124 in FIG. 1 (*a*) shows the general direction of light emission from lamp 215. Thus, the invention provides a lamp positioned for emitting light in a generally a lateral direction away from said string array, and toward the eyes of the player of the instrument. Lamp 215 is illuminated when the drive signal is applied to driver 102. Thus, the sustainer includes a lamp means positioned for emitting light in a generally lateral direction away from the string array, and toward the eyes of the player of the instrument.

Additional discussions of drivers are include below in reference to FIGS. 14–18. Following is a discussion of pickups utilized by the invention and a brief discussion of laterally adjustable shunt plates.

Figure 4:
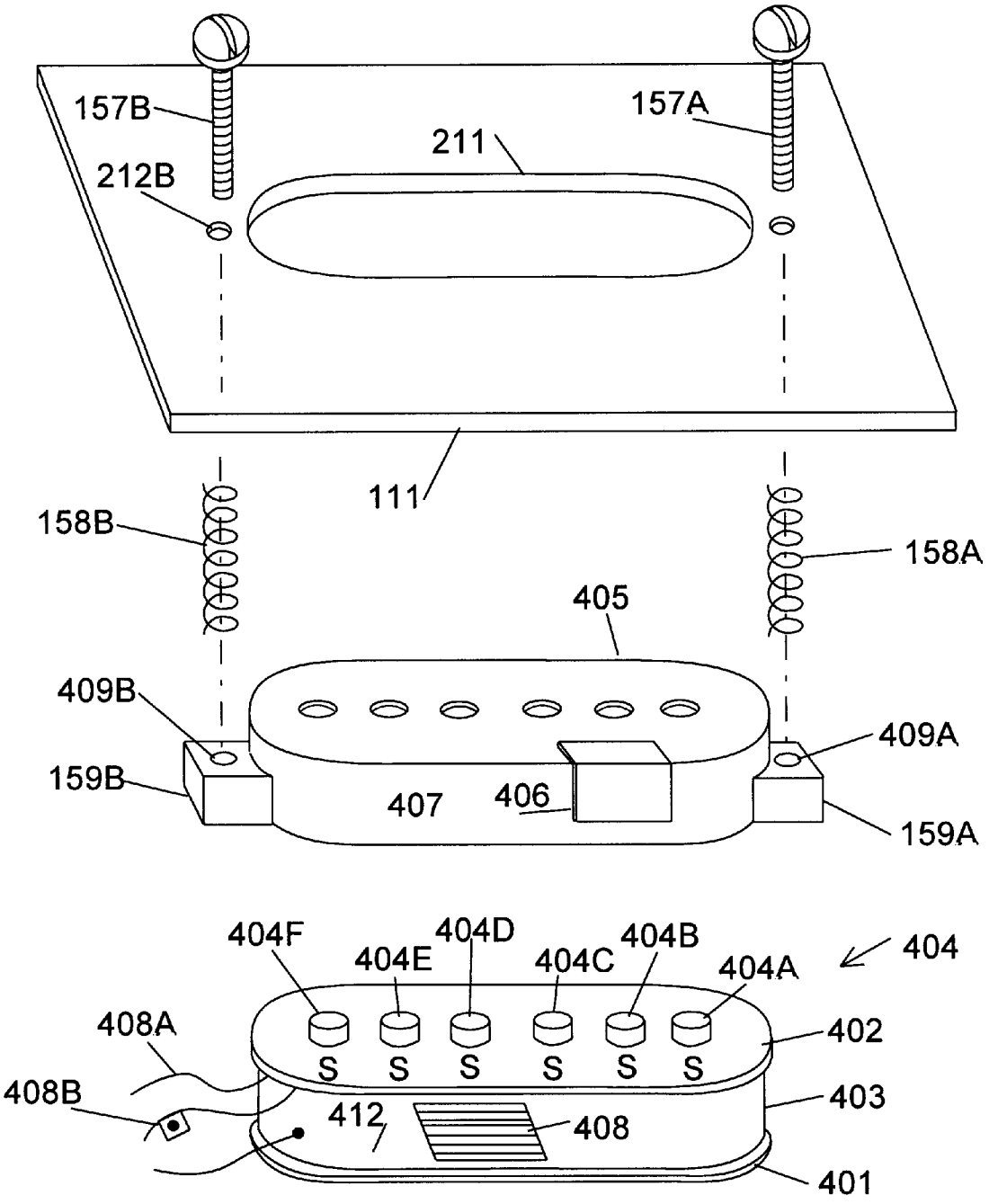
FIG. 4 shows laterally adjustable shunt plate 406 of the present invention applied to prior art single-coil pickup 103.

FIG. 4 shows laterally adjustable shunt plate 406 of the present invention applied to prior art single-coil pickup 103. Laterally adjustable shunt plate 406 of the present invention shall be discussed later. Bridge pickup 103 and neck pickup 101 are constructed similarly as follows. Cylindrically shaped magnets 404A to 404F are press-fit into top plate 402 and bottom plate 401 with their magnetic south poles facing upward. Magnets 404A to 404F form a laterally elongated magnetic core 404 having a broadly dispersed magnetic field. Thousands of turns of fine wire 408 are wrapped around core 404 to form a laterally elongated coil 403. The ends of wire 408 form output terminals 408A,408B. Terminal 408B exhibits positive-on-pull-away polarity. Pickup cover 405 encases pickup 103 and provides screw holes 409A,409B in flanges 159A,159B as a means to mount pickup 103 to the pick guard 111 with screws 157A, 157B and springs 158A, 158B. Laterally elongated coil 403 and laterally elongated core 404 of pickup 103 provide a single output that is representative of the vibration of all the strings at predetermined longitudinal location of pickup 103. In an alternate embodiment of pickup 103 generally referred to as a stacked single-coil pickup, the space occupied by coil 403 is divided into two spaces and a second length of wire 499 (not shown) is wrapped in the same manner as wire 408 to form a second elongated coil 498 (not shown) which is wired out-of-phase with coil 403 to provide a noise-cancelling effect. Knoblaugh (U.S. Pat. No. 2,119,584) shows a prior art stacked single-coil pickup.

Some known prior art sustainers having multi-string drivers employ neither single-coil pickups nor stacked single-coil pickups to provide a feedback signal due to the susceptibility of the single coil pickups to the effects of direct magnetic feedback. Rather, these prior art sustainers employ humbucking pickups due to their superior insensitivity to the effects of direct magnetic feedback.

FIG. 5(*a*) shows, in schematic format, the end view of elongated core 504 of prior art pickup 103 and its associated broadly dispersed magnetic field 501 impinging on string 505. Such dispersion augments the effects of direct magnetic feedback making single-coil pickup 103 an inherently inferior means to provide a feedback signal for some prior art sustainers utilizing a multi-string driver. The alternative embodiment stacked single-coil pickup is similarly inferior. Therefore, some prior art sustainers employ the superior humbucking pickup design generally comprising two core/coil assemblies (similar to pickup 103) disposed side-by-side. The two coils are wired out-of-phase to decrease the effects of direct magnetic feedback. FIG. 5(*b*) shows, in schematic format, the end view of the elongated cores 512A,512B in a prior art humbucking pickup 510. The concentrated magnetic field 514 impinges on string 513. Such concentration further decreases the effects of direct magnetic feedback. Thus, humbucking pickups are generally superior to single-coil pickups for providing a feedback signal for some prior art sustainers.

FIG. 1(*a*) shows bridge pickup 103 in guitar 100. Face 214 of pickup 103 faces driver 102. Magnetic flux emitter 206A emits a SOUTH polarity magnetic field that impinges substantially on the end of pickup 103 having screw 157A. Magnetic flux emitter 206B emits a NORTH polarity magnetic field that impinges substantially on the end of pickup 103 having screw 157B. Since end 159A of pickup 103 is closer to driver 102 than end 159B is, the NORTH and SOUTH magnetic fields do not completely cancel each other. Furthermore since strings 104A to 104C are generally bigger in diameter and mass than strings 104D to 104F, strings 104A to 104C provide the lower reluctance magnetic path between driver 102 and pickup 103. Thus, the intensity of the SOUTH polarity magnetic field that impinges on pickup 103 is greater than the intensity of the NORTH polarity magnetic field. Therefore in compensation, shunt plate 201 is disposed in a lateral position closer to emitter 206A to decrease the intensity of the SOUTH polarity magnetic field that impinges substantially on the end of pickup 103 having screw 157A.

Pickup 101 is disposed parallel to driver 102. So, the uneven diameters of strings 104 would have been the primary cause for the NORTH and SOUTH magnetic fields not cancelling each other if it were not for the magnetic unbalancing provided by plate 201. Plate 201 decreases the SOUTH magnetic field impinging upon pickup 103 and, to a lesser extent, it decreases the NORTH magnetic field impinging upon pickup 101. Therefore plate 200 is provided to compensate for the placement of plate 201 and the uneven diameters of strings 104.

In an alternate embodiment of the invention, plate 201 is removed and plate 406 (of FIG. 4) is installed between pickup 103 and driver 102. Thus providing the desired decrease in the SOUTH magnetic field impinging upon pickup 103. Furthermore, plate 200 is removed and another plate (not shown) is installed between pickup 101 and driver 102 to provide the desired decrease in the SOUTH magnetic field impinging upon pickup 103. This arrangement has the advantage that lateral adjustment of plate 406 has an insubstantial effect on pickup 101. Similarly, lateral adjustment of the plate on pickup 101 has an insubstantial effect on pickup 103.

Musical instruments generally provide a cavity for housing an output jack attached to a cover plate. Most such output jack cavities are generally large enough to hold one conventional 9-volt battery. The invention provides means to utilize this cavity for both a battery and an output jack.

Figure 7:
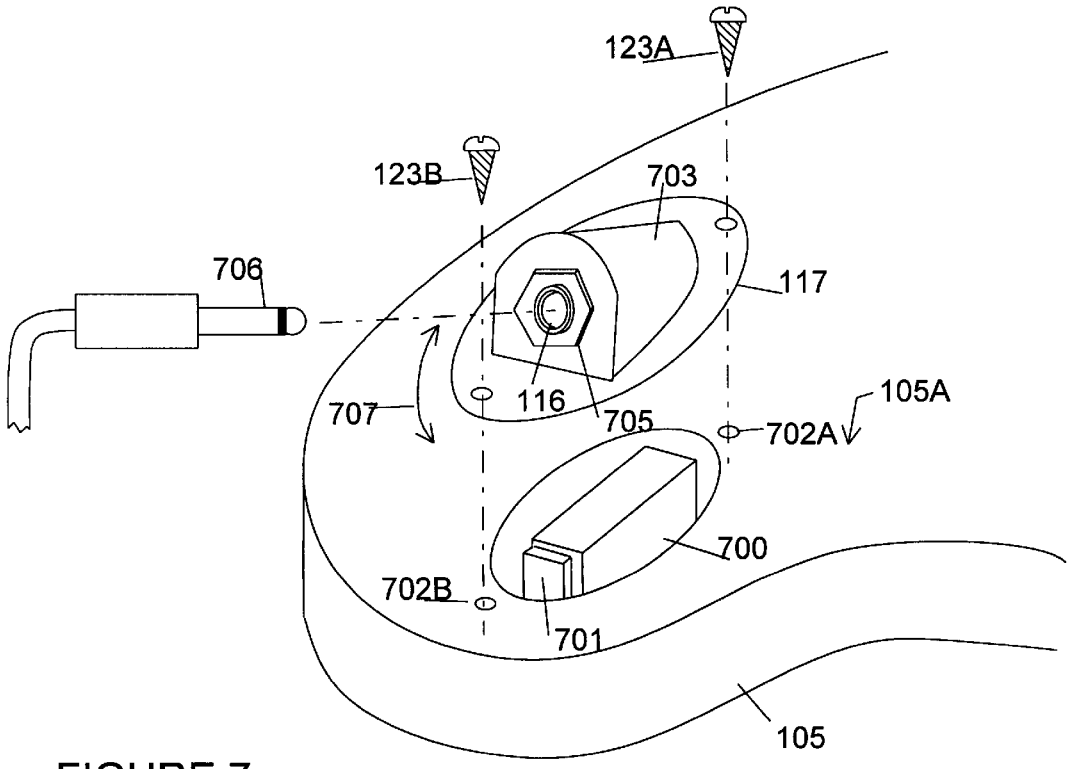
FIG. 7 shows, in exploded view, an embodiment of the present invention comprising battery cavity 704 in body 105.

FIG. 7 shows, in exploded view, an embodiment of the present invention comprising battery cavity 704 in body 105. Battery 700 provides power to the sustainer 1100 of FIG. 11. Battery connector 701 attaches to terminals (not shown) on battery 700 thereby providing electrical contact between sustainer 1100 and battery 700. Battery 700 is housed inside of cavity 704 in body 105. Jack plate 117 provides a means to restrain battery 700 from falling out of cavity 704. Jack plate 117 is attached to body 105 with wood screws 123A,123B. Output jack 116 provides an output signal, representative of vibration of strings 104, to an external amplifier and speaker (not shown) through plug 706. Plug 706 is inserted into jack 116 to mate with jack 116 and establish electrical contact with jack 116. Plug 706 conveys signals between the outside and the inside of cavity 704. Plug 706 includes a body 708 having a protrusion 709 extending away from body 708. Jack 116 has a hole 710 for inserting protrusion 709. Jack 116 is fastened to plate 117 with nut 705. Plate 117 provides optional emboss 703 to alter the angle of insertion 707 of plug 706 relative to top of guitar 105A such that the lengthwise dimension of plug 706 is not perpendicular to top 105A when plug 706 is mated with jack 116. Emboss 703 also provides additional volume above battery 700 for enclosing jack 116. In the prior art guitar commonly referred to as a "Strat", jack plate 117 is provided with emboss 703. However, emboss 703 faces downward into cavity 704 thereby decreasing the volume of cavity 704. That prior art arrangement does not provide enough volume in cavity 704 for battery 700 and jack 116. In the invention, jack plate 117 is turned over so that emboss 703 increases rather than decreases the volume of cavity 704. Therefore, the invention provides a cover attachable to the body for covering the cavity. The cover includes a jack mateable with a plug for conveying a signal between the inside and the outside of the cavity.

In an alternate embodiment of the invention, plug 706 conveys power through jack 116 from an AC power supply (not shown) for providing power to sustainer 1100. The ac power supply provides power to battery 700 for recharging battery 700. Thus, the sustainer of the alternate embodiment of the invention provides an amplifier coupled to the pickups for providing a drive signal in response to the feedback signal, the amplifier being housed inside of a cavity in the body of the instrument. A jack is provided that is mateable with a plug for conveying power from an ac power supply to the amplifier and the battery.

Another aspect of the present invention is to provide suitable drive force and battery life with half as many batteries of some known sustainers, thereby providing energy efficiency means to improve the energy efficiency of the amplifier. Furthermore, improving the energy efficiency of the amplifier decreases the operating cost of the sustainer since fewer batteries per hour of use are consumed.

Figure 8A:
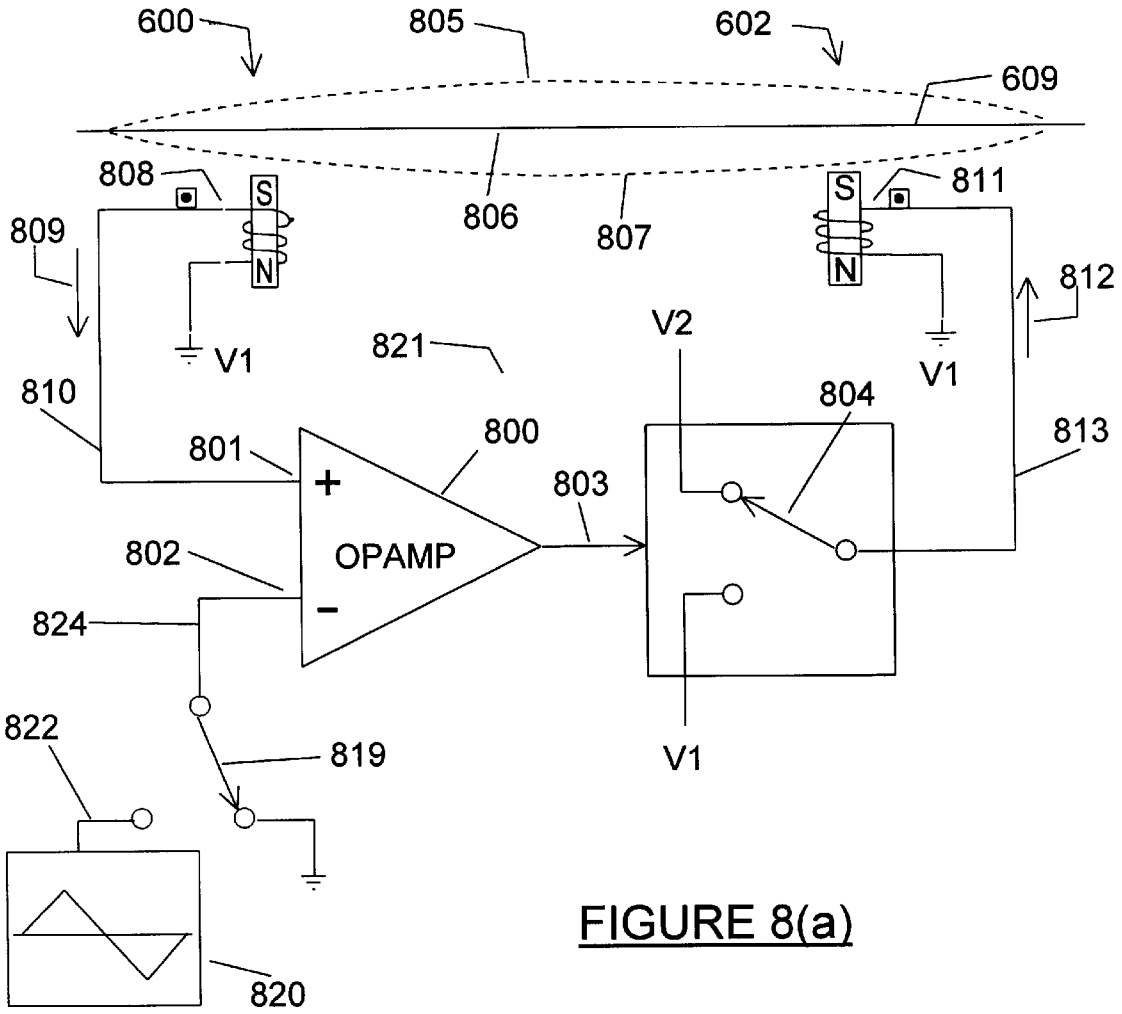
FIG. 8(*a*) shows, in schematic format, an aspect of the invention comprising non-linear switching amplifier 821 for providing a square-wave drive signal to driver 602.
Figure 8F:
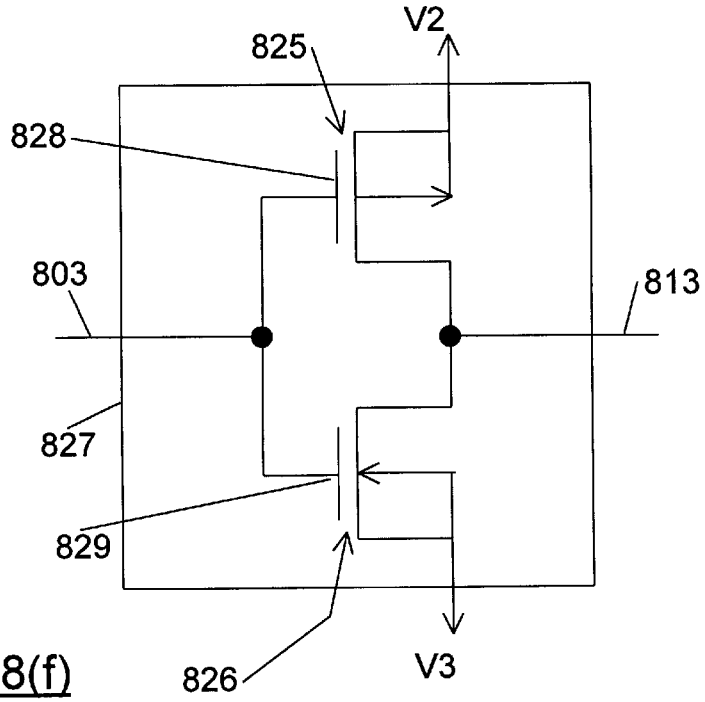
Figures 8B, 8C, 8D, 8E:
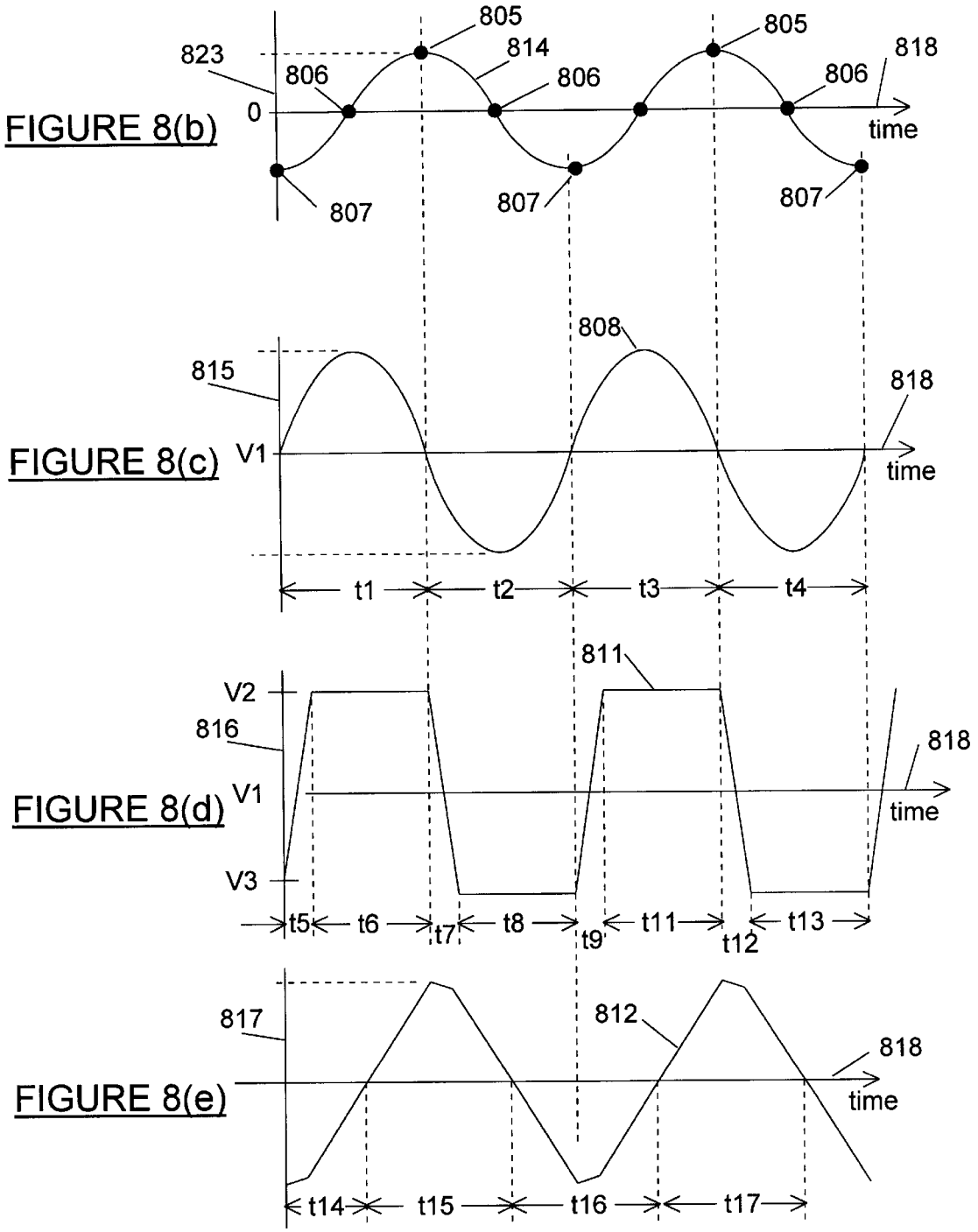

FIG. 8(*a*) shows, in schematic format, an aspect of the invention comprising non-linear switching amplifier 821 for providing a square-wave drive signal to driver 602. Pickup 600 provides feedback signal 810 comprising feedback voltage 808 and feedback current 809 in accordance with vibration of string 609. Driver 602 accepts drive signal 813 comprising drive voltage 811 and drive current 812. Drive signal 813 is provided by non-linear switching amplifier 821 comprising comparator 800 and drive-switch 804. Switch 819 determines the characteristic of drive signal 813 by providing threshold voltage 824. When switch 819 is in the rightward position, threshold voltage 824 comprises reference voltage V1. When switch 819 is in the leftward position, threshold voltage 824 comprises high frequency time-base signal 822. Comparator 800 compares the instantaneous feedback voltage 808 applied to non-inverting input 801 to threshold voltage 824 applied to inverting input 802. Drive-switch 804 is actuated by comparator 800 which provides drive-switch control signal 803 that is representative of whether the instantaneous value of feedback voltage 810 is greater than or lesser than threshold voltage 824. When feedback voltage 810 is greater than reference voltage V1, drive-switch 804 is in the upward position thereby applying a high output level V2 to driver 602. When feedback voltage 617 is lesser than reference voltage V1, drive-switch 804 is in the downward position thereby applying a low output level V3 to driver 602. Voltage V2 has greater potential than reference voltage V1. Voltage V3 has lesser potential than reference voltage V1. Such switching between voltages V2,V3 constitutes a square-wave drive voltage 811 provided to driver 602. The inductive reactance of driver 602 integrates square-wave drive voltage 811, with respect to time, thereby constituting triangle-wave drive current 812. Hence, non-linear switch mode amplifier 821 accepts feedback signal 810 from pickup 600 and provides drive signal 813 comprising square-wave drive voltage 811 and triangle-wave drive current 812. Thus, the invention provides a comparator means for providing a drive-switch control signal in response to the comparison of said feedback signal to a threshold signal.

FIG. 8(*b*) shows, in graphical format, vibration 814 of prior art string 609 with respect to time 818B. Vertical axis 823 represents the displacement of string 609 relative to point of rest 806. Horizontal axis 818B represents the passage of time and intersects with axis 823 at point 0 representative of no displacement of string 609. Therefore, points located above axis 818B represent displacement of string 609 above resting point 806 whereby string 609 is farther away from pickup 600 and driver 602. Points located below axis 818 represent displacement of string 609 below resting point 806 whereby string 609 is closer to pickup 600 and driver 602. Vibration 814 is generally sinusoidal comprising 1) position 807 which is the extent of vibration 814 closest to pickup 600 and driver 602, 2) position 805 which is the extent of vibration 814 farthest away from pickup 600 and driver 602, and 3) position 806 which is the extent of vibration 814 between positions 805,807.

FIG. 8(*c*) shows, in graphical format, generally sinusoidal feedback voltage 808 provided by prior art pickup 600 to non-linear switching amplifier 821 of the invention. Vertical axis 815 represents the instantaneous value of feedback voltage 808. Time axis 818C intersects axis 815 at point V1 representative of reference voltage V1. Time periods t1,t3 represent the periods of time when string 600 is moving away from pickup 600 thereby providing feedback voltage 808 greater than reference voltage V1. Time periods t2,t4 represent the periods of time when string 600 is moving towards pickup 600 thereby providing feedback voltage 808 lesser than reference voltage V1 Time periods t1 through t4 are generally equal in duration. Thus, feedback voltage 808 generally defines a sinusiod having frequency Fo wherein, Fo=1/(t1+t2).

FIG. 8(*d*) shows, in graphical format, square-wave drive voltage 811 provided to driver 602 by non-linear switching amplifier 821 of the invention when switch 819 is in the rightward position. Vertical axis 816 represents the instantaneous value of drive voltage 811. Time axis 818D intersects axis 816 at point V1 representative of reference voltage V1. Time periods t6,t11 represent the periods of time when feedback voltage 808 is greater than reference voltage V1 and drive-switch 804 provides voltage V2. Time periods t8,t13 represent the periods of time when feedback voltage 808 is lesser than reference voltage V1 and drive-switch 804 provides voltage V3. Time periods t5,t9 represent rise-time, the period of time for drive-switch 804 to transition from voltage V3 to voltage V2. Time periods t7,t12 represent fall-time, the period of time for drive-switch 804 to transition from voltage V2 to voltage V3. Rise-time periods t5,t9 and fall-time periods t7,t12 are substantially dependent on the speed of drive-switch 804. A relatively faster drive-switch 804 will have relatively shorter rise-time and fall-time periods. A relatively slower drive-switch 804 will have relatively longer rise-time and fall-time periods. Thus, the sustainer comprises a comparator means for providing a drive-switch control signal in response to the comparison of said feedback signal to a threshold signal, and a drive-switch means responsive to said drive-switch control signal for providing a square-wave drive signal. The square-wave drive signal includes a rise-time period representative of the period of time to transition from a low output level to a high output level, and a fall-time period representative of the period of time to transition from a high output level to a low output level wherein said rise-time periods and said fall-time periods are substantially dependant on the switching speed of said drive-switch means. The sustainer also includes a driver means for applying a drive force to said vibratory element in response to said square-wave drive signal.

FIG. 8(*e*) shows, in graphical format, triangle-wave drive current 812 provided to driver 602 by non-linear switching amplifier 821 of the invention. Drive current 812 is generally representative of the drive force applied to string 609 by driver 602 to sustain the vibration of string 609. Vertical axis 817 represents the instantaneous value of drive current 812. Time axis 818E intersects axis 817 at point 0 representative of zero drive current 812. Points above axis 818E represent drive current 812 flowing in the same direction as arrow 812 in FIG. 8(*a*) thereby applying a relatively lesser downward force on string 609. Points below axis 818 represent drive current 812 flowing in the opposite direction as arrow 812 in FIG. 8(*a*) thereby applying a relatively greater downward force on string 609. Drive current 812 is the time integral of square-wave drive voltage 811 as provided by the solution to Faraday's law V=L di/dt, where V is square-wave drive voltage 614, L is the inductance of driver 602, and di/dt is the time derivative of triangle-wave drive current 811. Time periods t15,t17 represent the periods of time when driver 602 applies a relatively lesser downward force on string 609 to generally reinforce the strings upward movement. Time periods t14,t16 represent the periods of time when driver 602 applies a relatively greater downward force on string 609 to generally reinforce the strings downward movement. Thus, the sustainer of FIG. 8(*a*) provides driver means for accepting said square-wave drive signal and providing a drive force to said vibratory element.

FIG. 8(*f*) shows, in schematic format, drive-switch 827 for accepting drive-switch control signal 803 and providing drive signal 813 in the preferred embodiment of the invention. In the preferred embodiment of the invention, drive-switch 827 replaces drive-switch 804 in FIG. 8(*a*). Drive-switch 827 comprises P-channel semi-conductor MOSFET output device 825 and N-channel semi-conductor MOSFET output device 826. Gates 828,829 of output devices 825,826 are connected together and are driven by drive-switch control signal 803. The acronym MOSFET stands for Metal-Oxide-Semiconductor-Field-Effect-Transistor. Many type of semi-conductor devices are suitable for drive-switch 827. The following is an exemplary list, not a exclusive list; bi-polar transistors, Junction-Field-Effect-Transitors (JFET's), Insulated-Gate-Field-Effect-Transistors (IGFET's), and MOSFET's. Generally, semi-conductor output devices employ compounds of silicon, gallium, germanium, or other elements including metals and metal oxides. Such devices generally provide a gate for controlling the flow of current between an input terminal and an output terminal. Fast switching speed of electrical current with no moving parts is a preferable feature of the semi-conductor output devices utilized in the preferred embodiment of the invention.

When signal 803 is such that device 825 is "on" (semi-conductor saturation mode), device 826 is "off" (semi-conductor cut-off mode). Such condition is equivalent to drive-switch 804 of FIG. 8(*a*) being in the upward position to provide voltage V2 to drive signal 813. When signal 803 is such that device 825 is "off", device 826 is "on". Such condition is equivalent to drive-switch 804 of FIG. 8(*a*) being in the downward position thereby providing voltage V3 to drive signal 813.

An advantage of non-linear switching amplifier 821 over prior art linear mode amplifiers is that output devices 825,826 behave as drive-switches having only two conditions, saturation and cut-off. Such conditions increase the energy efficiency of amplifier 821 by substantially eliminating power dissipation at output devices 825,826. To calculate the power dissipated by output devices 825 and 826, one applies the formula (P)=(V)×(I). For example the power dissipated by output devices 825 during time period t6 in FIG. 8(*d*) is found by multiplying the voltage (V) drop across device 825 times the current (I) through device 825. However since drive voltage 811 is equal to voltage V2, the voltage (V) is zero causing the power dissipation of device 825 to be zero regardless of the magnitude of current 812. Thus in theory, device 825 dissipates no power. However in practice, MOSFET device 825 has a relatively low impedance (generally less than one ohm) which causes an insubstantial power dissipation. Thus, the invention provides energy efficiency means to increase the energy efficiency of said amplifier means by substantially eliminating power dissipation at said semi-conductor output device means.

While non-linear switching amplifier 821 of FIG. 8(*a*) provides the desired efficiency results, the preferred embodiment of non-linear switching amplifier 821 provides substantial improvement relative to the linearity of drive current 812. When switch 819 is in the rightward position, threshold voltage 824 comprises DC reference voltage V1 which is a generally unchanging voltage level greater than the minimum of all instantaneous amplitudes of feedback voltage 808 and lesser than the maximum of all instantaneous amplitudes of feedback voltage 808. Such condition provides that the amplitude of drive voltage 811 and the amplitude of drive current 812 is substantially independent of the amplitude of feedback voltage 808. Thus, amplifier 821 is substantially non-linear when threshold voltage 824 comprises DC reference voltage V1.

In the preferred embodiment of amplifier 821 linearity is improved by providing a high frequency time-base signal to the comparator instead of DC reference voltage V1.

Figure 9:
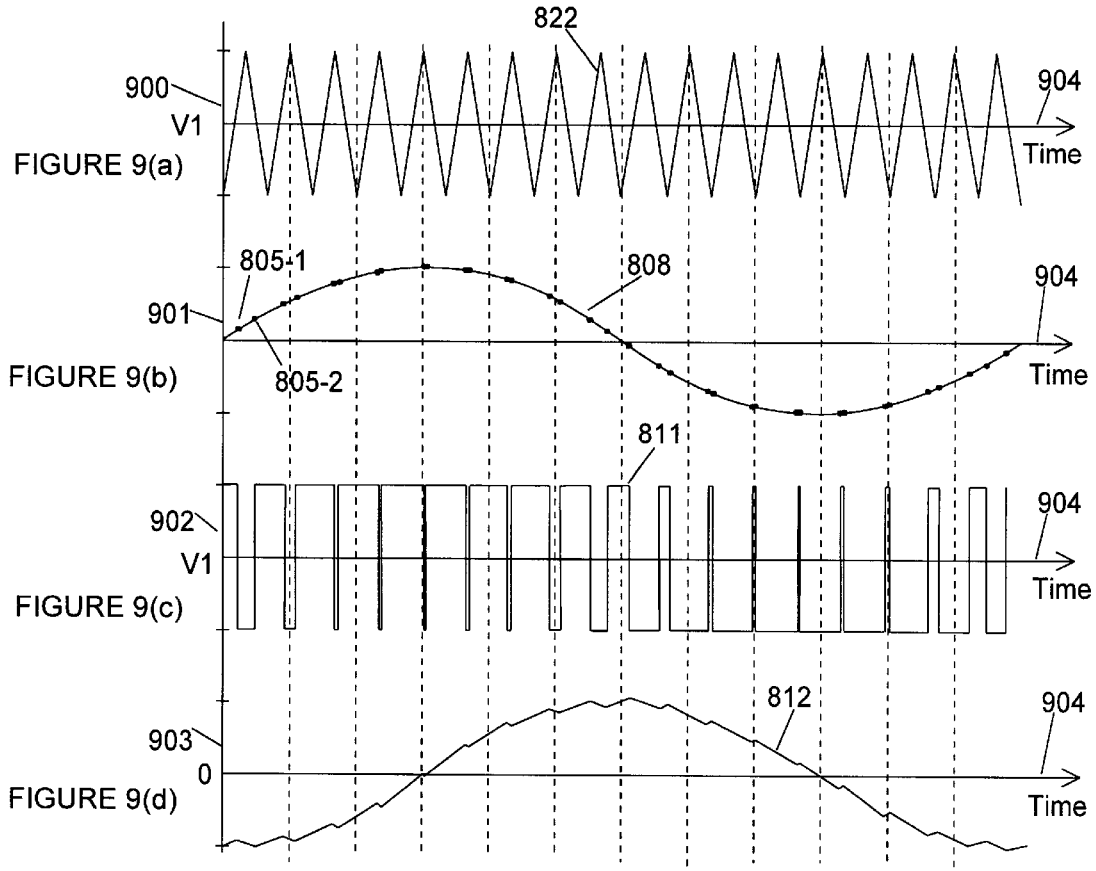
FIG. 9(*a*) shows, in graphical format, high frequency time-base signal 822 of the preferred embodiment of the invention.

FIG. 9 shows, in graphical format, the resultant waveforms for the circuit of FIG. 8(*a*) when switch 819 is in the leftward position to provide threshold voltage 824 comprising high frequency time-base signal 822. FIG. 9(*a*) shows, in graphical format, high frequency time-base signal 822 of the preferred embodiment of the invention. Vertical axis 900 represents the instantaneous value of signal 822. Time axis 904A intersects axis 900 at point V1 representative of reference voltage V1. Signal 822, commonly referred to as a triangle-wave, constitutes time variant threshold voltage 824 who's frequency is generally more than twice the highest frequency of feedback signal 808. Other wave forms may be utilized for signal 822 such as a sinusoidal waveform or saw-tooth wave form but the triangle-wave provides the intended results and is easily generated by low cost circuitry.

FIG. 9(*b*) shows, in graphical format, generally sinusoidal feedback voltage 808 provided by prior art pickup 600 to non-linear switching amplifier 821 of the invention. Vertical axis 901 represents the instantaneous value of feedback voltage 808. Time axis 904B intersects axis 901 at point V1 representative of reference voltage V1. Points 805-1,805-2 to 805-N mark the locations in time when the instantaneous value of feedback voltage 808 equals the instantaneous voltage of high frequency time-base signal 822 thereby causing comparator 800 to change drive-switch 804. Such changes provide the pulse-modulated square-wave drive voltage 811 in FIG. 9(*c*).

FIG. 9(*c*) shows, in graphical format, pulse-width modulated square-wave drive voltage 811 provided to driver 602 by non-linear switching amplifier 821 of the invention. Vertical axis 92 represents the instantaneous value of drive voltage 811. Time axis 904C intersects axis 902 at point V1 representative of reference voltage V1. Drive voltage 811 is a series of constant amplitude pulses having time duration dependent on the instantaneous amplitude of feedback voltage 808 and having periodic frequency dependent on the periodic frequency of time-base 822.

FIG. 9(*d*) shows, in graphical format, drive current 812 provided to driver 602 by non-linear switching amplifier 821 of the invention. Vertical axis 903 represents the instantaneous value of drive current 812. Time axis 904D intersects axis 903 at point 0 representative of zero drive current 812. Current 812 is the time integrated result of drive voltage 811 as discussed above in reference to FIG. 8(*e*). The instantaneous amplitude of current 812 is substantially dependant on the instantaneous amplitude of feedback signal 808. Therefore, the invention provides non-linear switching amplifier means having (i) satisfactory linearity of drive current, and (ii) energy efficiency enhancement means to increase the energy efficiency of said amplifier means by substantially eliminating power dissipation at the semiconductor output device means. Additionally, the sustainer provides a threshold signal comprising a high-frequency time-based signal for providing constant amplitude drive signal pulses having (i) a time duration dependant on the instantaneous amplitude of said feedback signal, and (ii) a periodic frequency dependent on the periodic frequency of the time-base signal.

To provide uniform drive current and drive force, the preferred embodiment of the invention provides compensation means responsive to the impedance of the driver to compensate the drive signal. This is provided by a current-source amplifier. The current-source amplifier of the invention provides a drive current (I) and allows the resultant drive voltage (V) to be determined by the actual impedance of the driver (Z) according to Ohm's law, V=(I) (Z). The current-source amplifier senses the driver current as a means for altering the frequency response of the drive voltage. The current-source amplifier provides a generally constant amplitude drive current, and allows the amplitude of the resultant drive voltage to be determined according to Ohm's law. Since the current-source amplifier provides a drive current having a flat frequency response, and since the impedance of the driver of the invention is characteristically inductive, the drive voltage increases with increasing frequency . Since the frequency response of the drive force is generally proportional to the frequency response of the drive current, the drive force has a generally flat frequency response in accordance with the frequency response of the drive current.

Figure 10:
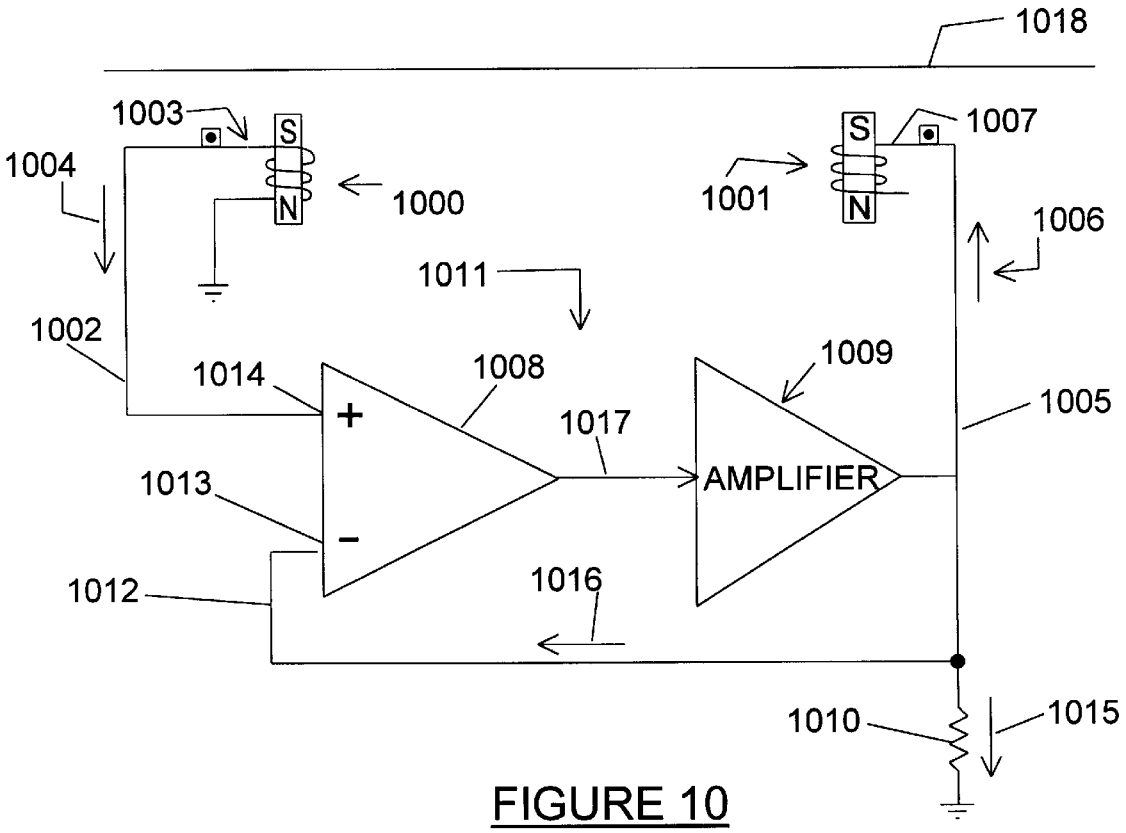
FIG. 10 shows, in schematic format, current-source amplifier 1011 of the preferred embodiment of invention.

FIG. 10 shows, in schematic format, current-source amplifier 1011 of the preferred embodiment of invention. Current-source amplifier 1011 comprises op-amp 1008, drive current sensing resistor 1010, and voltage-source amplifier 1009. Voltage-source amplifier 1009 may be a linear amplifier from the prior art or it may be a non-linear switching amplifier of the invention. Feedback signal 1002 comprises feedback voltage 1003 and feedback current 1004. Feedback signal 1002 is provided by pickup 1000 to op-amp 1008. Due to the common-mode characteristic and high gain of op-amp 1008, current-sense voltage 1012 applied to inverting input 1013 is substantially equal to feedback voltage 1003 applied to non-inverting input 1014 of op-amp 1008 by pickup 1000. Current 1015 through resistor 1010 is determined by Ohm's law I=V/R, where I is current 1015 in amperes, V is voltage 1003 in volts, and R is the value of resistor 1015 in ohms. Since the input bias current 1016 of op-amp 1008 is insubstantial, drive current 1006 is substantially equal to current 1015 as given by the preceding equation which does not contain any term relating to the impedance of driver 1001. To satisfy Ohms' law above, current-source amplifier 1011 automatically compensates the frequency related amplitude response and phase response of drive voltage 1007 for providing that the frequency related amplitude response and phase response of drive current 1006 is generally constant. Compensation is provided by error signal 1017 in response to current-sense voltage 1012 and feedback voltage 1003.

Current-sense voltage 1012 is determined by drive current 1006 which is dependant on drive voltage 1007 and the impedance of driver 1001. If for example, feedback voltage 1002 is greater than current-sense voltage 1012, error signal 1017 increases thereby increasing drive voltage 1007 and driver current 1006. This causes a corresponding increase in current-sense voltage 1012 due to the increase in current 1015. The increase in error signal 1017 continues until the difference between feedback voltage 1002 and current-sense voltage 1012 is insubstantial.

In an alternate embodiment, current sensing resistor 1010 could be replaced by a network of resistors, capacitors, inductors, and amplifying valves to achieve a drive current through driver 1001 having amplitude not generally constant relative to frequency. Such would be desirable for achieving different design objectives. For example, placing a capacitor in parallel with current sensing resistor 1010 would provide an increasing drive current relative to frequency. Placing a capacitor in series with current sensing resistor 1010 would provide a decreasing drive current relative to frequency. Furthermore, this same principle may be applied to driver 1001 as well. For example, placing a capacitor in parallel with driver 1001 would provide a decreasing drive current relative to frequency. Placing a capacitor in series with current driver 1001 would provide an increasing drive current relative to frequency. The permutations are numerous. For example providing op-amp 1008 with less than infinite gain will provide a high frequency cut-off point above which the drive current will decrease at a rate of 6 dB per octave. Below the high frequency cut-off point the drive current will be generally constant relative to frequency.

The purpose of current-source amplifier 1011 is to negate the impact of the impedance of driver 1001 on drive current 1006 thereby satisfying Ohm's law. Drive voltage 1007 provides drive current 1006 as dictated by Ohm's law without regard to the actual impedance of driver 1001. Thus, the sustainer includes a compensation means responsive to the impedance of the driver means for compensating the drive signal.

The preferred embodiment of the invention is a combination of the aspects just discussed. The electrical components and the amplifier are attached to a circuit board which is housed inside a cavity in body 105 underneath pick guard 111. This aspect and more shall be disclosed in the following paragraphs.

Figure 11:
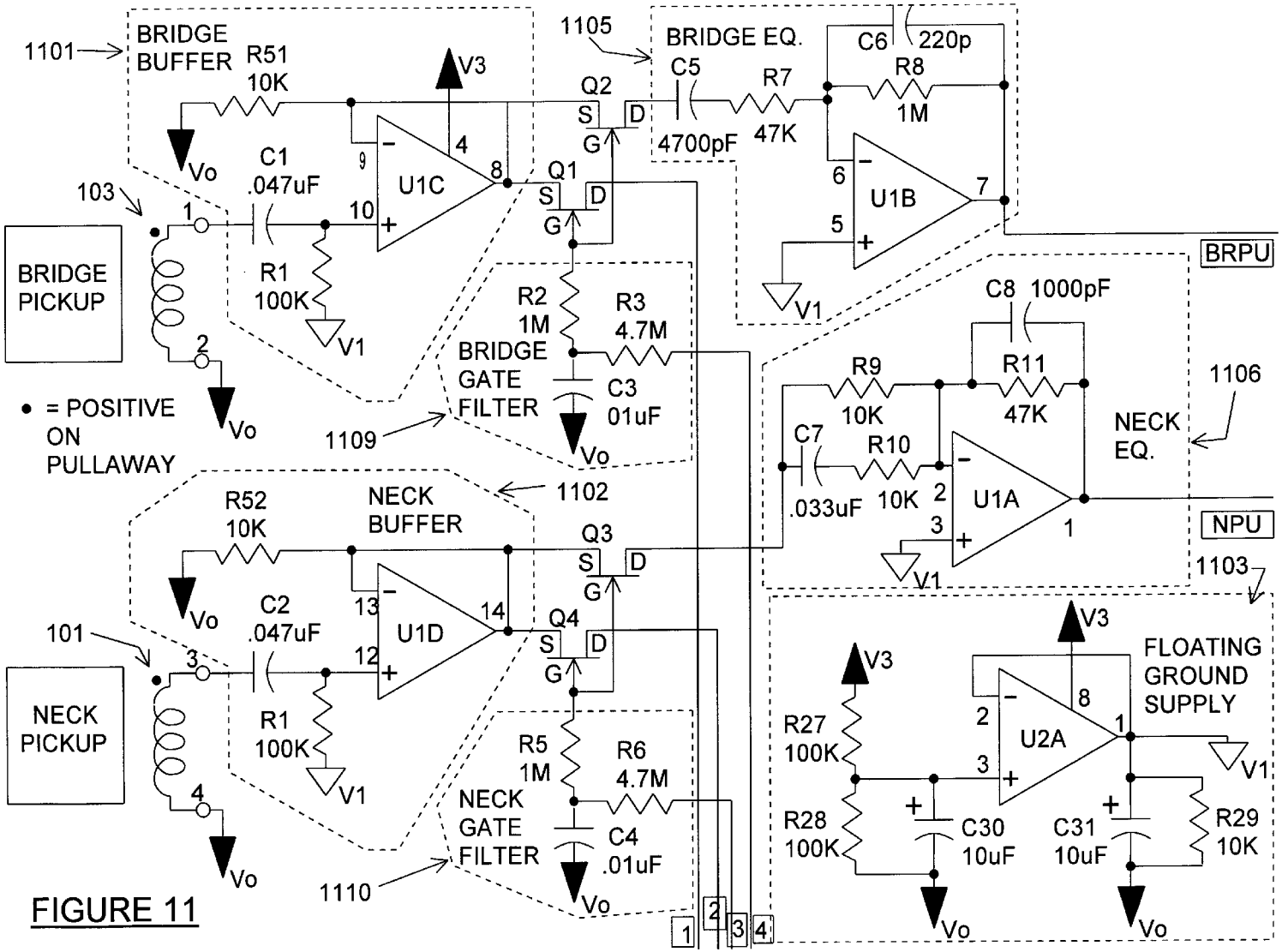
FIG. 11 shows, in schematic format, the preferred embodiment of sustainer 1100 of the invention.
Figures 11, 11B:
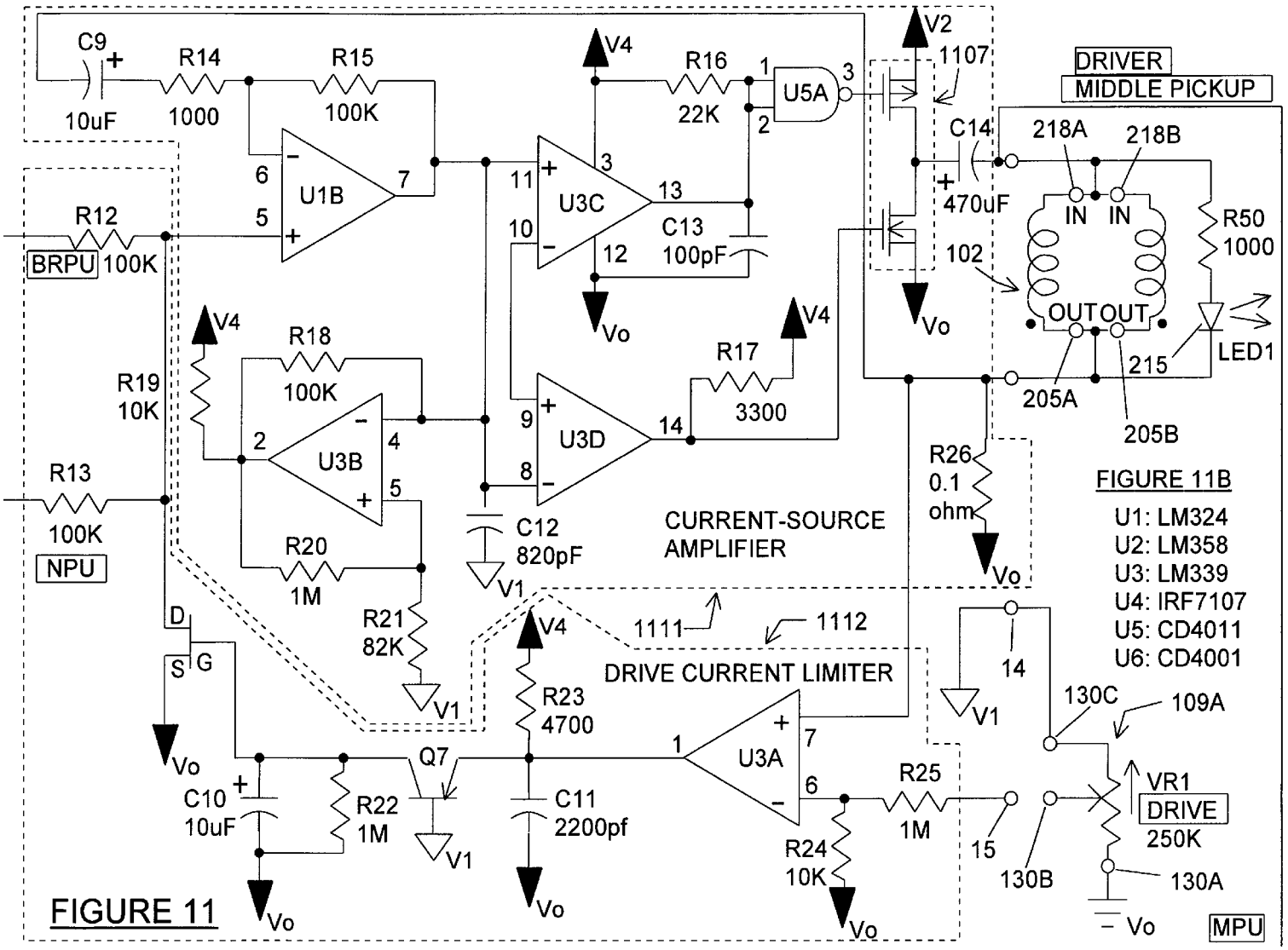
Figure 11:
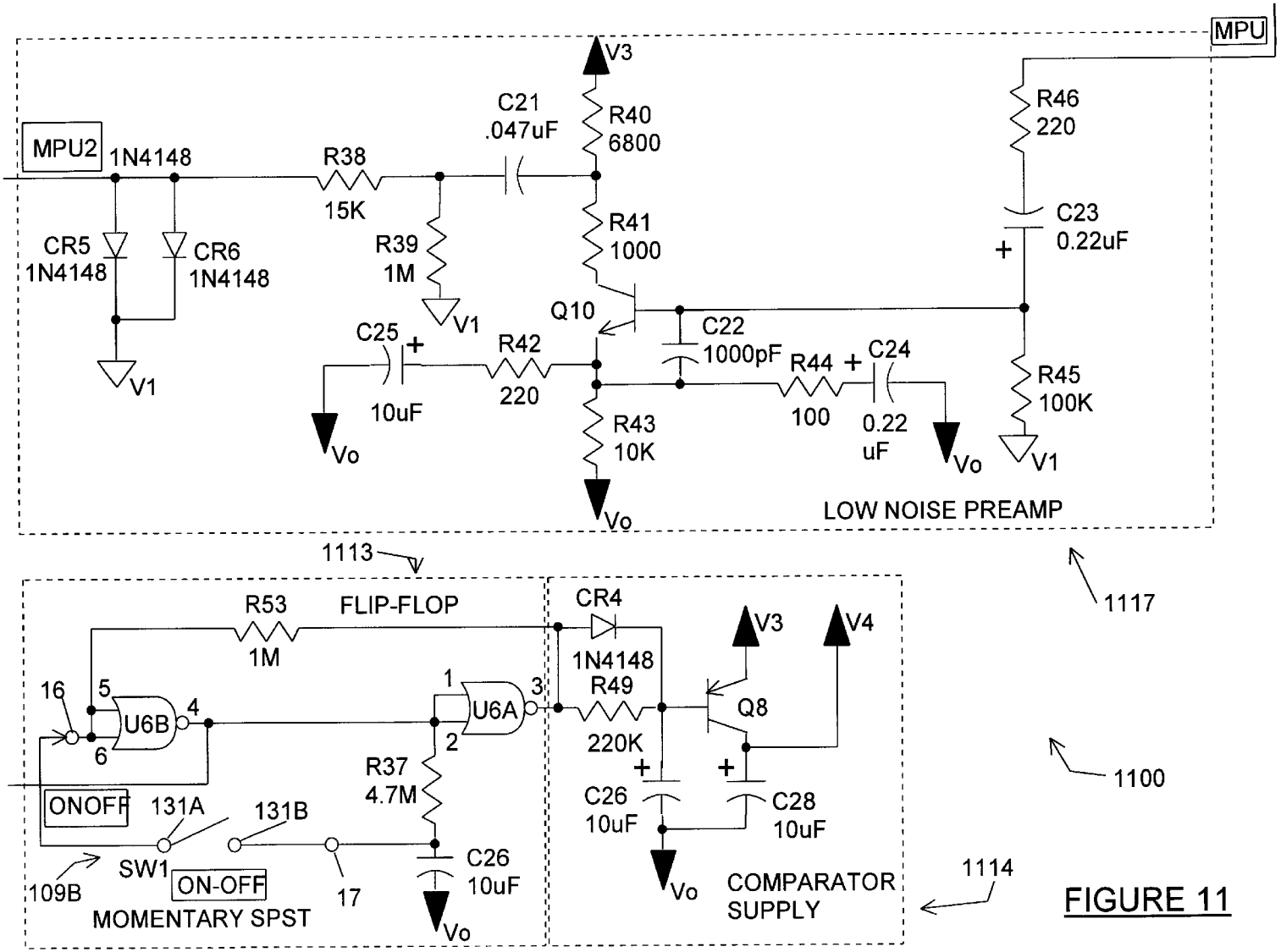
Figure 11:
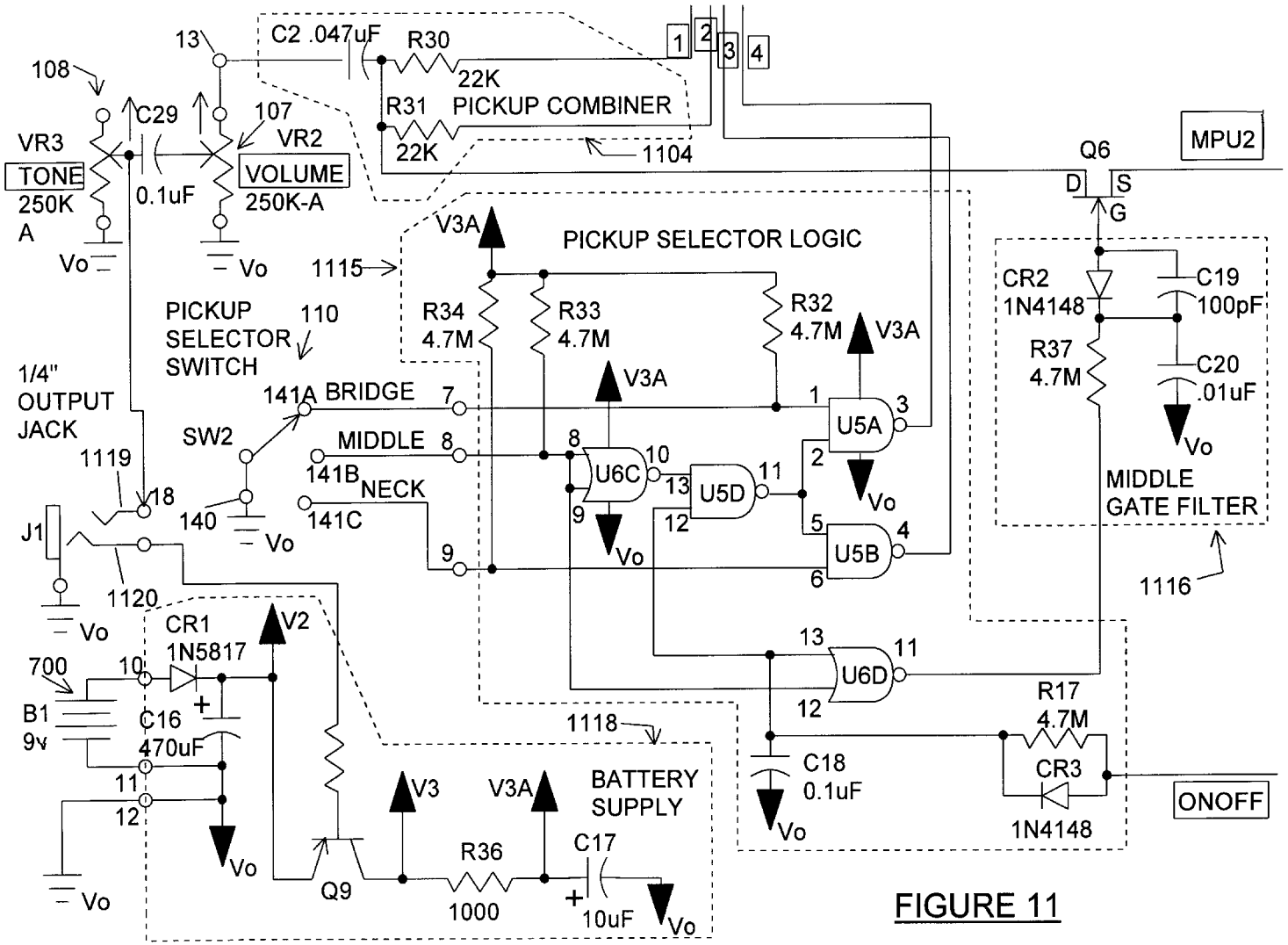

The sustainer comprises a circuit embodied as a circuit board housed underneath pick guard 111 inside a cavity in body 105. FIG. 11 shows, in schematic format, the preferred embodiment of sustainer 1100 of the invention. The following items have the same designations in FIGS. 1 and 11; neck pickup 101, driver 102, bridge pickup 103, pickup selector switch 110, output jack 116, volume control 107, tone control 108, drive control 109A, ON-OFF switch 109B. The following items have the same designations in FIGS. 7 and 11; battery 700, output jack 116. Lamp 215 has the same designations in FIGS. 2 and 11.

When plug 706 (of FIG. 7) is inserted into jack 116, battery supply 1118 is activated for providing power to sustainer circuit 1100. Battery supply 1118 comprises resistors R35,R36; capacitors C16,C17; diode CR1, and transistor Q9. Plug 706 connects resistor R35 to battery ground V0 through jack terminal 1120 and circuit board terminal 18. That connection draws current away from the base of transistor Q9 for turning "on" transistor Q9 to conduct battery current from battery 700 through diode CR1 and transistor Q9 to battery supplies V3 and V3A. Diode CR1 blocks battery current from flowing in the wrong direction if battery 700 is accidentally connected in reverse. Capacitor C16 provides surge current to drive switches 1107,1108 while they are providing drive current to driver 102. Resistor R36 and capacitor C17 provide AC bypass for battery supply V3A.

Battery supply V3 is applied to floating ground supply 1103 comprising resistors R27,R28,R29; capacitors C30, C31, and op-amp U2A. Floating ground supply 1103 provides floating ground V1 which is a DC voltage generally half the potential of battery supply V3. Floating ground V1 provides bias current to numerous components in FIG. 11.

Bridge buffer 1101 comprises resistors R1R51; op-amp U1C; and capacitor C1. Bridge buffer 1101 isolates bridge pickup 103 from variations in load resistance. Bridge buffer 1101 shifts the DC level of the bridge pickup feedback signal from battery ground V0 to floating ground V1. Bridge pickup 103 is connected to bridge buffer 1101 via circuit board terminals 1,2. The feedback signal from bridge pickup 103 is coupled to op-amp U1C-pin 10 via DC blocking capacitor C1. Resistor R1 provides bias current to op-amp U1C-pin 10 from floating ground V1. Op-amp U1C-pins 8,9 are connected together to provide a unity-gain buffer amplifier. Resistor R51 draws bias current from op-amp U1C-pin 8 to decrease cross-over distortion.

An aspect of the invention is the analog switching provided by JFET's Q1,Q2,Q3,Q4,Q6 which are controlled by analog switch control signals provided by pickup selector logic 1115.

JFET Q1 provides an analog switch means for applying the buffered bridge pickup feedback signal to resistor R30 of pickup combiner 1104. JFET Q2 provides an analog switch means for applying the buffered bridge pickup feedback signal to capacitor CS of bridge EQ 1105. Applying a "low" voltage (battery ground V0) to the gate of JFET Q2 turns the device "off" (transistor cut-off mode) causing the channel resistance between the source and drain of JFET Q2 to be relatively high thus providing an open circuit to prevent the bridge pickup feedback signal from being applied to bridge EQ 1105. Applying a "high" voltage (battery supply V3A) to the gate of JFET Q2 turns the device "on" (transistor saturation mode) causing the channel resistance between the source and drain of JFET Q2 to be relatively low thus providing a closed circuit to allow the bridge pickup feedback signal to be applied to bridge EQ 1105 and current-source amplifier 1111. Many different types of devices may be utilized as analog switches. The following is an exemplary list not an exclusive list; bi-polar transistors, Junction-Field-Effect-Transitors (JEET's), Insulated-Gate-Field-Effect-Transistors (IGFET's), and a mechanical relay. Generally, analog switch devices employ compounds of silicon, gallium, germanium, or other elements including metals and metal oxides. Such devices generally provide a gate terminal for controlling the resistance to the flow of current between an input terminal and an output terminal. The ability of a low power gate signal to provide an "on" resistance less than 300 ohms and an "off" resistance greater than 1,000,000 ohms is a preferable feature of the analog switch devices utilized in the preferred embodiment of the invention. Thus, the invention provides analog switch means responsive to an analog switch control signal transition for enabling the conveyance of an output signal to the output jack.

Bridge gate-filter 1109 comprises resistor R2,R3 and capacitor C3 for attenuating the high frequency components in the analog switch control voltage applied to resistor R3. Such attenuation decreases contamination of the bridge pickup feedback signal conveyed through JFET's Q1,Q2 by the high frequency components in the analog switch control voltage. Since the bridge pickup feedback signal conveyed through JFET Q1 is applied to an external amplifier and speaker, the attenuation of the high frequency components decreases an audible "pop" that would otherwise be heard through the external speaker.

The sustainer provides means for processing the bridge pickup feedback signal. When JFET Q2 is "on", the buffered bridge pickup feedback signal from bridge buffer 1101 is applied to bridge EQ 1105 comprising resistors R7,R8; op-amp U1B-pin 6; capacitors C5, C6. Resistor R7 determines the low cut-off frequency of bridge EQ 1105. Resistor R8 and capacitor C6 are connected between op-amp U1B-pins 6,7 for determining the gain and high cut-off frequency of bridge EQ 1105. The location of bridge pickup 103 provides a feedback signal that favors the harmonic frequencies of strings 104 over the fundamental frequencies of strings 104. That location causes sustainer 1100 to emphasize sustain of the harmonic frequencies when bridge pickup 103 provides the feedback signal. To further emphasize the sustain of harmonic frequencies, capacitor Cs and resistor R7 provide an attenuation of 3 dB or greater to frequencies below 720 Hz. Since the bridge pickup feedback signal is relatively low in amplitude resistor R8 sets the gain of op-amp U1B at 26.5 dB. The bridge pickup feedback signal contains very high harmonic frequencies that are not useful to sustainer 1100 and could potentially increase the chances of uncontrolled oscillation. Capacitor C6 attenuates frequencies above 720 Hz by 3 dB or greater. The cascaded result of the cut-off of high frequencies and low frequencies is such that bridge EQ 1105 provides a band-pass filter having gain of 20 dB at 720 Hz and 6 db/octave roll-off for frequencies above and below 720 Hz. Resistor R12 combines the bridge pickup feedback signal with the neck pickup feedback signal provided by neck EQ 1106 to resistor R13.

In addition to the above, bridge EQ 1105 provides phase inversion of the bridge pickup feedback signal as a means to process and alter direct electrostatic feedback as described earlier in reference to FIG. 6(*e*).

The sustainer provides means for processing the neck pickup feedback signal. Neck buffer 1102 comprises resistors R4,R52; op-amp U1D; and capacitor C2. Neck buffer 1101 isolates neck pickup 101 from variations in load resistance and neck buffer 1102 shifts the DC level of the neck pickup feedback signal from battery ground V0 to floating ground V1. Neck pickup 101 is connected to neck buffer 1102 via circuit board terminals 3,4. The feedback signal from neck pickup 101 is coupled to op-amp U1D-pin 12 via DC blocking capacitor C2. Resistor R4 provides bias current to op-amp U1D-pin 12 from floating ground V1. Op-amp U1D-pins 13,14 are connected together to provide a unity-gain buffer amplifier. Resistor R52 draws bias current from op-amp U1D-pin 14 to decrease cross-over distortion.

JFET Q4 provides an analog switch means for applying the buffered neck pickup feedback signal to resistor R31 of pickup combiner 1104. JFET Q3 provides an analog switch means for applying the buffered neck pickup feedback signal to capacitor C7 and resistor R9 of neck EQ 1106. JFET's Q3,Q4 provide analog switching functions similar to those provided by JFET's Q2,Q1 respectively.

Neck gate-filter 1110 comprises resistor R5,R6 and capacitor C4 to attenuate the high frequency components in the analog switch control voltage applied to resistor R6. When JFET Q3 is "on", the buffered neck pickup feedback signal from neck buffer 1102 is applied to neck EQ 1106 comprising resistors R9,R10,R11; op-amp U1A, and capacitors C7,C8. Resistors R9, R10 and capacitor C7 determine the cut-off frequencies of the low frequency shelving characteristic of neck EQ 1106. Resistor R11 and capacitor C8 connected between op-amp U1A-pins 1,2 determine the gain and high cut-off frequency. The location of neck pickup 101 provides a feedback signal that increases the fundamental frequencies of strings 104 over the harmonic frequencies of strings 104A through 104F. Such location causes sustainer 1100 to favor sustain of the fundamental frequencies when neck pickup 101 provides the feedback signal.

The low frequency shelving characteristic of neck EQ 1106 provides a 3 dB to 6 dB attenuation to frequencies below 480 Hz. Since the neck pickup feedback signal is relatively low in amplitude, resistor R11 sets the gain of neck EQ 1106 at 20 dB. The neck pickup feedback signal contains very high harmonic frequencies that are not useful to the sustain amplifier and could potentially increase the chances of uncontrolled oscillation. Capacitor C8 attenuates frequencies above 3400 Hz by 3 dB or greater. Resistor R13 combines the neck pickup feedback signal with the bridge pickup feedback signal provided by bridge EQ 1105 to resistor R12.

In addition to the above, neck-EQ 1106 also provides phase inversion to the neck pickup feedback signal as a means to process and alter direct electrostatic feedback as described earlier in reference to FIG. 6(*e*).

Another aspect of the invention is current-source amplifier 1111. The bridge pickup feedback signal and the neck pickup feedback signal are combined by resistors R12,R13 and applied to current-source amplifier 1111. Op-amp U2B is equivalent to op-amp 1008 of FIG. 10 in reference to current-source amplifier 1011 described earlier. Resistors R1S and R14 reduce the gain of op-amp U2B so that the frequency response of current-source amplifier 1111 extends up to only about 3000 Hz. Capacitor C9 blocks the DC component of the current-sense voltage provided by current sensing resistor R26. Op-amp U2B-pin 7 provides an error for compensating the drive signal in response to the impedance of driver 102. Together comparators U3C,U3D provide the same function as the single comparator 800 of FIG. 8(*a*) in reference to the non-linear switching amplifier 821. Comparator U3B-pin 4 provides the frequency time-base signal to comparators U3C-pin 10 and U3D-pin 9.

Resistors R19,R18,R20,R21, capacitor C12, and Comparator U3B form a high frequency time-base generator for providing a triangle wave signal having a frequency of 30 KHz and peak-to-peak amplitude of about 0.50 volts. Comparator U3C-pin 13 provides the drive-switch control signal to NAND gate inverter USC-pins 8,9 for controlling the gate terminal of drive switch 1107 (which is a P-channel semiconductor MOSFET power transistor at IC U4-pins 3,4,6). Pull-up resistor R16 and capacitor C13 introduce a brief time delay into the drive-switch control signal transition that turns "on" switch 1107. Insubstantial time delay is introduced into the drive-switch control signal transition that turns "off" switch 1107. NAND gate U5C inverts the phase of the gate control signal for providing the correct polarity drive-switch control signal to drive switch 1107.

Drive switch 1108 is an N-channel semi-conductor MOSFET power transistor at IC U4-pins 1,2,8. Drive switch 1108 is provided with a similar drive-switch control signal from comparator U3D-pin 14. Pull-up resistor R17 interacts with the intrinsic gate capacitance of drive switch 1108 for introducing a brief time delay into the drive-switch control signal transition that turns "on" switch 1108. Insubstantial time delay is introduced into the drive-switch control signal transition that turns "off" switch 1108. The brief time delay decreases cross-conduction of current that would otherwise flow directly from the battery supply V2, through drive switches 1107 and 1108, to battery ground V0 while drive switches 1107,1108 are transitioning between "on" and "off". If not decreased, the cross-conduction current would increase the power dissipation of drive switches 1107,1108 thereby decreasing efficiency of current-source amplifier 1111.

Coupling capacitor C14 couples the pulse-width modulated square-wave drive signal from drive switches 1107, 1108 to driver 102 which is connected to circuit board terminals 5,6. Driver 102 is reverse-connected so as to accept a phase-inverted drive signal processing and altering direct electrostatic feedback as described earlier in reference to FIG. 6(*e*).

Another aspect of the invention is lamp 215 which emits light laterally away from strings 104 for indicating that the drive signal is applied to driver 102. Lamp 215 is a light emitting diode LED1. Lamp 215 and resistor R50 are housed inside of cover 209 (FIG. 2) that encases driver 102. Lamp 215 extends through hole 216 in cover 209 for giving a visual indication that a drive signal is applied to driver 102. Since the drive signal has constant peak-to-peak voltage swing, the brightness of lamp 215 is generally independent of the drive current. Lamp 215 glows as brightly when the drive current is relatively low as when the drive current is relatively high because lamp 215 is more responsive to the amplitude of the drive signal pulses than the duration of the drive signal pulses.

In reference to FIG. 7(*b*), another aspect is the electrostatic shielding provided between the inner layers 300A, 300B of driver 102 and pickups 101,103. The outer layers 301A, 301B provide the electrostatic shielding to avoid using costly foil shielding. Circuit board terminal 5 provides a relatively large amplitude drive signal of approximately 8.5 volts peak-to-peak. Such enables circuit board terminal 5, and all connections to it, to emit an electrostatic field that couples to pickup 101,103 as direct electrostatic feedback. Circuit board terminal 6 has a relatively small amplitude current sense voltage of approximately 0.1 Vp-p. Such is practically battery ground V0 relative to the drive signal. Thus, the signal at circuit board terminal 6 is utilized for providing an electrostatic shield between the drive voltage at circuit board terminal 5 and pickup 101,103.

FIG. 3 shows coils 203A, 203B of driver 102. Terminals 218A,218B of driver 102 are connected to the inner layers 300A,300B of coils 203A,203B respectively. Inner layers 300A,300B are those portions of wire comprising coils 203A,203B that are closer to cores 206A,206B respectively. Terminals 218A,218B are connected to circuit board terminal 5 in FIG. 11. Thus, inner layers 300A,300B receive the fluctuating drive signal that is capable of emitting an electrostatic field. Terminals 205A,205B of driver 102 in FIG. 3 are connected to the outer layers 301A,301B of coils 203A, 203B respectively. Outer layers 301A,301B are those portions of wire comprising coils 203A,203B that are farther away from cores 206A,206B respectively. Terminals 205A, 205B are connected to circuit board terminal 6 in FIG. 11. Outer layers 301A,301B receive the reference signal (practically battery ground V0). Outer layers 301A,301B are between inner layers 300A,300B an pickups 101,103 to provide electrostatic shielding between inner layers 300A, 300B and pickups 101,103. Thus, the invention provides means for applying a reference voltage to the outer layers of both of the coils so that the outer layers provide electrostatic shielding between the inner layers and the pickups.

Referring to FIG. 11, another aspect of the sustainer is its drive current limiter 1112 which utilizes drive current sensing resistor R26 for changing the amplitude of the feedback signal in response to a change in the drive current. Drive current limiter 1112 provides means for maintaining a generally constant drive current in the face of widely fluctuating amplitude of the feedback signal. FIG. 1 (*b*) shows that drive control 109A of the invention is adjusted by rotating knob 109C in the circular direction shown by arrow 132. FIG. 11 shows that terminal 130A of drive control potentiometer 109A is connected to battery ground V0 and that terminal 130C is connected to circuit board terminal 14 and that terminal 130B is connected to circuit board terminal 15. Drive current is conducted through sensing resistor R26 to provide a current-sense feedback voltage representative of the drive current through driver 102. The current-sense feedback voltage is applied to op-amp U2B-pin 6 of current-source amplifier 1111 through coupling capacitor C9 and resistor R14. Resistor R26 also provides the current-sense feedback voltage to comparator U3A-pin 7 of drive current limiter 1112.

Drive current limiter 1112 comprises resistors R12,Rl3, R22,R23,R24,R25; capacitors C10,C11; and comparator U3A. Comparator U3A compares the current-sense feedback voltage with a threshold voltage applied to comparator U3A-pin6. The threshold voltage is predetermined by the user adjustment of drive control 109A. When the drive current has sufficient amplitude to produce a current-sense feedback voltage greater than the threshold voltage, comparator U3A-pin 1 transitions from battery ground V0 to battery supply voltage V4 at a rate determined by pull-up resistor R23 and timing capacitor C11. When the error voltage at comparator U3A-pin 1 reaches about 0.6 volts above floating ground V1, transistor Q7 provides current to capacitor C10 and resistor R22. As the voltage on capacitor C10 rises, the gate of JFET Q5 decreases the channel resistance and attenuates the pickup feedback signals applied to op-amp U2B-pin 5 through resistor R12,R13. Such action continues until the drive current provides a current-sense feedback voltage to comparator U3A-pin 7 that is generally equal to the user defined threshold voltage applied to comparator U3A-pin 6. Subsequent increases in the amplitude of the feedback signal do not produce substantive corresponding increases in the actual drive current due to the limiting action of drive current limiter 1112. The drive current is generally maintained at a limit defined by the user. Thus, means are provided for (i) providing a current-sense signal responsive to the said drive current and (ii) for changing the amplitude of the feedback signal in response to a change in the current-sense signal.

Another aspect of the invention provides that the sustainer can be enabled or disabled by one simple, low cost momentary contact switch. Thus, the major components of the sustainer are responsive to a transition in a control signal. Analog switches are provided for combining the pickup signals with the driver output signal and for providing the substitution signal to the output jack (instead of the driver output signal) when the sustainer is enabled. The amplifier responds to a control signal as well. A flip-flop provides the primary control signal transitions and delay circuits provide the secondary control signal transitions.

FIG. 1(*b*) shows that ON-OFF switch 109B of the invention is actuated by temporarily pressing down on knob 109C towards pick guard 111 in the direction indicated by arrow 133. This causes a temporary contact between switch terminals 131A,131B. FIG. 11 shows that switch terminal 131A is connected to circuit board terminal 16 and that switch terminal 131B is connected to circuit board terminal 17 for controlling flip-flop 1113. Flip-flop 1113 comprises NOR gates U6A,U6B; resistors R48,R53 and capacitor C27. Flip-flop 1113 provides control signals for turning current-source amplifier 1111 "on" or "off". When flip-flop 1113 is "off", current-source amplifier 1111 is turned "off" for disabling the sustainer. When flip-flop 1113 is "on", current-source amplifier 1111 is turned "on" for enabling the sustainer.

Flip-flop 1113 is considered "off" when the control signal provided by NOR gate U6B-pin 4 is "low" (battery ground V0) and the control signal provided by NOR gate U6A-pin 3 is "high" (battery supply V3A). Flip-flop 1113 is considered "on" when the control signal provided by NOR gate U6B-pin 4 is "high" and the control signal provided by NOR gate U6A-pin 3 is "low". When flip-flop 1113 is "off", resistor R53 conveys the "high" from NOR gate U6B-pin 3 to U6B-pins 5,6 for "latching" both NOR gates in their respective states. When flip-flop 1113 is "on", resistor R53 conveys the "low" from NOR gate U6B-pin 3 to U6B-pins 5,6 for "latching" both NOR gates in their respective states.

Flip-flop 1113 turns "off" current-source amplifier 1111 by turning "off" drive switches 1107,1108. The "high" from NOR gate U6A-pin 3 is applied to comparator supply 1114. Comparator supply 1114 comprises capacitors C26,C28; resistor R49, diode CR4, and transistor Q8. The "high" provided by flip-flop 1113 is conveyed through diode CR4 for turning "off" transistor Q8 and removing power supply V4 from comparators U3A,U3B,U3C,U3D. When power supply V4 is removed, the output of comparator U3C-pin 13 goes "low" and turns "off" drive switch 1108. When power supply V4 is removed, the output of comparator U3D-pin 14 goes "low" which causes NAND gate U5C-pin 10 to go "high" for turning "off" drive switch 1107. Thus, flip-flop 1113 turns "off" current-source amplifier 1111 by turning "off" drive switches 1107,1108.

To cause a transition in the control signals provided by flip-flop 1113, switch 109B is actuated for temporarily connecting together the circuit board terminals 16,17. The actuation of switch 109B connects capacitor C27 to NOR gate U6B-pins 5,6. If flip-flop 1113 was previously "off", capacitor C27 was discharged through resistor R48 because NOR gate U6B-pin 4 was "low". Actuating switch 109B connects capacitor C27 to NOR gate U6B-pins 5,6 thereby temporarily overriding the "high" conveyed by resistor R53. This forces NOR gate U6B-pins 5,6 to go "low". Such temporary action propagates through both NOR gates thereby turning "on" flip-flop 113.

When flip-flop 1113 is "on", current-source amplifier 1111 is turned "on" because the "low" at NOR gate U6A-pin 3 draws current out of the base of transistor Q8 through resistor R49. This turns "on" transistor Q8 thereby enabling battery supply V4 to provide power to comparators U3A, U3B,U3C,U3D.

To turn "off" flip-flop 1113, switch 109B is contacted. The charge on capacitor C27 overrides the "low" provided from resistor R53 thereby forcing NOR gate U6B-pins 5,6 to go "high". This turns flip-flop 113 "off".

When flip-flop 1113 is "off", current-source amplifier 1111 is turned "off" because the "high" at NOR gate U6A-pin 3 prevents current flow out of the base of transistor Q8 through resistor R49. This turns "off" transistor Q8 thereby disabling battery supply V4 and removing the drive signal from driver 102.

The transitions in the control signal provided from flip-flop 1113 are conveyed to pickup selector logic 1115. To explain their interaction, the interaction between pickup selector switch 110 and pickup selector logic 1115 will first be explained.

FIG. 1(*c*) shows that pickup selector switch body 10A of the prior art is attached to the underside of pick guard 111 with brackets 110C,110D and screws 117,118. Switch arm 110E projects through slot 119 in pick guard 111 for rotating around axis 142 in the leftward and rightward directions shown by arrow 143. Switch arm 110E can be positioned in any one of five detent positions designated 1,2,3,4,5 shown in FIGS. 1(*a*),1(*c*). Knob 110B is attached to the end of switch arm 110E.

FIG. 11 shows that selector switch terminal 140 is the common connection which is connected to battery ground V0. Selector switch terminals 141A,141B,141C are connected to circuit board terminals 7,8,9 respectively. When pickup selector switch 110 is in detent position 1, circuit board terminal 7 is at battery ground V0 and pull-up resistors R33,R34 apply battery supply V3A to circuit board terminals 8,9. Such action indicates that the user wants bridge pickup 103 to provide the output signal to output jack 116. When pickup selector switch 110 is in detent position 2, circuit board terminals 7,8 are at battery ground V0 indicating that the user wants bridge pickup 103 and driver 102 to provide the output signal to output jack 116. When pickup selector switch 110 is in detent position 3, circuit board terminal 8 is at battery ground V0 indicating that the user wants driver 102 to provide the output signal to output jack 116. When pickup selector switch 110 is in detent position 4, circuit board terminals 8,9 are at battery ground V0 indicating that the user wants neck pickup 101 and driver 102 to provide the output signal to output jack 116. When pickup selector switch 110 is in detent position 5, circuit board terminal 9 is at battery ground V0 indicating that the user wants neck pickup 101 to provide the output signal to output jack 116.

Pickup selector logic 1115 comprises resistors R32,R33, R34,R47; capacitor C18; diode CR3; NAND gate U5A, U5B,U5D; and NOR gates U6C,U6D. Pickup selector logic 1115 provides analog switch control signals for determining which pickups provide the output signal to the external amplifier and speaker connected to output jack 116. When flip-flop 1113 is "off", NOR gate U6B-pin 4 provides a "low" to NAND gate U5D-pin 12 and NOR gate U6D-pin 13 through resistor R47 for providing pickup selector switch 110 with total control over pickup selector logic 1115. When flip-flop 1113 is "on", NOR gate U6B-pin 4 provides a "high" to NAND gate U5D-pin 12 and NOR gate U6D-pin 13 through resistor R47 for providing pickup selector switch 110 with only partial control over pickup selector logic 1115.

Regardless of whether flip-flop 1113 is "on" or "off", placing pickup selector switch 110 in detent position 1 indicates that only bridge pickup 103 is to provide the output signal. While in detent position 1, NAND gate USA-pin 1 goes "low" thereby causing NAND gate USA-pin 3 to go "high". Such "high" analog switch control signal is applied to JFET's Q1,Q2 through bridge gate-filter 1109 for turning "on" both of JFET's Q1,Q2. JFET Q1 applies the bridge pickup feedback signal to resistor R30. DC blocking capacitor C15 passes the AC components in the feedback signal to volume control potentiometer 107, and tone control potentiometer 108, and output jack 116. When conveyed to output jack 116, the bridge pickup feedback signal is considered an output signal. JFET Q2 applies the bridge pickup feedback signal to bridge EQ 1105. Since switch 110 is still in detent position 1, NAND gate U5B-pin 4 and NOR gate U6D-pin 11 are both "low" because circuit board terminals 8,9 have been pulled "high" by pull-up resistors R33,R34. Such "low" signals turn "off" JFET's Q3,Q4,Q6 for providing that the bridge pickup feedback signal is the only signal applied to output jack 116 and op-amp U2B. Op-amp U2B conveys the bridge pickup feedback signal to current-source amplifier 1111.

Regardless of whether flip-flop 1113 is "on" or "off", placing pickup selector switch 110 in detent position 5 indicates that only neck pickup 101 is to provide the output signal. Detent position 5 causes NAND gate U5B-pin 6 to go "low" thereby causing NAND gate U5B-pin 4 to go "high". Such "high" analog switch control signal turns "on" JFET's Q3,Q4 for applying the neck feedback signal to neck EQ 1106 and output jack 116. NAND gate USA-pin 3 goes "low" due to pull-up resistor R32 at NAND gate U5A-pin 1. NOR gate U6D-pin 11 goes "low" due to pull-up resistor R33 at NOR gate U6D-pin 12. Such "low" analog switch control signals turn "off" JFET's Q1,Q2,Q6. Thus, detent position 5 of pickup selector switch 110 enables neck pickup 101 to provide the only feedback signal to current-source amplifier 1111 and the only output signal to output jack 116.

When flip-flop 1113 is "off", placing pickup selector switch 110 in detent position 3 indicates that driver 102 is to provide the output signal. Detent position 3 causes NOR gate U6D-pin 12 to go "low" thereby causing NOR gate U6D-pin 11 to go "high". Such "high" analog switch control signal turns "on" JFET Q6 for conveying the driver output signal to output jack 116. Middle gate-filter 1116 comprises capacitors C20,C19; resistor R37; and diode CR2 for attenuating high frequency components in the analog switch control signal applied to JFET Q6 thereby decreasing switching noise. NAND gate U5A-pin 3 goes "low" due to pull-up resistor R32 thereby causing NAND gate USA-pin 1 to go "high". NAND gate U5B-pin 4 goes "low" due to pull-up resistor R34 thereby causing NAND gate U5B-pin 6 to go "high". Such action turns "off" JFET's Q1,Q2,Q3,Q4 for enabling the driver output signal to be the only signal applied to output jack 116.

When flip-flop 1113 is "off", placing pickup selector switch 110 in detent position 2 indicates that driver 102 and bridge pickup 103 are to provide the output signal. NAND gate U5A-pin 3 is "high". NAND gate U5B-pin 4 is "low". NOR gate U6D-pin 11 is "high".

When flip-flop 1113 is "off", placing pickup selector switch 110 in detent position 4 indicates that driver 102 and neck pickup 101 are to provide the output signal. NAND gate U5A-pin 3 is "low". NAND gate U5B-pin 4 is "high". NOR gate U6D-pin 11 is "high".

When flip-flop 1113 is "on", placing pickup selector switch 110 in any of detent position 2, 3, or 4 indicates that bridge pickup 103 and neck pickup 101 are to provide the output signal. The "high" signal provided by U6B-pin 4 of flip-flop 1113 is conveyed to NAND gate U5D-pin 12 and NOR gate U6D-pin 13 through resistor R47 thereby causing NOR gate U6D-pin 11 to provide a "low" analog switch control voltage for turning "off" JFET Q6. Furthermore, NAND gate U5D is enabled thereby enabling any one of detent positions 2,3,4 to provide a "low" to U5A-pin 2 and U5B-pin 4 for turning "on" JFET's Q1,Q2,Q3,Q4. Therefore, when flip-flip 1113 is "on", any one of detent positions 2,3,4 enable both neck pickup 101 and bridge pickup 103 for providing the feedback signal and the output signal. Thus, the invention provides analog switch means responsive to a transition in a control signal for combining a first feedback signal with a second feedback signal for providing a composite feedback signal to the amplifier.

Furthermore, when flip-flip 1113 is "on", any one of detent positions 2,3,4 enable the bridge pickup feedback signal and the neck pickup feedback signal to be combined by pickup combiner 1104 for providing the substitution signal for the driver output signal. The substitution signal provided is a better substitute for the driver output signal than either of the individual feedback signals is alone. That is due to the fact that combining the two feedback signals changes the harmonic content of the substitution signal. The harmonic content is changed because bridge pickup 103 and neck pickup 101, being in different locations, respond differently to string harmonics. Combining the two feedback signals causes cancellation of certain harmonics and accentuation of others. Thus, the invention provides a substitution signal in response to the vibratory element. Sound modifier means change the harmonic content of the substitution signal independently of the driver output signal. A means is provided for substituting the substitution signal for the driver output signal while the drive signal is being applied to the driver means. In an alternative embodiment, one (or both) of the feedback signals is processed by a filter to change the harmonic content of the substitution signal. In both embodiment, the harmonic content of the substitution signal is being modified by a sound modifier means. In neither embodiment however, does the sound modifier means change the harmonic content of the driver output signal.

Thus, the sustainer includes means for providing an output signal in response to the vibratory element, an output jack means, and an analog switch means responsive to a transition in a control signal to enable the conveyance of the output signal to the output jack means. The output signal can be the same feedback signal that is provided to the amplifier or the output signal can be the driver output signal provided by the driver when the drive signal is not applied.

During the enabling and disabling of the sustainer, two control signal transitions are provided. The first control signal transition happens in response to the actuation of switch 109B. The second control signal transition happens in response to the first control signal transition after a brief time delay.

During the enabling transition of flip-flop 1113 (a transition from "off" to "on"), a first control signal transition is provided by NOR gate U6B-pin 4 which transitions from "low" to "high". Simultaneous with that, NOR gate U6A-pin 3 transitions from "high" to "low". Both of these transitions are part of the first control signal transition. Diode CR3 conveys that first transition with insubstantial delay to pickup selector logic 1115.

During the enabling transition, a time delay is provided by resistor R49 and capacitor C26 in response to the first control signal transition. About 0.1 seconds after the first control signal transition, capacitor C26 discharges through resistor R49 thereby turning "on" transistor Q8. Transistor Q8 provides a second control signal transition by transitioning battery supply V4 from about battery ground V0 to about battery supply V3. The first control signal transition enables pickup selector logic 1115 to substitute the substitution signal for the driver output signal. The second control signal transition enables amplifier 1111 for applying the drive signal to driver 102. This arrangement of control signal transitions gives pickup selector logic 1115 enough time to turn "off" JFET Q6 and turn "on" JFET's Q1,Q2,Q3,Q4 before applying the drive signal to driver 102. Thus, the sustainer includes a means for providing a first control signal transition at a predetermined point in time, means responsive to said first control signal transition provide a second control signal transition at a point in time that is later than the first control signal transition. Additionally, means are provided for applying the drive signal to the driver in response to the second control signal transition. Means are provided for substituting the substitution signal for the driver output signal in response to the first control signal transition.

For an example of the enabling transition, assume pickup selector switch 110 is in detent position and flip-flop 1113 transitions from "off" to "on". NAND gate U5A-pin 3 and NAND gate U5B-pin 4 transition from "low" to "high" to turn "on" JFET's Q1,Q4 for providing the substitution signal. NOR gate U6D-pin 11 transitions from "high" to "low" to turn "off" JFET Q6 for removing the driver output signal. After the substitution signal has substituted the driver output signal, the drive signal is applied to driver 102 by applying battery supply V4 to comparators U3A,U3B,U3C, U3D in response to the second control signal transition.

During the disabling transition of flip-flop 1113 (a transition from "on" to "off"), a first control signal transition is provided by NOR gate U6B-pin 4 which transitions from "high" to "low". Simultaneous with that, NOR gate U6A-pin 3 transitions from "low" to "high". Both of these transitions are part of the first control signal transition. Diode CR4 conveys the first transition with insubstantial delay to transistor Q8 for disabling battery supply V4 in response to the first control signal transition.

During the disabling transition, a time delay is provided by resistor R47 and capacitor C18 in response to the first control signal transition. About 0.1 seconds after the first control signal transition, capacitor C18 discharges through resistor R47 thereby providing a second control signal transition to pickup selector logic 1115 for substituting the driver output signal for the substitution signal. The first control signal transition removes the drive signal from driver 102 by disabling amplifier 1111. The second control signal transition provides the substitution. This arrangement of control signal transitions gives the drive current enough time to be dissipated by drive switches 1107, 1108 and other components before pickup selector logic 1115 applies the driver output signal to output jack 116. Thus, means provide a first control signal transition at a predetermined point in time. Another means, responsive to the first control signal transition, provides a second control signal transition that is at a point in time that is later than the first control signal transition. Additionally, the sustainer includes means for removing the drive signal from the driver in response to the first control signal transaction. Means are provided for substituting the driver output signal for the substitution signal in response to the second control signal transition.

For an example of the disabling transition, assume pickup selector switch 110 is in detent position 3. The first control signal transition removes battery supply V4. The second control signal transition provides a transition at NAND gate USA-pin 3 and NAND gate U5B-pin 4 for turning "off" JFET's Q1,Q4 thereby removing the substitution signal. NOR gate U6D-pin 11 transitions from "low" to "high" to turn "on" JFET Q6 for applying the driver output signal to output jack 116. After the drive signal has been remove from driver 102 (and the drive current has dissipated), the driver output signal is substituted for the substitution signal.

Another aspect of the invention is low noise pre-amp 1117. When flip-flop 1113 is "off", drive switches 1107,1108 are "off" and the driver output signal provided by driver 102 is easily detected and boosted by low noise pre-amp 1117 which comprises resistors R38, R39, R40, R41, R42, R43, R44, R45, R46; capacitors C21, C22, C23, C24; diodes CR5, CR6; and transistor Q10. Pre-amp 1117 applies the boosted driver output signal to JFET Q6 which is under the control of pickup selector logic 1115. The driver output signal is coupled through current limiting resistor R46 and DC blocking capacitor C23 to the base of transistor Q10. Resistor R45 provides bias current to transistor Q10. Capacitor C22 attenuates radio frequency signals received by driver 102 thereby decreasing radio frequency interference. Emitter resistor R43 sets the collector current through transistor Q10 to about 0.3 mA. Collector resistors R40,R41 set the collector-emitter voltage for transistor Q10 at about 1.2 volts. Gain resistor R42 and DC blocking capacitor C25 set the gain of transistor Q10 at about 31 dB. Resistor R44 and capacitor C24 boost signals higher than 3500 Hz by at least an additional 3 dB. The amplified driver output signal is coupled by DC blocking capacitor C21 to resistor R39 for shifting the DC level of the driver output signal to floating ground V1. Resistor R38 increases the output impedance of pre-amp 1117 to 22K ohms for combining the driver output signal with the other pickup signals at pickup combiner 1104. JFET Q6 provides pickup selector logic 1115 with a means to control the driver output signal.

When flip-flop 1113 is "on", the driver output signal (which is generally less than 3 mV peak-to-peak) is not easily detected because it is mixed with the drive voltage which is about 8 volts peak-to-peak. Instead of providing costly circuitry to recover the driver output signal, the driver output signal is not utilized when the drive signal is applied. Since there is no switch provided between driver 102 and low noise pre-amp 1117, the drive signal is applied to the base of transistor Q10. Thus, current limiting resistor R46 is provided to limit the current injected into the base of transistor Q10. Transistor Q10 conveys the drive signal to JFET Q6 where diodes CR5,CR6 limit the peak-to-peak amplitude of the drive signal to about 1.1 volts for enabling JFET Q6 to substantially prevent the drive signal from being conveyed to output jack 116. Resistor R41 also helps prevent the conveyance of the drive signal by limiting the peak-to-peak amplitude of the drive signal.

Figure 12A:
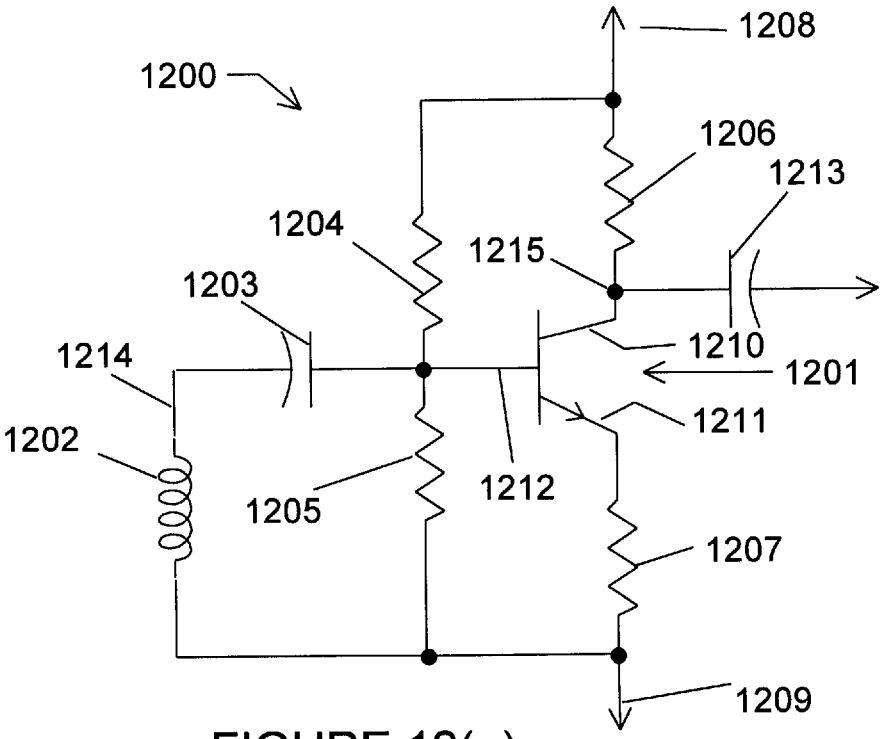
FIG. 12(*a*) shows, in schematic format, common-emitter low noise discrete preamplifier 1200 of the preferred embodiment of the invention.
Figure 12B:
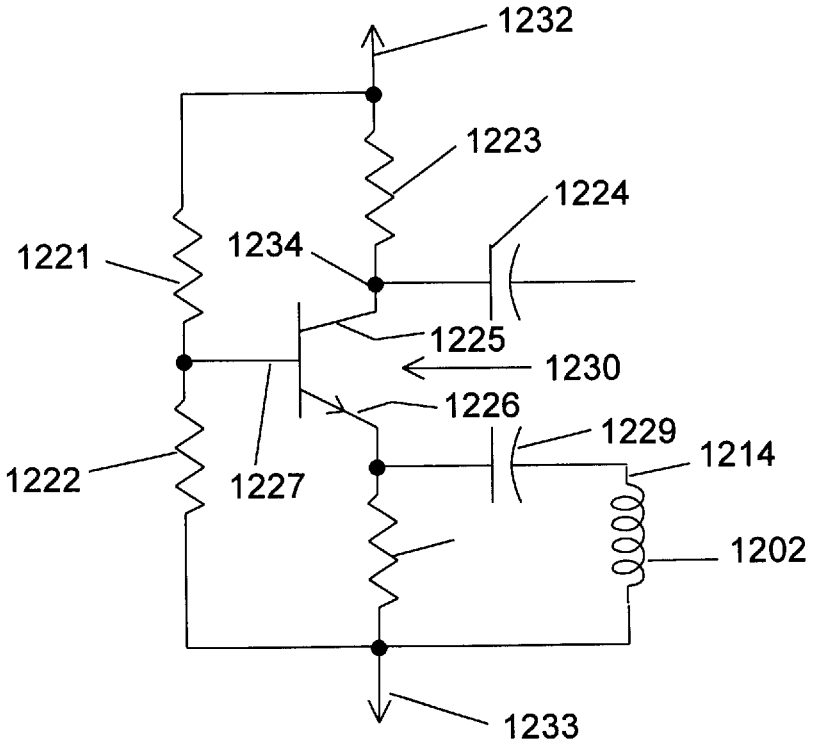

FIGS. 12(*a*) and 12(*b*) show, in schematic format, two embodiments of low noise discrete preamplifiers 1200,1220 of the present invention. Low noise discrete preamplifiers 1200,1220 provide low noise because driver output signal 1214 passes through one amplifying valve, a transistor. In general, preamplifier noise is attributed to thermal noise provided by resistors and amplifying valves. To decrease such noise, the preamplifiers in FIG. 12 provide high gain with few noise providing components. The preamplifiers of FIG. 12 provide high gain because transistors having current gains in excess of 40 dB are readily available.

FIG. 12(*a*) shows, in schematic format, common-emitter low noise discrete preamplifier 1200 of the preferred embodiment of the invention. Transistor 1201 has base terminal 1212, collector terminal 1210, and emitter terminal 1211 for providing electrical connections to transistor 1201. Resistors 1204,1205 are provided for supplying bias current to base 1212. Capacitor 1203 applies driver output signal 1214 from driver 1202 to base 1212. Emitter resistor 1207 provides means for conducting current from emitter 1211 of transistor 1201 to power supply ground 1209. Collector resistor 1206 provides means for conducting current from power supply 1208 to collector 1210 of transistor 1201. Capacitor 1213 provides means for conveying amplitude boosted driver output signal 1215 from collector 1210 of transistor 1201 to subsequent circuitry (not shown). Output signal 1215 is out-of-phase relative to signal 1214.

FIG. 12(*b*) shows, in schematic format, common-base low noise discrete preamplifier 1220 in an alternate embodiment of the invention. Transistor 1230 has base terminal 1227, collector terminal 1225, and emitter terminal 1226 for providing electrical connections to transistor 1230. Resistors 1221,1222 are provided for supplying bias current to base 1227. Capacitor 1229 applies driver output signal 1214 from driver 1202 to emitter 1226. Emitter resistor 1228 provides means for conducting current from emitter 1226 of transistor 1230 to power supply ground 1233. Collector resistor 1223 provides means for conducting current from power supply 1232 to collector 1225 of transistor 1230. Capacitor 1224 provides means for conveying amplitude boosted driver output signal 1234 from collector 1225 of transistor 1230 to subsequent circuitry (not shown). Output signal 1234 is not in-phase relative to signal 1214.

The above preamplifiers can be realized with amplifying valves other than bi-polar transistors 1201,1230. For example a field-effect transistor can be substituted in place of transistor 1201 of FIG. 12(*a*). The gate of the field-effect transistor is connected into the circuit where base 1212 is now connected. The drain of the field-effect transistor is connected into the circuit where collector 1210 is now connected. The source of the field-effect transistor is connected into the circuit where emitter 1211 is now connected. The same devices useful as analog switches described above can be used in the preamplifier circuits of FIG. 12.

Figure 13:
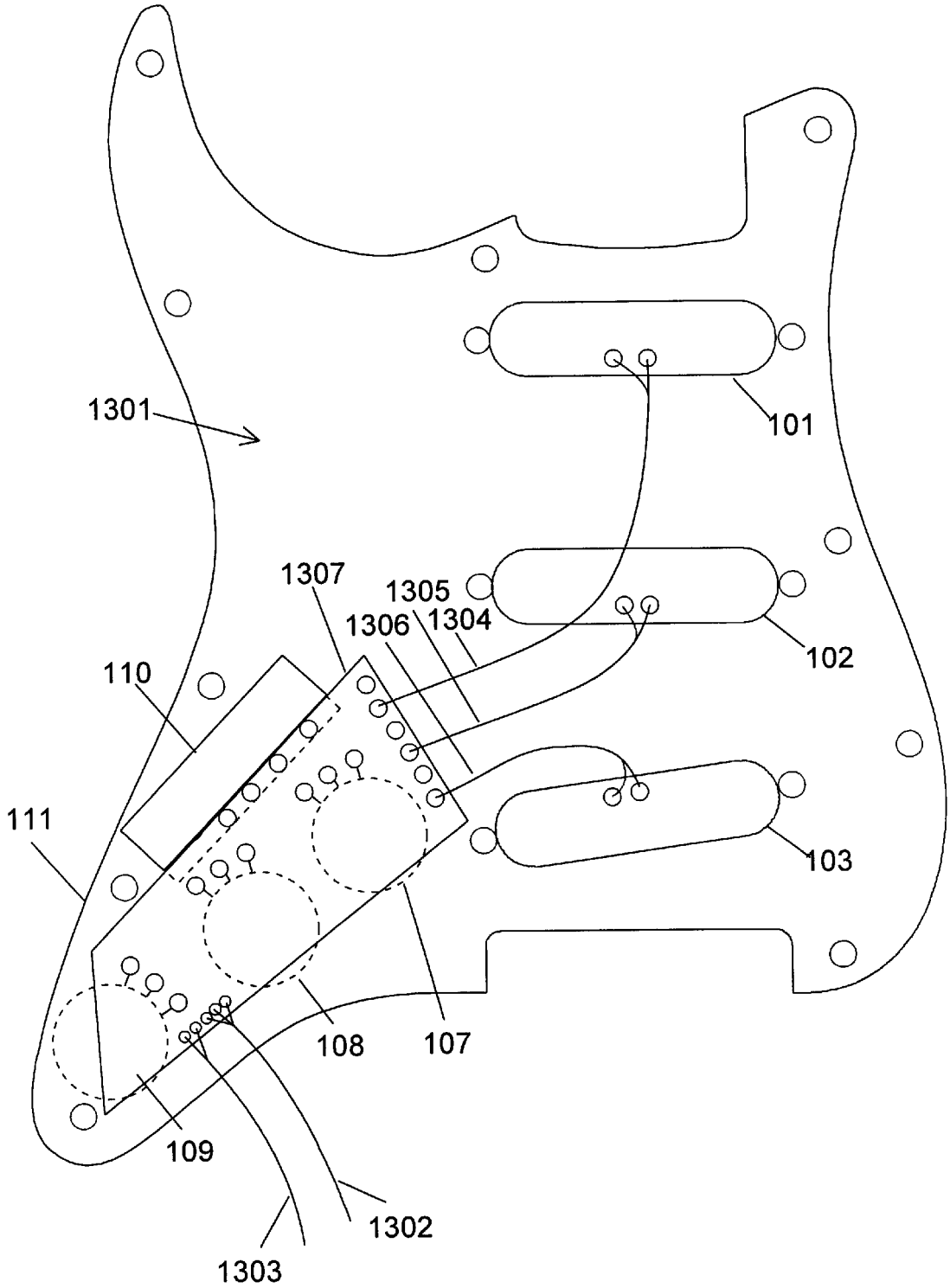
FIG. 13 shows, in plan view, sustainer assembly 1300 in the preferred embodiment of the invention comprising back-side 1301 of pickup guard 111 in combination with neck pickup 101, driver 102, bridge pickup 103, controls 107 to 109, pickup selector switch 110, wiring harnesses 1302 to 1306, and circuit board 1307.

To facilitate the assembly of the sustainer, the sustainer components are affixed to pick guard 111. FIG. 13 shows, in plan view, sustainer assembly 1300 in the preferred embodiment of the invention comprising backside 1301 of pick guard 111 in combination with neck pickup 101, driver 102, bridge pickup 103, controls 107 to 109, pickup selector switch 110, wiring harnesses 1302 to 1306, and circuit board 1307. The circuit in FIG. 11 is embodied as circuit board 1307. Wiring harnesses 1304 to 1306 connect neck pickup 101, driver 102, and bridge pickup 103 to circuit board 1307 respectively. Wiring harness 1302 connects output jack 116 (not shown) to circuit board 1307. Wiring harness 1303 connects battery 700 (not shown) to circuit board 1307. Controls 107 to 109 and switch 110 are attached to circuit board 1307 and pickup guard 111. Such provides support for circuit board 1307. Sustainer assembly 1300 comprises the components shown in FIG. 13.

An interesting aspect of the sustainer is driver 102 and its associated lateral unbalancing means 200, 201. Referring to FIG. 1(*a*) and FIG. 2, driver 102 is one embodiment in a class of drivers referred to as lateral drivers. A lateral driver of the invention emits a lateral magnetic field into a plurality of strings. A lateral magnetic field comprises lines of magnetic flux flowing in generally a lateral direction, transverse to the lengthwise direction of the strings. Magnetic shunt plates 200,201 unbalance the lateral magnetic field provided by flux emitters 206A,206B. Driver 102 of FIG. 1(*a*) is referred to as a bilateral driver because the lateral magnetic field is provided by two magnetic cores disposed end-to-end, laterally across strings 104.

Figure 14A:
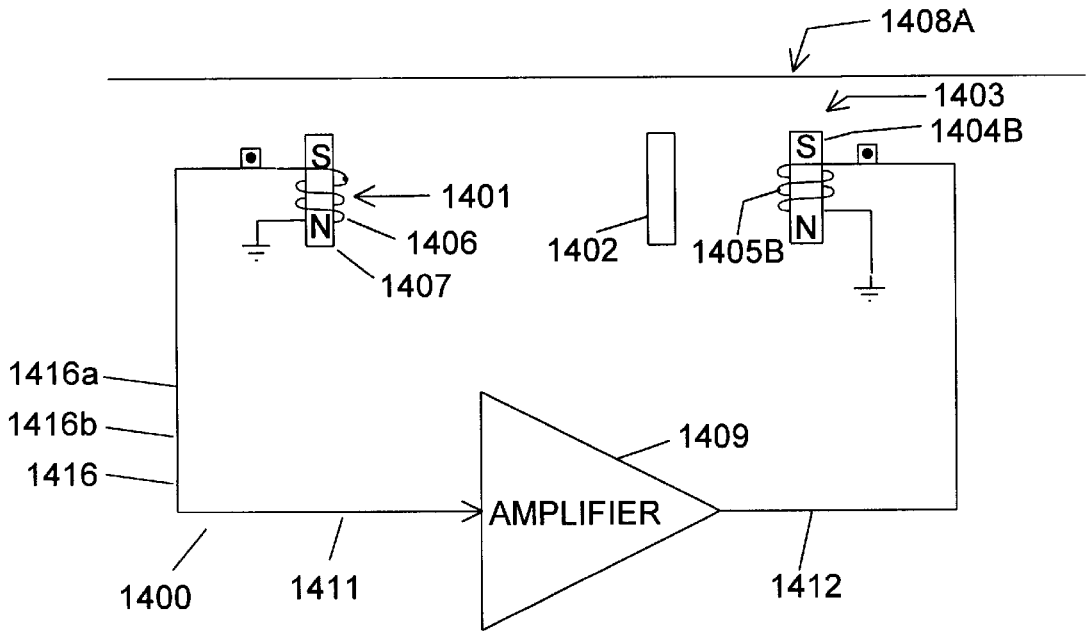
FIG. 14(*a*) shows, in schematic format, the side view of bi-lateral driver 1403 in sustainer 1400 of the preferred embodiment of the invention.
Figure 14B:
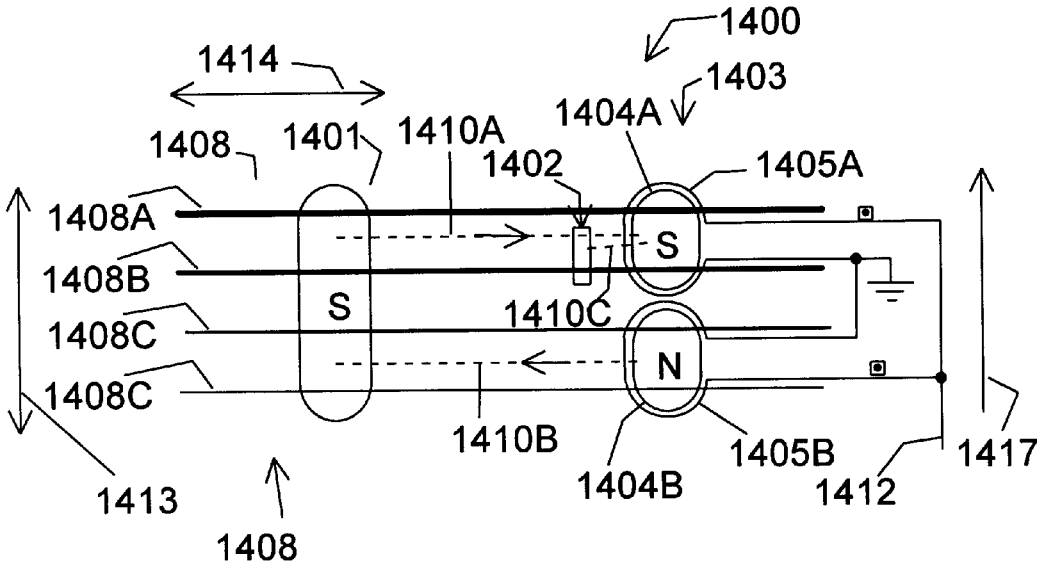
Figure 14C:
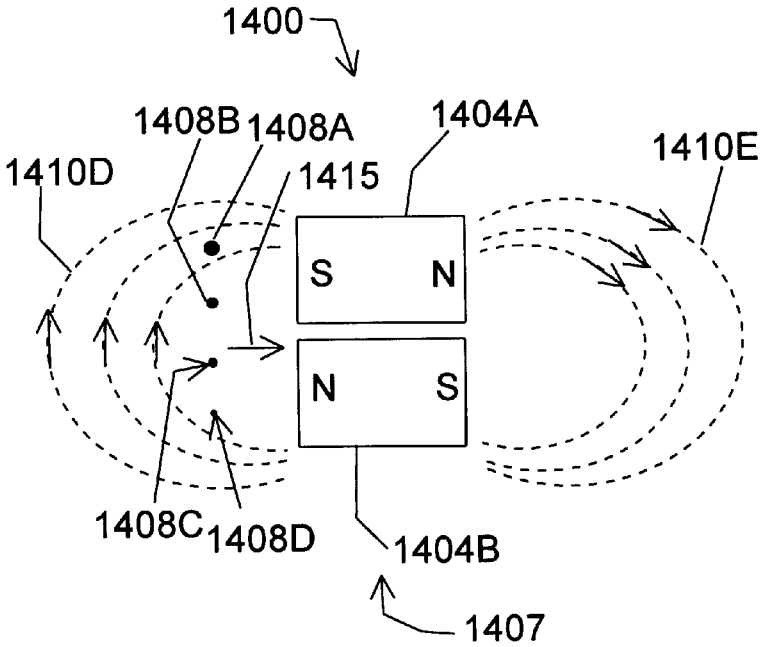

FIG. 14(*a*) shows, in schematic format, the side view of bi-lateral driver 1403 in sustainer 1400 of the preferred embodiment of the invention. FIG. 14(*b*) shows, in schematic format, the top view of bilateral driver 1403 in sustainer 1400 of the preferred embodiment of the invention. FIG. 14(*c*) shows, in schematic format, the end view of bilateral driver 1403 in sustainer 1400 of the preferred embodiment of the invention. Strings 1408A to 1408D are disposed extended in generally the same longitudinal direction. Strings 1408A to 1408D are disposed side-by-side for generally defining an array of strings 1408 having widthwise lateral direction 1413 transverse to longitudinal direction 1414. The diameter of string 1408A is greater than the diameter of string 1408B. The diameter of string 1408B is greater than the diameter of string 1408C and so on. String 1408D has the smallest diameter.

Pickup 1401 comprises magnetic core 1407 wrapped with coil 1406. Pickup 1401 provides feedback signal 1411 in response to vibration of strings 1408. Feedback signal 1411 is applied to the input of amplifier 1409 for providing driver signal 1412 to driver 1403. Driver 1403 provides a drive force to strings 1408 for sustaining the vibration of strings 1408.

Bi-lateral driver 1403 comprises magnetic cores 1404A and 1404B wrapped with coils 1405A and 1404B respectively. Cores 1404A,1404B are disposed end-to-end across strings 1408. FIG. 14(*c*) shows the lateral magnetic field 1410D that impinges on strings 1408 thereby providing the drive force to strings 1408. Magnetic field 1410D flows in lateral direction 1417 away from core 1404B towards core 1404A. A phase of feedback signal 1412 that increases the intensity of lateral magnetic field 1410D provides a corresponding increase in the drive force designated by arrow 1415 of FIG. 14(*c*). A phase of feedback signal 1412 that decreases the intensity of lateral magnetic field 141 OD provides a corresponding decrease in the drive force designated by arrow 1415 of FIG. 14(*c*). Driver 1403 also provides an unused lateral magnetic field 1410E.

In addition to the lateral magnetic field, driver 1403 also emits "leakage" magnetic flux that impinges on pickup 1401. The leakage flux is direct magnetic feedback 1410A emitted from core 1404A and direct magnetic feedback 1410B emitted from core 1404B. Feedback 1410A and feedback 1410B are those portions of the magnetic field emitted from driver 1403 that impinge on pickup 1401. Ideally, feedback 1410A and 1410B, being of opposite polarity, will substantially cancel each other by inducing equal but opposite polarity noise voltages 1416A, 1416B in pickup 1401. However, this does not generally happen because strings 1408 provide unequal direct magnetic paths for feedback 1410A and 1410B due to the unequal diameters of strings 1408.

Strings 1408A and 1408B provide a lower reluctance magnetic path for feedback 1410A because they have larger diameter. Strings 1408D and 1408E provide a higher reluctance path for feedback 1410B because they have smaller diameter. Such unequal paths cause the intensity of feedback 1410A to be greater than feedback 1410B at pickup 1401. Therefore, to compensate for the unequal string diameters, a lateral unbalancing means is provided to create a magnetic imbalance.

As shown in FIG. 14(*b*), magnetic shunt 1402 is positioned closer to core 1404A for shunting a portion 1410C of feedback 1410A away from pickup 1401. The shunted portion 1410C would otherwise be conveyed to pickup 1401. Thus, shunt 1402 lessens the intensity of feedback 1410A. Shunt 1402 also lessens the intensity of feedback 1410B but the effect is minimal because shunt 1402 is closer to core 1404A. Therefore, shunt 1402 enables noise voltage 1416A induced by feedback 1410A to substantially cancel noise voltage 1416B induced by feedback 1410A.

Moving shunt 1402 in lateral direction 1413 provides a wide adjustment range. When shunt 1402 is positioned equidistant from cores 1404A and 1404B, the shunting effect provided to cores 1404A and 1404B is equal. Such provides no magnetic unbalance to lateral magnetic field 1410D. When shunt 1402 is positioned closer to core 1404A, feedback 1410A is lesser than feedback 1410B. When shunt 1402 is positioned closer to core 1404B, feedback 1410B lesser than feedback 1410A. Thus, a wide adjustment range is provided.

Movement of shunt 1402 in lateral direction 1413 provides a means to change the phase of noise signal 1416. Noise signal 1416 is the combination of noise signals 1416A and 1416B. Noise signal 1416A is produced by feedback 1410A. Due to the direction of winding of coil 1405A, noise 1416A is out-of-phase with drive signal 1412. Noise signal 1416B is produced by feedback 1410B. Due to the direction of winding of coil 1405B, noise signal 1416B is in-phase with drive signal 1412. When shunt 1402 is positioned closer to core 1404A, noise signal 1416 is in-phase with drive signal 1412 because noise signal 1416B has greater amplitude than noise signal 1416A. When shunt 1402 is positioned closer to core 1404B, noise signal 1416 is out-of-phase with drive signal 1412 because noise signal 1416A has greater amplitude than noise signal 1416B. When shunt 1402 is positioned to substantially eliminate direct magnetic feedback 1410A and 1410B, noise signal 1416 is insubstantial and its phase is indeterminate. Thus, the sustainer provides means to adjust the phase and amplitude of noise signal 1416.

The means to adjust the phase and amplitude of noise signal 1416 is utilized in the preferred embodiment. Positional misalignments of shunt 201 (in FIG. 1(*a*)) provide means for adjusting the amplitude and phase of the noise signal. This enables the sustainer to emphasize harmonic string vibrations by recycling the noise signal through the pickup, amplifier, and driver. Thus, the sustainer provides driver means for emitting a lateral magnetic field for applying a drive force to the strings. Lateral unbalancing means are provided for unbalancing the lateral magnetic field to substantially eliminate direct magnetic feedback. Means responsive to the imbalance of the lateral magnetic field are provided for emphasizing harmonic string vibration.

Figures 15A, 15B:
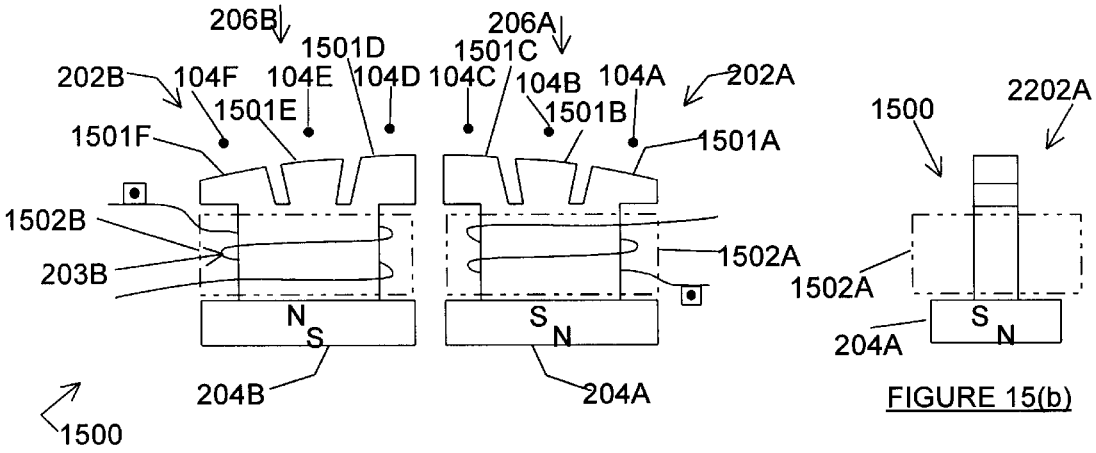
FIG. 15(*a*) shows, in front view, an alternate embodiment of lateral driver 1500.
Figures 16A, 16B, 16C:
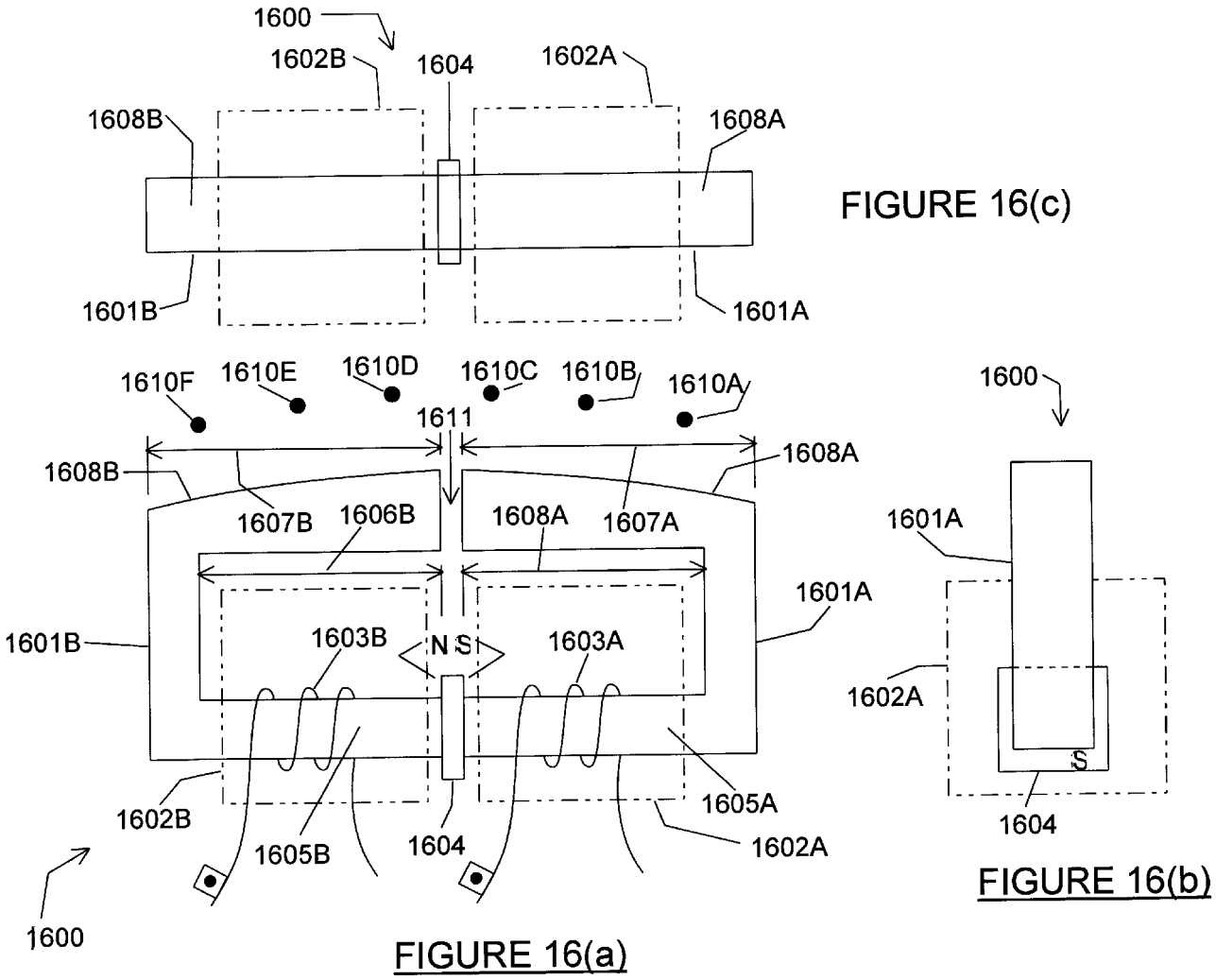
FIG. 16(*a*) shows, in front view, an alternate embodiment of lateral driver 1600.
Figures 17A, 17B, 17C:
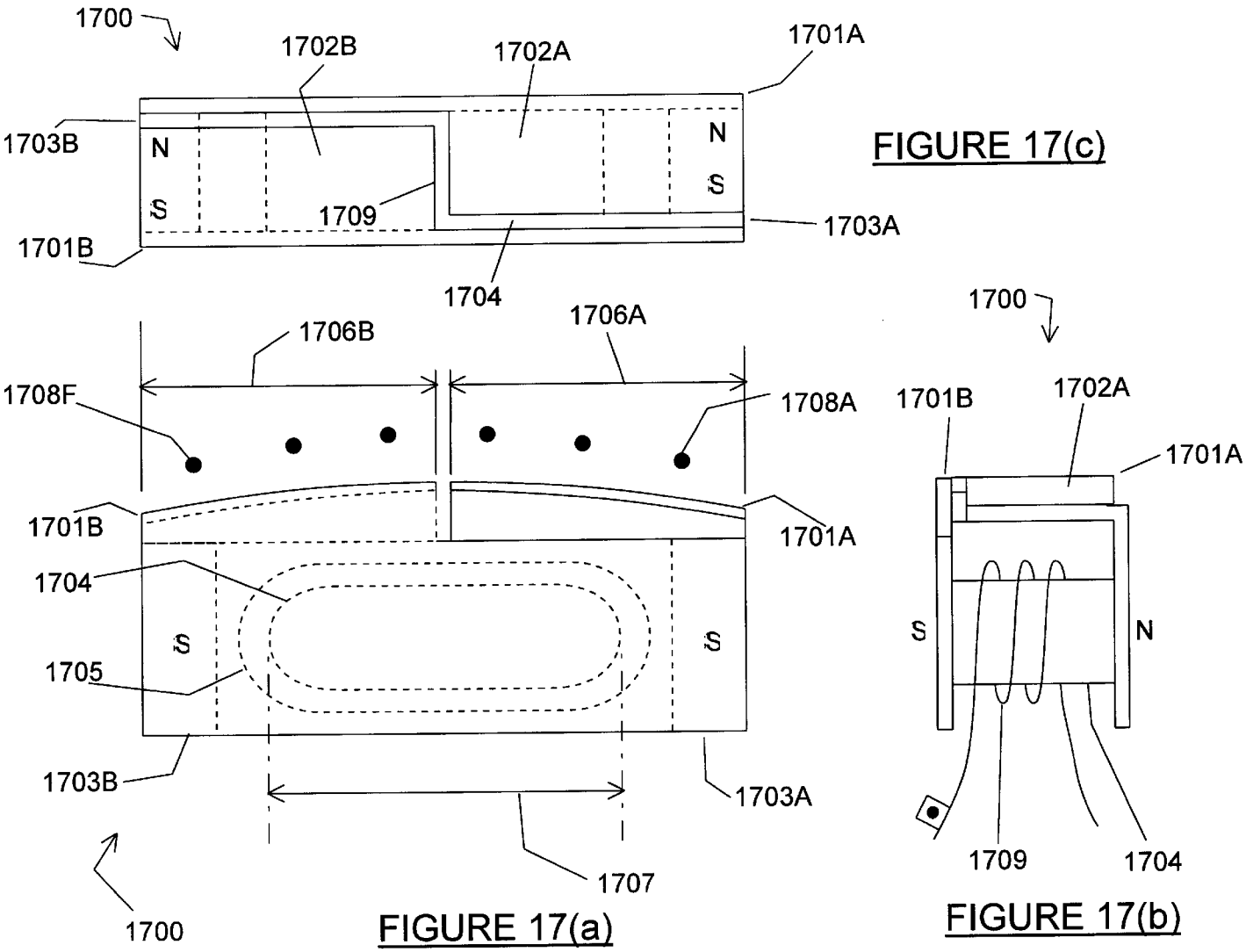
FIG. 17(*a*) shows, in front view, an alternate embodiment of lateral driver 1700.
Figures 18A, 18B, 18C:
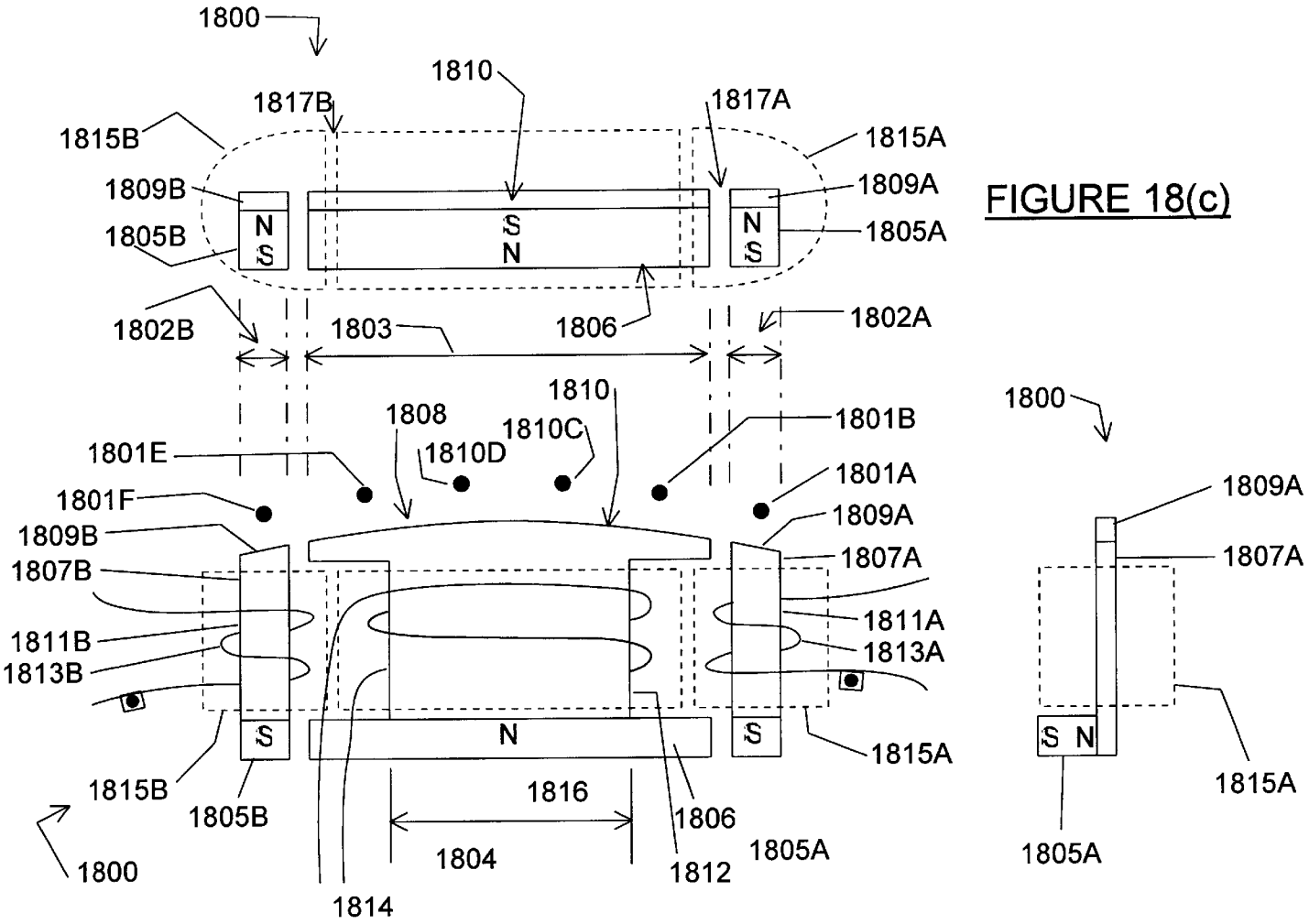
FIG. 18(*a*) shows, in front view, an alternate embodiment of lateral driver 1800.

Other embodiments of lateral drivers are provided in FIGS. 15, 16, 17, and 18. Each driver has unique advantages and disadvantages. One of the aspects of the driver shown in figures 16 and 17 is that they provide magnetic core means for redirecting magnetic flux from the coil base means to the emitter means for providing a lateral magnetic field. Another aspect of the drivers shown in FIGS. 15,16, and 18 is that the lateral width of at least one of the emitter means is substantially unequal to the lateral width of at least one of the coil base means for narrowing at least one of the gaps between adjacent emitter means.

FIG. 15(*a*) shows, in front view, an alternate embodiment of lateral driver 1500. FIG. 15(*b*) shows, in side view, an alternate embodiment of lateral driver 1500. Driver 1500 is substantially similar to driver 102 (FIG. 2) with the following exceptions; (i) coil bases 207A,207B provide the function of the flux collectors by collecting flux from magnets 204A,204B; (ii) flux emitter 206A comprises prongs 1501A, 1501B,1501C; (iii) flux emitter 206B comprises prongs 1501D,1501E,1501F.

The lateral width of emitter 206A (of driver 1500) is the same as the lateral width of emitter 206A (of driver 102). The lateral width of emitter 206B (of driver 1500) is the same as the lateral width of emitter 206B (of driver 102). The lateral width of coil base 207A (of driver 1500) is the same as the lateral width of coil base 207A (of driver 102). The lateral width of coil base 207B (of driver 1500) is the same as the lateral width of coil base 207B (of driver 102).

The advantage with driver 1500 is that the lateral widths of prongs 1501A–1501F can be changed for providing unequal drive forces to strings 104A–104F.

FIG. 16(*a*) shows, in front view, an alternate embodiment of lateral driver 1600. FIG. 16(*b*) shows, in side view, an alternate embodiment of lateral driver 1600. FIG. 16(*c*) shows, in top view, an alternate embodiment of lateral driver 1600. Driver 1600 applies a drive force to stings 1610A–1610F. Driver 1600 comprises the following components; (i) magnetic cores 1601A,1601B; (ii) coils 1603A, 1603B wound around coil bases 1605A,1605B having lateral widths 1606A,1606B respectively; (iii) flux emitters 1608A,1608B having lateral widths 1607A,1607B respectively; and (iv) magnet 1604. Outlines 1602A,1602B indicate the available space for coils 1603A,1603B respectively.

The advantage with driver 1600 is that it provides relatively large spaces 1602A,1602B for coils 1603A,1603B. Therefore, large diameter wire can be used to provide coils 1603A,1603B with low resistance therefor improving the efficiency of the switching amplifier. The switching amplifier provides such high efficiency that the resistance of the driver coils is generally the greatest cause of energy loss.

A first aspect of driver 1600 is that the lateral width of flux emitter 1607A is greater than the lateral width of coil base 1605A and, the lateral width of flux emitter 1607B is greater than the lateral width of coil base 1605B. This provides a narrow gap 1611.

Another aspect of driver 1600 is that cores 1601A,1601B redirect the magnetic flux from coil bases 1605A,1605B into a lateral magnetic field. Coils 1603A,1603B are generally cylindrically shaped for providing flux to coil bases 1605A, 1605B that flows generally in a lateral direction transverse to the lengthwise direction of strings 1610A–1610F. Core 1601A changes the direction of the coil base flux by redirecting it to emitter 1608B. Core 1601B changes the direction of the coil base flux by redirecting it to emitter 1608B.

FIG. 17(*a*) shows, in front view, an alternate embodiment of lateral driver 1700. FIG. 17(*b*) shows, in side view, an alternate embodiment of lateral driver 1700. FIG. 17(*c*) shows, in top view, an alternate embodiment of lateral driver 1700 having magnets 1703A, 1703B removed. Driver 1700 applies a drive force to stings 1708A through 1708F. Driver 1700 comprises the following components; (i) magnetic cores 1701A,1701B; (ii) coil 1709 wound around coil base 1704 having lateral width 1707; (iii) flux emitters 1702A, 1702B having lateral widths 1706A,1706B respectively; and (iv) magnets 1703A,1703B. Outline 1705 indicates the available area for coil 1709. The advantage with driver 1700 is its simple, low cost design. Only one coil is utilized.

A first aspect of driver 1700 is that the lateral width 1707 of coil base 1704 is greater than the lateral widths 1706A, 1706B of flux emitters 1702A,1702B.

Another aspect of driver 1700 is that cores 1701A,1701B redirect the magnetic flux from coil base 1704 into a lateral magnetic field. Coil 1709 is generally cylindrically shaped for providing flux to coil base 1704 that flows generally in a lengthwise direction parallel to the lengthwise direction of strings 1608A–1608F. Core 1701A changes the direction of the coil base flux by redirecting it to emitter 1702AB. Core 1701B changes the direction of the coil base flux by redirecting it to emitter 1702AB.

Thus the invention provides a driver means including, a flux emitter means for emitting a generally laterally flowing magnetic flux into the strings to provide the drive force. A coil base means has a conductor wrapped around the coil base means in a coiling configuration for providing a magnetic flux flowing in a predetermined direction. Additionally, a redirecter means is provided for redirecting magnetic flux from the coil base means to the emitter means to provide the generally laterally flowing magnetic flux.

FIG. 18(*a*) shows, in front view, an alternate embodiment of lateral driver 1800. FIG. 18(*b*) shows, in side view, an alternate embodiment of lateral driver 1800. FIG. 18(*c*) shows, in top view, an alternate embodiment of lateral driver 1800. Driver 1800 applies a drive force to stings 1801A through 1801F. Driver 1800 comprises the following components; (i) magnetic cores 1807A, 1807B, 1808; (ii) coils 1813A, 1813B, 1814 wound around coil bases 1811A, 1811B, 1812 having lateral widths 1802A, 1802B, 1803 respectively; (iii) flux emitters 1809A,1809B,1810 having lateral widths 1802A, 1802B, 1804 respectively; and (iv) magnets 1805A, 1805B, 1806. Outlines 1815A, 1815B, 1816 indicate the available area for coils 1813A, 1813B, 1814 respectively.

The advantage with driver 1800 is that greater drive current can be applied to coils 1813A, 1813B for increasing the drive force to strings 1801A, 1801F. Typically, these strings benefit from greater drive force than strings 1801B through 1801E. Two laterally adjustable shunt plates can be used on one face of driver 1800 because it has two gaps 1817A, 1817B. One plate would unbalance the lateral magnetic field between emitters 1809A and 1810. The other plate would unbalance the lateral magnetic field between emitters 1810 and 1809B.

A first aspect of driver 1800 is that the lateral width 1803 of flux emitter 1810 is greater than the lateral widths of at least one of coil bases 1811A,1811B,1812. The lateral widths 1802A, 1802B of flux emitters 1809A, 1809B are lesser than the lateral widths of at least one of coil bases 1811A,1811B,1812.

Thus, the invention provides a driver means including a coil base means comprising a magnetic core means having a predetermined lateral width, a conductor means wrapped around the core means in a coiling configuration for providing magnetic flux and a plurality of magnetic flux emitter means. The magnetic flux emitter means are disposed generally in an end-to-end relation to form a generally laterally extending array positioned adjacent to the laterally extending array of strings. At least one of the magnetic flux emitter means has a lateral width substantially unequal to the lateral width of the coil base means. Adjusting the size of the flux emitter means can narrow a gap between a pair of adjacent magnetic flux emitter means.

As these and other variances and combinations of the features discussed above may be utilized without departing from the invention, the foregoing descriptions of the preferred embodiments should be taken by way of illustration rather than by way of limitation of the invention as defined by the claims.

What is claimed is:

1. A sustainer for a musical instrument having at least one vibratory element, said sustainer comprising:

(a) a means for providing a drive signal;

(b) a driver means having a plurality of flux emitter means disposed in an end-to-end relation for emitting a magnetic field to apply drive forces to said vibratory element in response to said drive signal, and;

(c) a gap narrowing means for narrowing a gap between at least two of said flux emitter means.

2. The sustainer of claim 1 wherein said gap narrowing means comprises at least one of said flux emitter means having a portion overhanging a coil base means in the direction of said gap to narrow said gap.

3. The sustainer of claim 1 wherein at least one of said flux emitter means includes a plurality of prong means disposed between a coil base means and said vibratory element.

4. A sustainer for a musical instrument having a body and a neck means extending away from said body for supporting a first end of at least one vibratory element, said body having a bridge means for supporting a second end of said vibratory element, said sustainer comprising:

(a) a neck pickup means disposed adjacent to said neck means for providing a neck pickup signal responsive to vibration of said vibratory element;

(b) a bridge pickup means disposed adjacent to said bridge means for providing a bridge pickup signal responsive to vibration of said vibratory element;

(c) an amplifier means for providing a drive signal responsive to at least one of said neck pickup signal and said bridge pickup signal;

(d) a driver means disposed between said body and said vibratory element between said neck pickup means and said bridge pickup means for emitting a magnetic field to apply drive forces to said vibratory element;

(e) said neck means includes a nut means for supporting said first end of said vibratory element;

(f) said bridge means includes at least one saddle means for supporting said second end of said vibratory element;

(g) an arrangement of said neck pickup means, said bridge pickup means, and said driver means for providing space between said neck pickup means and said driver means, and space between said bridge pickup means and said driver means, said arrangement comprising:

(1) a scale length dimension (S) being a linear distance measurable between said nut means and said saddle means, a dimension (N) being a linear distance measurable between said nut means and the center of said neck pickup means, a dimension (M) being a linear distance measurable between said nut means and the center of said driver means and, a dimension (B) being a linear distance measurable between said nut means and the center of said bridge pickup means;

(2) said dimension (N) being within a range of 76 percent of the dimension (S) plus or minus 10 percent of the dimension (S);

(3) said dimension (M) being within a range of 85 percent of the dimension (S) plus or minus 10 percent of the dimension (S), and;

(4) said dimension (B) being within a range of 94 percent of the dimension (S) plus or minus 10 percent of the dimension (S).

5. The sustainer of claim 4 wherein said driver means includes:

(a) a plurality of flux emitter means disposed in an end-to-end relation across said vibratory element for emitting said magnetic field, and;

(b) a gap narrowing means for narrowing a gap between at least two of said flux emitter means.

6. A sustainer for a musical instrument having at least one vibratory element supported by a structure, said sustainer comprising:

(a) an amplifier means for providing a drive signal;

(b) a driver means responsive to said drive signal for applying drive forces to said vibratory element;

(c) a battery means disposed inside a cavity in said structure for providing power to said amplifier means;

(d) a cover means disposed across the opening to said cavity for restraining said battery means inside said cavity, and;

(e) a jack means in said cover means for conveying a signal between the inside and the outside of said cavity.

7. The sustainer of claim 6 further comprising (i) a means responsive to vibration of said vibratory element for providing said signal responsive to vibration of said vibratory element, and (ii) a means having a plug means mateable with said jack means for conveying said signal through said jack means to an external amplification means disposed externally to said structure.

8. The sustainer of claim 6 further comprising (i) an AC power supply means disposed externally to said structure means for providing said signal, and (ii) a means having a plug means mateable with said jack means for conveying said signal through said jack means to said amplifier means to provide power to said amplifier means.

9. A sustainer for a musical instrument having at least one vibratory element, said sustainer comprising:

(a) a drive-switch means for providing a square-wave drive signal to increase energy efficiency of said sustainer, and;

(b) a driver means responsive to said square-wave drive signal for providing a magnetic field to apply drive forces to said vibratory element.

10. The sustainer of claim 9 wherein said square-wave drive signal comprises at least;

(a) a rise-time period comprising a period of time for transitioning from a low output level to a high output level, and;

(b) a fall-time period comprising a period of time for transitioning from said high output level to said low output level, and;

(c) a means for decreasing at least one of said rise-time period and said fall-time period.

11. The sustainer of claim 10 further comprising a semi-conductor output device means operable in a switch mode of operation for decreasing at least one of said rise-time period and said fall-time period, wherein said switch mode of operation includes a semi-conductor saturation mode of operation and a semi-conductor cut-off mode of operation.

12. The sustainer of claim 10 further comprising a means cooperable with said drive-switch means for changing said square-wave drive signal between said low output level and said high output level in response to at least one of a feedback signal and a high frequency time base signal.

13. A sustainer for a musical instrument having at least one vibratory element and an amplifier means for providing a drive signal, said sustainer comprising:

(a) a driver means responsive to said drive signal for applying drive forces to said vibratory element, and;

(b) said amplifier means having a compensation means responsive to an impedance of said driver means for compensating said drive signal.

14. The sustainer of claim 13 further comprising:

(a) said amplifier means having a means for providing a drive current to said driver means, and;

(b) said compensation means having a current sensing means for providing a current sense signal responsive said drive current.

15. The sustainer of claim 13 wherein said compensation means includes a means for changing the amplitude of said drive signal in response to a change in the frequency of said drive signal.

16. A sustainer for a musical instrument having at least one vibratory element supported by a structure and a means for providing a drive signal, said sustainer comprising:

(a) a driver means responsive to said drive signal for applying drive forces to said vibratory element;

(b) a means cooperable with said driver means for providing a driver output signal responsive to vibrations of said vibratory element;

(c) a means for conveying said driver output signal to an external amplification means disposed externally to said structure;

(d) a pickup means for providing a substitution signal responsive to vibrations of said vibratory element;

(e) a sound modifier means operable on said substitution signal for changing harmonic content of said substitution signal to provide a modified substitution signal, and;

(f) a means for substituting said modified substitution signal for said driver output signal.

17. The sustainer of claim 16 wherein said sound modifier means comprises (i) a pickup means for providing a pickup signal in response to vibration of said vibratory element, and (ii) a means for combining said pickup signal with said substitution signal.

18. The sustainer of claim 16 wherein said sound modifier means includes a filter.

19. A sustainer for a musical instrument having a plurality of strings disposed in a side-by-side arrangement to define a laterally extending array, said sustainer comprising:

(a) a pickup means;

(b) a means for providing a drive signal;

(c) a driver means responsive to said drive signal for emitting a driver magnetic field to apply drive forces to said strings;

(d) a means for providing a lateral magnetic field, and;

(e) a lateral unbalancing means cooperable with said lateral magnetic field for providing a magnetic imbalance between said driver means and said pickup means to decrease a direct magnetic feedback between said driver means and said pickup means.

20. The sustainer of claim 19 wherein said lateral unbalancing means includes:

(a) a magnetic shunt means for shunting a portion of said lateral magnetic field, said magnetic shunt means being moveable from a first position to a second position, and;

(b) a means for retaining said magnetic shunt means in at least one of said first position and said second position.

21. The sustainer of claim 20 wherein said magnetic shunt means is between said pickup means and said driver means.

22. A sustainer for a musical instrument having at least one vibratory element and a pickup means for providing a feedback signal responsive to said vibratory element, said sustainer comprising:

(a) an amplifier means for providing a drive signal;

(b) a driver means responsive to said drive signal for emitting a driver magnetic field to apply drive forces to said vibratory element;

(c) an adjustable unbalancing means changeable from a first condition to a second condition for changing a magnetic imbalance between said pickup means and said driver means to change the phase and the amplitude of a noise signal induced in said feedback signal by a direct magnetic feedback between said driver means and said pickup means, and;

(d) a misalignments means for misaligning said adjustable unbalancing means to recycle said noise signal through said pickup means, said amplifier means, and said driver means to emphasize harmonic vibration of said vibratory element.

23. The sustainer of claim 22 further comprising a means for recycling said noise signal through said pickup means and said amplifier means and said driver means for emphasizing harmonic vibration of said vibratory element.

24. The sustainer of claim 22 wherein said adjustable unbalancing means includes:

(a) a magnetic shunt means for shunting a portion of said driver magnetic field, said magnetic shunt means being moveable from a first position to a second position;

(b) a means for retaining said magnetic shunt means in at least one of said first position and said second position, and;

(c) said misalignment means includes a means for moving said magnetic shunt means.

25. A sustainer for a musical instrument having a structure for supporting at least one vibratory element, said sustainer comprising:

(a) a rigid sheet of material positionable between said structure and said vibratory element, the sheet having means for supporting:

(1) a first pickup means for providing a first feedback signal;

(2) an amplifier means responsive to said first feedback signal for providing a drive signal, and;

(3) a driver means for applying drive forces to said vibratory element in response to said drive signal;

(b) a means for conveying said first feedback signal to said amplifier means, and;

(c) a means for conveying said drive signal between said amplifier means and said driver means.

26. The sustainer of claim 25 further comprising:

(a) said first pickup means includes a neck pickup means for providing a signal responsive to vibrations of said vibratory element;

(b) a bridge pickup means for providing a signal responsive to vibrations of said vibratory element;

(c) said neck pickup means being disposed next to a neck means;

(d) said bridge pickup means being disposed next to a bridge means, and;

(e) an arrangement of said neck pickup means, said driver means, and said bridge pickup means wherein said driver means is disposed between said neck pickup means and said bridge pickup means.

27. A sustainer for a musical instrument having at least one vibratory element and a pickup means for providing a feedback signal, said sustainer comprising:

(a) a comparator means for comparing said feedback signal to a threshold signal to provide a control signal;

(b) a drive-switch means responsive to said control signal for providing a square-wave drive signal comprising at least a transition from one predetermined level to another predetermined level, and;

(c) a driver means responsive to said square-wave drive signal for providing a magnetic field to apply drive forces to said vibratory element.

28. The sustainer of claim 27 wherein said threshold signal comprises at least one of a DC reference signal and a high-frequency time-base signal.

29. A sustainer for a musical instrument having at least one vibratory element and a driver means responsive to a drive signal for applying drive forces to said vibratory element, said sustainer comprising:

(a) a means for providing a first control signal transition at a predetermined time;

(b) a means for providing a second control signal transition after said first control signal transition, and;

(c) a means responsive to said second control signal transition for applying said drive signal to said driver means.

30. The sustainer of claim 29 further comprising:

(a) a means cooperable with said driver means for providing a driver output signal responsive to vibration of said vibratory element;

(b) a means for providing a substitution signal responsive to vibration of said vibratory element, and;

(c) a means responsive to said first control signal transition for substituting said substitution signal for said driver output signal.

31. A sustainer for a musical instrument having at least one vibratory element and a means for providing a drive signal, said sustainer comprising:

(a) a driver means responsive to said drive signal for providing a drive force to said vibratory element;

(b) a means for providing a first control signal transition at a predetermined time;

(c) a means for providing a second control signal transition after said first control signal transition, and;

(d) a means responsive to said first control signal transition for removing said drive signal from said driver means.

32. The sustainer of claim 31 further comprising:

(a) a means cooperable with said driver means for providing a driver output signal responsive to vibration of said vibratory element;

(b) a means for providing a substitution signal responsive to vibration of said vibratory element, and;

(c) a means responsive to said second control signal transition for substituting said driver output signal for said substitution signal.

33. A sustainer for a musical instrument having at least one vibratory element and a means for providing a drive signal, said sustainer comprising:

(a) a driver means responsive to said drive signal for providing a drive force to said vibratory element;

(b) a means cooperable with said driver means for providing a driver output signal responsive to vibration of said vibratory element, and;

(c) a preamplifier means cooperable with said driver means for amplifying said driver output signal, said preamplifier means having an amplifying valve means including:

(1) an output terminal means for providing an modified driver output signal;

(2) a first input terminal means for providing a first electrical connection to said amplifying valve means, and;

(3) a second input terminal means for providing a second electrical connection to said amplifying valve means.

34. The sustainer of claim 33 further comprising at least one of:

(a) a means for applying said driver output signal to said first input terminal means to provide said modified output signal being out-of-phase relative to said driver output signal, and;

(b) a means for applying said driver output signal to said second input terminal means to provide said modified output signal being in-phase relative to said driver output signal.

35. The sustainer of claim 33 wherein said amplifying valve means comprises a device selected from the group consisting of bi-polar transistors and field-effect transistors and junction field-effect transistors and insulated-gate field-effect transistors and metal-oxide semiconductor field-effect transistors and semiconductor transistors.

36. A sustainer for a musical instrument having at least one vibratory element and a pickup means for providing a feedback signal, said sustainer comprising:

(a) a means for providing a drive signal;

(b) a driver means responsive to said drive signal for (i) applying drive forces to said vibratory element and, (ii) emitting direct electromagnetic radiation impinging on said pickup means, and;

(c) a feedback elimination means for processing and altering said direct electromagnetic radiation to decrease an effect of said direct electromagnetic radiation on said feedback signal.

37. The sustainer of claim 36 wherein said feedback elimination means comprises at least:

(a) a means for providing an error signal representative of said direct electromagnetic radiation, and;

(b) a means for combining said error signal with said feedback signal.

38. The sustainer of claim 36 wherein:

(a) said direct electromagnetic radiation comprises direct magnetic feedback and direct electrostatic feedback, and;

(b) said feedback elimination means comprises a means for processing and altering said direct magnetic feedback independently of said direct electrostatic feedback.

39. A sustainer for a musical instrument comprising a structure for supporting at least one vibratory element, said sustainer comprising:

(a) a first pickup means disposed between said structure and said vibratory element for emitting a first magnetic field to provide a feedback signal responsive to an intersection between said vibratory element and said first magnetic field;

(b) a means for providing a drive signal;

(c) a driver means disposed between said structure and said vibratory element for emitting a driver magnetic field to (i) provide a drive force to said vibratory element in response to said drive signal, and (ii) provide a shifting force to said first pickup magnetic field to shift the position of said intersection between said vibratory element and said first magnetic field, and;

(d) a shifting force minimizing means for decreasing said shifting force.

40. The sustainer of claim 39 further comprising:

(a) a neck pickup means disposed adjacent to said neck means for providing a neck pickup signal responsive to vibration of said vibratory element;

(b) a bridge pickup means disposed adjacent to said bridge means for providing a bridge pickup signal responsive to vibration of said vibratory element;

(c) a driver means disposed between said body and said vibratory element between said neck pickup means and said bridge pickup means for emitting a magnetic field to apply drive forces to said vibratory element;

(d) said neck means includes a nut means for supporting a first end of said vibratory element;

(e) said bridge means includes at least one saddle means for supporting a second end of said vibratory element;

(f) said shifting force minimizing means includes an arrangement of said neck pickup means, said bridge pickup means, and said driver means for providing space between said neck pickup means and said driver means, and space between said bridge pickup means and said driver means, said arrangement comprising:

(1) a scale length dimension (S) being a linear distance measurable between said nut means and said saddle means, a dimension (N) being a linear distance measurable between said nut means and the center of said neck pickup means, a dimension (M) being a linear distance measurable between said nut means and the center of said driver means and, a dimension (B) being a linear distance measurable between said nut means and the center of said bridge pickup means;

(2) said dimension (N) being within a range of 76 percent of the dimension (S) plus or minus 10 percent of the dimension (S);

(3) said dimension (M) being within a range of 85 percent of the dimension (S) plus or minus 10 percent of the dimension (S), and;

(4) said dimension (B) being within a range of 94 percent of the dimension (S) plus or minus 10 percent of the dimension (S).

41. The sustainer of claim 40 further comprising:

(a) said driver means has a plurality of flux emitter means disposed in an end-to-end relation for emitting said magnetic field, and;

(b) a gap narrowing means for narrowing a gap between at least two of said flux emitter means.

42. A sustainer for a musical instrument having at least one vibratory element and a means for providing a feedback signal, said sustainer comprising:

(a) a means responsive to said feedback signal for providing a drive current;

(b) a driver means responsive to said drive current for applying drive forces to said vibratory element;

(c) a current sensing means responsive to said drive current for providing a current-sense signal, and;

(d) a drive-current limiter means responsive to said current-sense signal for changing the amplitude of said feedback signal in response to a change in said drive current.

43. The sustainer of claim 42 further comprising:

(a) said drive-current limiter means having a means for providing an error signal responsive to said drive current exceeding a predetermined level, and;

(b) said drive-current limiter means having a means for changing said driver current in response to said error signal.

44. A sustainer for a musical instrument having a plurality of strings disposed in a side-by-side arrangement to define a laterally extending array, said sustainer comprising:

(a) an amplifier means for providing a drive signal;

(b) a driver means for applying drive forces to said strings in response to said drive signal, said driver means having:

(1) a first elongated coil means, and;

(2) a second elongated coil means disposed in an end-to-end relation across said strings with said first coil means.

45. The sustainer of claim 44 wherein said driver means includes:

(a) a first coil base means;

(b) a second coil base means;

(c) said first coil means includes a wire wound around said first coil base means, and;

(d) said second coil means includes a wire wound around said second coil base means.

46. The sustainer of claim 45 wherein said driver means includes:

(a) a first permanent magnet means for providing a magnetic flux to said first coil base means, and;

(b) a second permanent magnet means for providing a magnetic flux to said second coil base means.

47. A sustainer for a musical instrument having a structure, a means for providing a drive signal, and a driver means for providing a drive force to at least one vibratory element, said sustainer comprising:

(a) an momentary ON-OFF switch means for enabling said sustainer to sustain vibration of said vibratory element;

(b) said momentary ON-OFF switch means having a first terminal, a second terminal, and a means for providing a temporary connection between said first terminal and second terminal in response to a temporary actuating force, and;

(c) said structure having a means for supporting said momentary ON-OFF switch means.

* * * * *